US008755721B2

(12) United States Patent
Oshikawa et al.

(10) Patent No.: US 8,755,721 B2
(45) Date of Patent: Jun. 17, 2014

(54) POWDER CONTAINER, POWDER SUPPLY ASSEMBLY, AND IMAGE FORMING APPARATUS IN WHICH A POWDER OUTLET FACES IN AN OPPOSITE DIRECTION AS AN OPENING OF A CONTAINER BODY

(75) Inventors: Yuki Oshikawa, Kanagawa (JP); Emi Kita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 250 days.

(21) Appl. No.: 13/075,641

(22) Filed: Mar. 30, 2011

(65) Prior Publication Data

US 2011/0243579 A1 Oct. 6, 2011

(30) Foreign Application Priority Data

Apr. 1, 2010 (JP) ..... 2010-085101
Jul. 5, 2010 (JP) ..... 2010-152823

(51) Int. Cl.
*G03G 15/08* (2006.01)

(52) U.S. Cl.
USPC ..... 399/262; 399/12

(58) Field of Classification Search
USPC ..... 399/12, 262
See application file for complete search history.

(56) References Cited

U.S. PATENT DOCUMENTS 5,530,531 A 6/1996 Girard
5,903,806 A 5/1999 Matsuoka et al.
7,486,915 B2 * 2/2009 Koyama et al. ..... 399/258
7,773,920 B2 8/2010 Oshikawa
7,783,209 B2 8/2010 Uno et al.
7,962,064 B2 * 6/2011 Asai ..... 399/120
2004/0052538 A1 3/2004 Yugeta et al.
2006/0182469 A1 * 8/2006 Koyama et al. ..... 399/258
2007/0122205 A1 5/2007 Taguchi et al.
2007/0147900 A1 6/2007 Taguchi et al.

(Continued)

FOREIGN PATENT DOCUMENTS

CN 101387850 A 3/2009
JP 10-63078 3/1998

(Continued)

OTHER PUBLICATIONS

Eupropean Search Report issued Jul. 13, 2011, in patent application No. EP 11 15 8751.5.

(Continued)

*Primary Examiner* — G. M. Hyder
(74) *Attorney, Agent, or Firm* — Oblon, Spivak, McClelland, Maier & Neustadt, L.L.P.

(57) ABSTRACT

A powder container includes a powder containing compartment having a powder outlet connectable to a horizontally extending tube of an apparatus in conjunction with installation of the powder container in the apparatus, a removably insertable plug member to open and close the powder outlet in conjunction with installation of the powder container, and at least one discrimination protrusion projecting from an outer circumferential surface of the powder container. The powder contained in the powder containing compartment is discharged from the powder outlet thereof to the tube. A downstream end of the discrimination protrusion is positioned downstream from a downstream end of the powder outlet of the powder containing compartment in an installation direction in which the powder container is installed in the apparatus, and at least one of shape, arrangement, and quantity of the discrimination protrusion is unique to the type of powder contained in the powder container.

15 Claims, 41 Drawing Sheets

(56) References Cited

U.S. PATENT DOCUMENTS

| | | | | |
|---|---|---|---|---|
| 2007/0147902 | A1 | 6/2007 | Taguchi et al. | |
| 2007/0154243 | A1 | 7/2007 | Taguchi et al. | |
| 2007/0154244 | A1* | 7/2007 | Taguchi et al. | 399/262 |
| 2007/0160393 | A1 | 7/2007 | Taguchi et al. | |
| 2007/0160394 | A1 | 7/2007 | Taguchi et al. | |
| 2007/0177886 | A1 | 8/2007 | Taguchi et al. | |
| 2007/0286646 | A1* | 12/2007 | Ichikawa et al. | 399/262 |
| 2008/0175628 | A1 | 7/2008 | Kita et al. | |
| 2008/0181670 | A1 | 7/2008 | Tsuda et al. | |
| 2008/0240792 | A1 | 10/2008 | Kita et al. | |
| 2008/0253810 | A1 | 10/2008 | Tateyama et al. | |
| 2009/0041508 | A1 | 2/2009 | Oshikawa et al. | |
| 2009/0087214 | A1 | 4/2009 | Utsunomiya et al. | |
| 2009/0103935 | A1 | 4/2009 | Uno et al. | |
| 2009/0110425 | A1 | 4/2009 | Uno et al. | |
| 2009/0263164 | A1 | 10/2009 | Koeda et al. | |
| 2011/0002713 | A1 | 1/2011 | Taguchi et al. | |
| 2011/0008075 | A1 | 1/2011 | Taguchi et al. | |
| 2011/0286771 | A1 | 11/2011 | Taguchi et al. | |

FOREIGN PATENT DOCUMENTS

| | | |
|---|---|---|
| JP | 2000-338758 | 12/2000 |
| JP | 2002-91150 | 3/2002 |
| JP | 2004-109367 | 4/2004 |
| JP | 2004-287404 | 10/2004 |
| JP | 2005-241865 | 9/2005 |
| JP | 2005-241868 | 9/2005 |
| JP | 2006-58698 | 3/2006 |
| JP | 2007-140433 | 6/2007 |
| JP | 2008-233667 | 10/2008 |
| JP | 2009-122429 | 6/2009 |
| JP | 2009-211038 | 9/2009 |

OTHER PUBLICATIONS

Combined Chinese Office Action and Search Report issued Apr. 16, 2013, in Patent Application No. 201110079609.9.

Japanese Office Action issued Nov. 22, 2013, in Japan Patent Application No. 2010-085101.

* cited by examiner

POWDER CONTAINER, POWDER SUPPLY ASSEMBLY, AND IMAGE FORMING APPARATUS IN WHICH A POWDER OUTLET FACES IN AN OPPOSITE DIRECTION AS AN OPENING OF A CONTAINER BODY

CROSS-REFERENCE TO RELATED APPLICATIONS

This patent specification is based on and claims priority from Japanese Patent Application Nos. 2010-085101, filed on Apr. 1, 2010, and 2010-152823, filed on Jul. 5, 2010 in the Japan Patent Office, which are hereby incorporated by reference herein in their entirety.

BACKGROUND OF THE INVENTION

1. Field of the Invention

The present invention generally relates to a powder container for containing powder such as toner and an image forming apparatus such as a copier, a printer, a facsimile machine, a plotter, or a multifunction machine capable of at least two of these functions that includes the powder container.

2. Description of the Background Art

In general, electrophotographic image forming apparatuses such as copiers, printers, facsimile machines, or multifunction machines including at least two of these functions include a development device to develop latent images formed on an image carrier. In addition, cylindrical toner containers (bottles) for containing toner, removably installable in main bodies of image forming apparatuses, are widely used.

For example, JP-2004-287404-A proposes a toner bottle that includes a bottle body having an opening on one side, a cap to cover the opening of the bottle body, and a spiral protrusion formed in an inner circumferential surface of the bottle body. As the bottle body rotates, the toner contained in the bottle body is transported along the spiral protrusion to the opening of the bottle body. The cap is retained in the main body in such a way as not to rotate as the bottle body rotates. The toner discharged from the bottle body is discharged outside the toner bottle through a toner outlet formed in the cap and supplied to a development device. The toner outlet is formed on the bottom of the cap so that the toner flows down under its own weight.

The cap includes a shutter to open and close the toner outlet. The shutter opens and closes the toner outlet in conjunction with installation of the toner bottle in the image forming apparatus.

The toner bottle proposed in the JP-2004-287404-A can alleviate leakage of toner in replacement of the toner bottle compared with the toner bottle without the cap because users need not touch the toner outlet owing to the shutter.

Additionally, in JP-2006-058698-A, the cap of the toner bottle includes a nozzle insertion portion into which a nozzle provided in the main body of the image forming apparatus is inserted. The shutter of the toner outlet blocks the nozzle insertion portion when the toner bottle is not installed in the image forming apparatus, to prevent leakage of toner.

Additionally, JP-2008-233667 proposes a toner container in which the shutter to close the toner outlet is movable horizontally, which is identical to a direction in which the toner container is slidingly installed in the apparatus.

Those toner containers typically include discrimination protrusions projecting from outer circumferential surfaces of the toner containers. The shape or arrangement of the discrimination protrusions is unique to each color of toner, and insertion openings formed in the image forming apparatus have a shape that fits only the discrimination protrusion of the toner container for the corresponding color. Such an arrangement ensures that a toner container of the wrong color is prevented from being inserted set in a container mount for specific color in the apparatus.

In particular, in the arrangement in which the toner container is horizontally inserted in the image forming apparatus as in JP-2008-233667, it is important to prevent the toner container of wrong color from being set in the container mount. However, when the toner container of wrong color is inserted, depending on the arrangement of the discrimination protrusions, it is possible that opening the toner outlet of the toner container is already started by the time the discrimination protrusion hits the insertion opening.

Moreover, in JP-2008-233667-A, when the toner container of the wrong color is inserted, it is possible that the shutter jolts due to some reason, thus opening the toner outlet unintentionally, because the direction in which the shutter moves parallels the installation direction of the toner container. As a result, the toner of the wrong color leaks out and onto the container mount.

SUMMARY OF THE INVENTION

In view of the foregoing, an object of this specification is to prevent powder container of a wrong type from being set in a power container mount of an apparatus.

An another object of this specification is to prevent leakage of the power therefrom when a user mistakenly tries to install the powder container of the wrong type in the power container mount of the apparatus.

In one illustrative embodiment of the present invention provides a powder container, removably installable horizontally in an apparatus. The apparatus includes a horizontally extending tube connectable to the powder container.

The powder container includes a powder containing compartment for containing a powder, extending horizontally, and, having a powder outlet connectable to a powder inlet of the tube of the apparatus in conjunction with installation of the powder container in the apparatus, a removably insertable plug member to open and close the powder outlet of the powder containing compartment in conjunction with installation of the powder container in the apparatus, and a discrimination portion including at least one discrimination protrusion projecting from an outer circumferential surface of the powder container. The powder contained in the powder containing compartment is discharged from the powder outlet thereof to the tube via the powder inlet of the tube. The discrimination portion is positioned with a downstream end of the discrimination protrusion downstream from a downstream end of the powder outlet of the powder containing compartment in an installation direction in which the powder container is installed in the apparatus and, at least one of shape, arrangement, and quantity of the protrusion is unique to the type of powder contained in the powder container.

Another illustrative embodiment provides an image forming apparatus that includes the above-described powder container.

Yet another illustrative embodiment provides a powder supply assembly to supply a powder to an apparatus.

The powder supply assembly includes a powder container for containing the powder, having a powder outlet; a container mount provided in the apparatus, in which the powder container is removably installed, a container driving unit to rotate the powder container at least partially to discharge the powder from the powder container through the powder outlet, a container detector to detect whether the powder container is set at the installation position in the container mount, a retainer movable between a retaining position to retain the powder container at an installation position in the container mount and a release position to unlock the powder container from the installation position, a retainer detector to detect whether or not the retainer is at the retaining position, and a controller provided in the apparatus, operatively connected to the container detector as well as the retainer detector to permit or prohibit driving of the container driving unit based on a combination of a detection result generated by the container detector and a detection result generated by the retainer detector.

Yet another illustrative embodiment provides an image forming apparatus that includes the above-described powder supply assembly.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
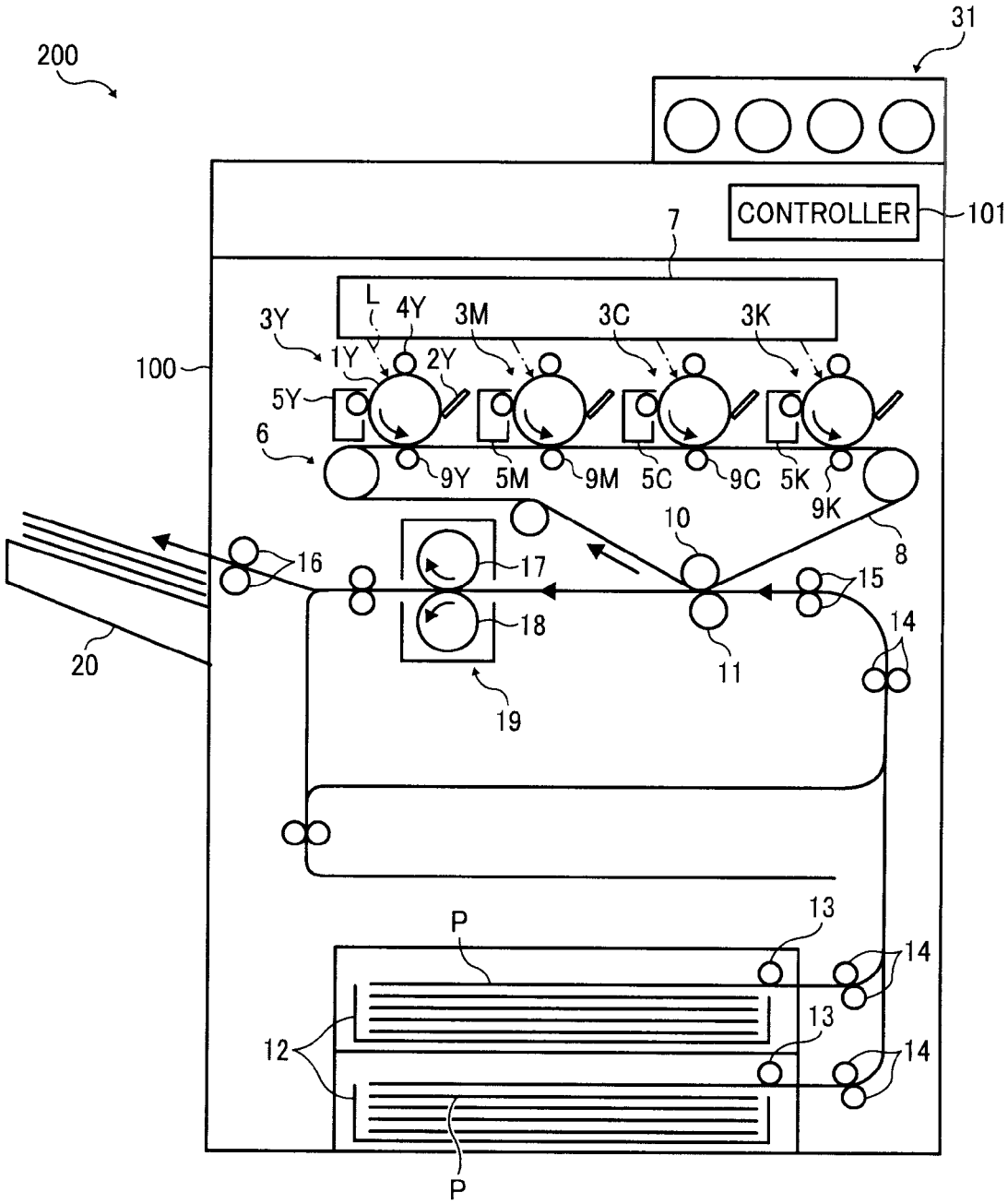
FIG. 1 is a schematic diagram illustrating a configuration of an image forming apparatus according to an illustrative embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Figure 2:
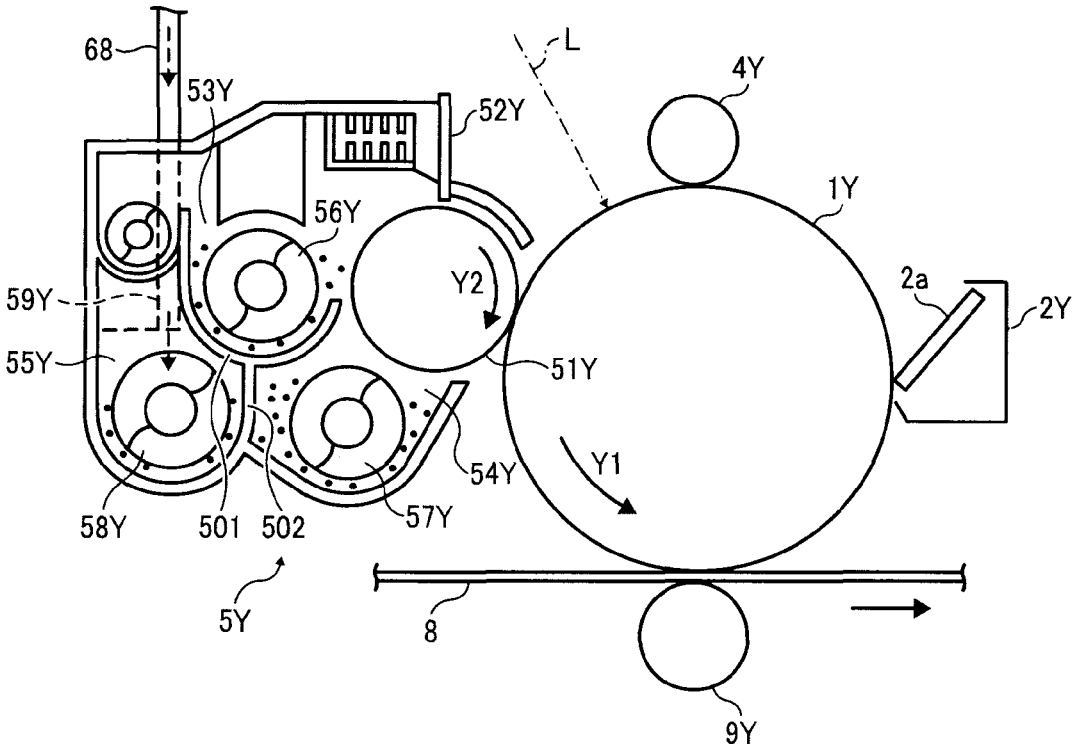
FIG. 2 is a schematic cross-sectional view illustrating a configuration of an image forming unit included in the image forming apparatus shown in FIG. 1.

Referring now to the drawings, wherein like reference numerals designate identical or corresponding parts throughout the several views thereof, and particularly to FIGS. 1 and 2, an electrophotographic image forming apparatus according to an illustrative embodiment of the present invention is described. It is to be noted that the subscripts Y, M, C, and K attached to the end of each reference numeral indicate only that components indicated thereby are used for forming yellow, magenta, cyan, and black images, respectively, and hereinafter may be omitted when color discrimination is not necessary.

First Embodiment

A configuration and operation of an image forming apparatus according to a first embodiment is described below with reference to FIGS. 1 and 2.

As shown in FIG. 1, an image forming apparatus 200 includes a toner container mount 31, serving as a powder container mount, provided above a main body 100 of the image forming apparatus 200. Four toner containers 32Y, 32M, 32C, and 32K (shown in FIG. 3) for containing yellow, magenta, cyan, and black toners, respectively, are removably installed in the toner container mount 31. That is, the toner containers 32Y, 32M, 32C, and 32K are replaceable.

The image forming apparatus 200 according to the present embodiment includes four image forming units 3Y, 3M, 3C, and 3K for forming yellow, magenta, cyan, and black toner images, respectively. Each of the image forming units 3Y, 3M, 3C, and 3K are removably installable in the main body 100.

Figure 3:
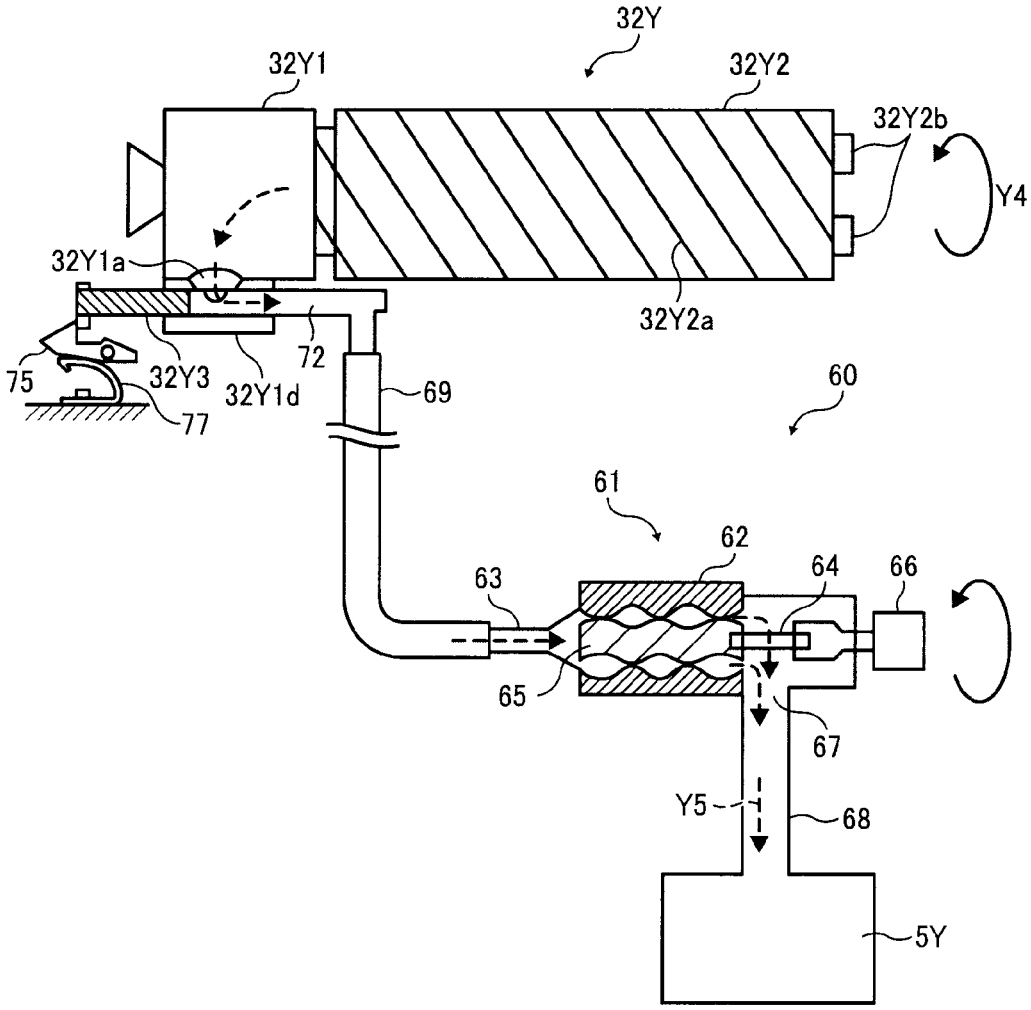
FIG. 3 is a schematic diagram that illustrates a toner supply device and a toner container.

Although not shown in FIG. 1, toner supply devices 60Y, 60M, 60C, and 60K shown in FIG. 3 are provided above the image forming units 3Y, 3M, 3C, and 3K. Each toner supply device 60 supplies the toner contained in the corresponding toner container 32 to a development device 5 of the corresponding image forming unit 3.

Referring to FIG. 2, the image forming unit 3Y for yellow includes a photoreceptor drum 1Y and further includes a charging member 4Y, the development device 5Y, a cleaning unit 2Y, a discharger, and the like provided around the photoconductor drum 1Y. Image forming processes, namely, charging, exposure, development, transfer, and cleaning processes are performed on the photoreceptor drum 1Y, and thus a yellow toner image is formed on the photoreceptor drum 1Y.

It is to be noted that other image forming units 3 have a similar configuration to that of the yellow image forming unit 3Y except the color of the toner used therein and form toner images of the respective colors. Thus, only the image forming unit 3Y is described below and descriptions of other image forming units are omitted.

Referring to FIG. 2, the photoreceptor drum 1Y is rotated counterclockwise in FIG. 2 by a driving motor (not shown). A surface of the photoreceptor drum 1Y is charged uniformly at a position facing the charging member 4Y by the charging member 4Y (charging process).

When the photoreceptor drum 1Y reaches a portion to receive a laser beam L emitted from an exposure unit 7 (shown in FIG. 1), the photoreceptor drum 1Y is scanned with the laser beam L, and thus an electrostatic latent image for yellow is formed thereon (exposure process).

Then, the photoreceptor drum 1Y reaches a portion facing the development device 5Y, where the latent image is developed with toner into a yellow toner image (development process).

When the surface of the photoreceptor drum 1Y carrying the toner image reaches a portion facing the primary-transfer bias roller 9Y via the intermediate transfer belt 8, the toner image is transferred therefrom onto the intermediate transfer belt 8 (primary-transfer process). After the primary-transfer process, a certain amount of toner tends to remain on the photoreceptor drum 1Y.

When the surface of the photoreceptor drum 1Y reaches a position facing the cleaning unit 2Y, a cleaning blade 2*a* of the cleaning unit 2Y mechanically collects any toner remaining on the photoreceptor drum 1Y (cleaning process).

Subsequently, the discharger removes potentials remaining on the surface of the photoreceptor drum 1Y.

Thus, a sequence of image forming processes performed on the photoreceptor drum 1Y is completed.

The above-described image forming processes are performed in the image forming units 3M, 3C, and 3K similarly to the yellow image forming unit 3Y. That is, the exposure unit 7 disposed above the image forming units 3 in FIG. 1 directs laser beams L according to image data onto the photoreceptor drums 1 in the respective image forming units 3. Specifically, the exposure unit 7 includes light sources to emit the laser beams L, multiple optical elements, and a polygon mirror that is rotated by a motor. The exposure unit 7 directs the laser beams L to the respective photoreceptor drums 1 via the multiple optical elements while deflecting the laser beams L with the polygon mirror.

Then, the toner images formed on the respective photoreceptor drums 1 through the development process are transferred therefrom and superimposed one on another on the intermediate transfer belt 8. Thus, a multicolor toner image is formed on the intermediate transfer belt 8.

Referring now to FIG. 1, the intermediate transfer unit 6 includes the intermediate transfer belt 8, the four primary-transfer bias rollers 9, a secondary-transfer backup roller 10, multiple tension rollers, and a belt cleaning unit. The intermediate transfer belt 8 is supported by the multiple rollers and is rotated in the direction indicated by an arrow shown in FIG. 1 as one of the multiple rollers that serves as a driving roller rotates.

The four primary-transfer bias rollers 9 are pressed against the corresponding photoreceptor drums 1 via the intermediate transfer belt 8, and four contact portions between the primary-transfer bias rollers 9 and the corresponding photoreceptor drums 1 are hereinafter referred to as primary-transfer nips. Each primary-transfer bias roller 9 receives a transfer bias whose polarity is opposite the polarity of the toner.

While rotating in the direction indicated by the arrow shown in FIG. 1, the intermediate transfer belt 8 sequentially passes through the respective primary-transfer nips. Then, the single-color toner images are transferred from the respective photoreceptor drums 1 primarily and superimposed one on another on the intermediate transfer belt 8.

Then, the intermediate transfer belt 8 carrying the multicolor toner image reaches a portion facing the secondary-transfer roller 11 disposed facing the secondary-transfer backup roller 10. The secondary-transfer backup roller 10 and the secondary-transfer roller 11 press against each other via the intermediate transfer belt 8, and the contact portion therebetween is hereinafter referred to as a secondary-transfer nip. The multicolor toner image formed on the intermediate transfer belt 8 is transferred onto a sheet P (recording medium) transported to the secondary-transfer nip (secondary-transfer process). A certain amount of toner tends to remain on the intermediate transfer belt 8 after the secondary-transfer process.

When the intermediate transfer belt 8 reaches a position facing the belt cleaning unit, any toner remaining on the intermediate transfer belt 8 is collected by the belt cleaning unit. Thus, a sequence of image forming processes performed on the intermediate transfer belt 8 is completed.

The sheet P is transported by the sheet feeder 12 provided in the lower portion of the main body 100 to the secondary-transfer nip via a feed roller 13, pairs of conveyance rollers 14, and a pair of registration rollers 15. More specifically, the sheet feeder 12 contains multiple sheets P piled one on another. When the feed roller 13 is rotated counterclockwise in FIG. 1, the sheet P on the top is picked up and transported from the sheet feeder 12 to the pair of conveyance rollers 14.

Then, the conveyance rollers 14 transport the sheet P to the pair of registration rollers 15. The registration rollers 15 stop the sheet P by clamping the sheet P therebetween and then forward the sheet P to the secondary-transfer nip, timed to coincide with the arrival of the multicolor toner image formed on the intermediate transfer belt 8. Thus, the multicolor toner image is recorded on the sheet P.

Subsequently, the sheet P onto which the multicolor image is transferred is transported to the fixing device 19. In the fixing device 19, the multicolor toner image is fixed on the sheet P with heat from a fixing roller 17 and pressure exerted by a pressure roller 18.

Then, the sheet P is discharged by a pair of discharge rollers 16 outside the apparatus and stacked on the stack tray 20 as an output image.

Thus, a sequence of image forming processes performed in the image forming apparatus 200 is completed. It is to be noted that the main body 100 of the image forming apparatus 200 further includes a controller 101 that is may be a computer including a central processing unit (CPU) and associated memory units (e.g., ROM, RAM, etc.), for example. The controller 101 performs various types of control processing by executing programs stored in the memory. Field programmable gate arrays (FPGA) may be used instead of the CPU.

Next, a configuration and operation of the development device 5Y in each image forming unit is described in further detail below with reference to FIG. 2.

The development device 5Y includes a development roller 51Y disposed facing the photoreceptor drum 1Y, a doctor blade 52Y disposed facing the development roller 51Y, a supply screw 56Y, a collecting screw 57, an agitation screw 58Y, and a toner concentration detector to detect the concentration of toner in the developer. A casing of the development device 5Y serves as a developer container and is divided, at least partially, into a supply compartment 53Y, a collecting compartment 54Y, and an agitation compartment 55Y (also collectively "the developer conveyance compartments 53Y, 54Y, and 55Y") in which the supply screw 56Y, the collecting screw 57Y, and the agitation screw 58Y are respectively provided. The development roller 51Y includes a magnet roller or multiple magnets fixed in position relative to the casing of the development device 5Y, a sleeve that rotates around the magnet, and the like. Two-component developer consisting essentially of carrier (carrier particles) and toner (toner particles) is contained in the developer conveyance compartments 53Y, 54Y, and 55Y. The toner contained in the toner container 32Y is supplied through a port 59Y formed above the agitation compartment 55Y.

Arrangement of the components of the development device 5 is described in further detail below.

The supply compartment 53Y faces the development roller 51Y, and the developer contained in the supply compartment 53Y is supplied to the development roller 51Y. While supplying the developer to the developing roller 51Y, the supply screw 53Y provided in the supply compartment transports the developer in an axial direction of the development roller 51Y toward a back side of paper on which FIG. 2 is drawn. The doctor blade 52Y, serving as a developer regulator, that adjusts the amount of developer supplied to the development roller 51 to a desired or given layer thickness is positioned downstream from a portion where the development roller 51Y faces the supply screw 56Y in a direction in which the development sleeve rotates, indicated by arrow Y2.

The collection compartment 54Y is facing the development roller 51Y at a position downstream in the rotational direction of the development sleeve from a development area where the development roller 51Y faces the photoreceptor drum 1Y. The developer that has passed the development area and been separated from the development roller 51Y (hereinafter "developer after development") is collected in the collection compartment 54Y. The collecting screw 57Y is positioned in parallel to the axial direction of the development roller 51Y in the collection compartment 54Y. The collecting screw 57Y is spiral-shaped and transports the developer in the direction identical or similar to the direction in which the supply screw 56Y transports the developer (hereinafter "developer conveyance direction"). The developing roller 51Y and the supply compartment 53Y in which the supply screw 56Y is provided are arranged laterally, and the collection compartment 54Y in which the collecting screw 57Y is provided is positioned beneath the development roller 51Y.

It is to be noted that the magnets provided inside the development sleeve are arranged so that no magnetic pole is present in a portion where the developer is to be separated from the development roller 51Y (release portion) to enable separation of the developer from the development roller 51Y. Alternatively, the magnets may be arranged to generate a repulsive magnetic field in the portion where the developer is to be separated from the development roller 51Y.

The agitation compartment 55Y is positioned beneath the supply compartment 53Y in parallel to the collection compartment 54Y. The agitation screw 58Y provided in the agitation compartment 55Y is shaped like a spiral and parallels the axial direction of the development roller 51Y. While agitating the developer, the agitation screw 58Y transports the developer in the axial direction of the development roller 51Y toward a front side of paper on which FIG. 2 is drawn, which is opposite the developer conveyance direction by the supply screw 56Y.

The developing unit 5Y further includes a first partition 501 including a portion separating the supply compartment 53Y from the agitation compartment 55Y. Although separated by the first partition 501, the supply compartment 53Y and the agitation compartment 55Y communicates with each other in both end portions in the direction perpendicular to the surface of paper on which FIG. 2 is drawn, through openings, namely, a first communication portion and a third communication portion respectively formed on the front side and the back side of paper on which FIG. 2 is drawn.

It is to be noted that the supply compartment 53Y and the collection compartment 54Y are separated by the first partition 501 as well, and no opening is formed in that portion of the first partition 501. Thus, the supply compartment 53Y does not communicate with the collection compartment 54Y.

The development device 5Y further includes a second partition 502 that includes a portion separating the agitation compartment 55Y from the collection compartment 54Y. Although separated by the second partition 502, an opening (second communication portion) through which the agitation compartment 55Y communicates with the collection compartment 54Y is formed in the second partition 502, in an end portion, that is, on the back side of paper on which FIG. 2 is drawn.

The development device 5Y configured as described above operates as follows.

The development sleeve of the development roller 51Y rotates in the direction indicated by arrow Y2 shown in FIG. 2. The developer held on the development roller 51Y by the magnetic field generated by the magnets is transported as the development sleeve rotates.

The ratio of the toner to the carrier (the concentration of toner) in the developer contained in the development device 5Y is adjusted within a predetermined range. More specifically, the toner supply device 60Y supplies toner from the toner container 32Y to the agitation compartment 55Y according to the consumption of toner in the development device 5Y. The configuration and operation of the toner supply device 60 are described in further detail later.

The toner supplied to the agitation compartment 55Y is transported to the front side of paper on which FIG. 2 is drawn through the agitation compartment 55Y by the agitation screw 58Y while mixed with the developer. The developer that has reached a downstream end portion of the supply compartment 53Y is supplied therefrom to the supply compartment 53Y through the opening (first communication portion) of the first partition 501, which is positioned in the downstream end portion in the developer conveyance direction by the agitation screw 58Y and in an upstream end portion (proximal end portion) in the developer conveyance direction by the supply screw 54Y.

Then, the supply screw 56Y transports the developer supplied from the agitation compartment 55Y to the supply compartment 53Y downstream in the supply compartment 53Y while supplying it to the development roller 51Y. Then, the developer that is not supplied to the development roller 51Y (excessive developer) but is transported to the downstream end portion of the supply compartment 53Y is transported through the opening (third communication portion) formed in the first partition 501 to the agitation compartment 55Y.

The developer carried on the development roller 51Y is transported in the direction indicated by arrow Y2 in FIG. 2 to the doctor blade 52Y. The amount of the developer on the development roller 51Y is adjusted to a suitable amount by the doctor blade 52Y, after which the developer is carried to the development area facing the photoreceptor drum 1Y. Then, the toner in the developer adheres to the latent image formed on the photoreceptor drum 1Y due to the effect of the magnetic field generated in the development area. Subsequently, the developer remaining on the development roller 51Y is separated from the development roller 51Y and drops to the collection compartment 54Y. The developer collected from the development roller 51Y in the collection compartment 54Y is transported by the collection screw 57Y to a downstream end portion of the collection compartment 54Y in the conveyance direction therein, after which the collected developer is transported to the agitation compartment 58Y through the opening or second communication portion.

While being mixed with the toner supplied to the agitation compartment 55Y, the excessive developer and the collected developer supplied to the agitation compartment 55Y are transported by the agitation screw 58Y through the agitation compartment 55Y to the front side of paper on which FIG. 2 is drawn. Then, the mixed developer is supplied through the opening or first communication portion of the first partition 501 to the supply compartment 53Y.

The toner concentration detector is provided beneath the agitation compartment 55Y, and toner is supplied by the toner supply device 60 from the toner container 32Y according to outputs from the toner concentration detector. The toner concentration detector may be a magnetic permeability sensor, for example.

Next, a toner supply assembly according to the first embodiment is described below. The toner supply device 60, the toner container 32, the toner container mount 31 provided in the main body 100, and the controller 101 together form the toner supply assembly.

Figure 4:
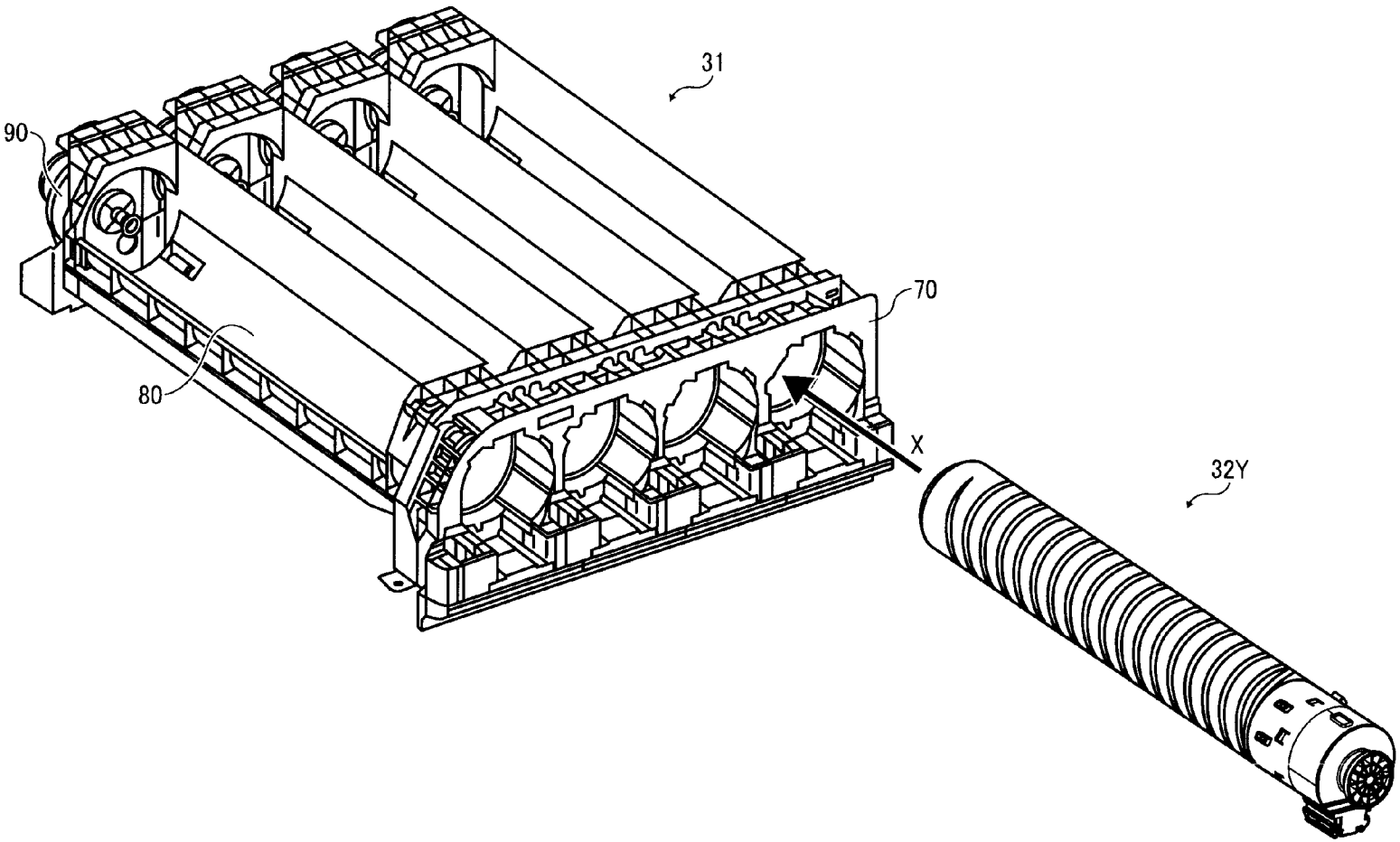
FIG. 4 is a perspective view of a toner container mount.

FIG. 3 is a schematic diagram that illustrates supply of toner by the toner supply device 60 from the toner container 32 to the development device 5, and FIG. 4 is a perspective view of the toner container mount 31.

Referring to FIG. 4, the toner container mount 31 serving as a powder container mount includes a bottle fixing portion 70 (powder container engagement portion), bottle guides 80 (powder container guides), a bottle driving unit 90 (powder container driving unit). The toner container 32Y is installed in and removed from the toner container mount 31 through the bottle fixing portion 70. The toner container 32Y is installed in the toner container mount 31 horizontally, which is a direction indicated by arrow X shown in FIG. 4. It is to be noted that the term "horizontally" used in this specification is not limited to an exact horizontal direction but includes substantially horizontal directions.

Referring to FIG. 3, the toner container 32 is described below.

The toner container 32Y according to the present embodiment is a substantially cylindrical toner bottle and includes a cap 32Y1 and container body 32Y2. A spiral protrusion 32Y2*a* protrudes inward from an inner circumferential face of the container body 32Y2. In other words, a spiral groove is formed in an outer circumferential surface of the toner container 32Y. In a lower portion of the cap 32Y1, a toner outlet 32Y1*a* and toner discharge portion 32Y1*d* are provided. The cap 32Y1 further includes a plug 32Y3 to close the toner outlet 32Y1*a*.

Figure 5:
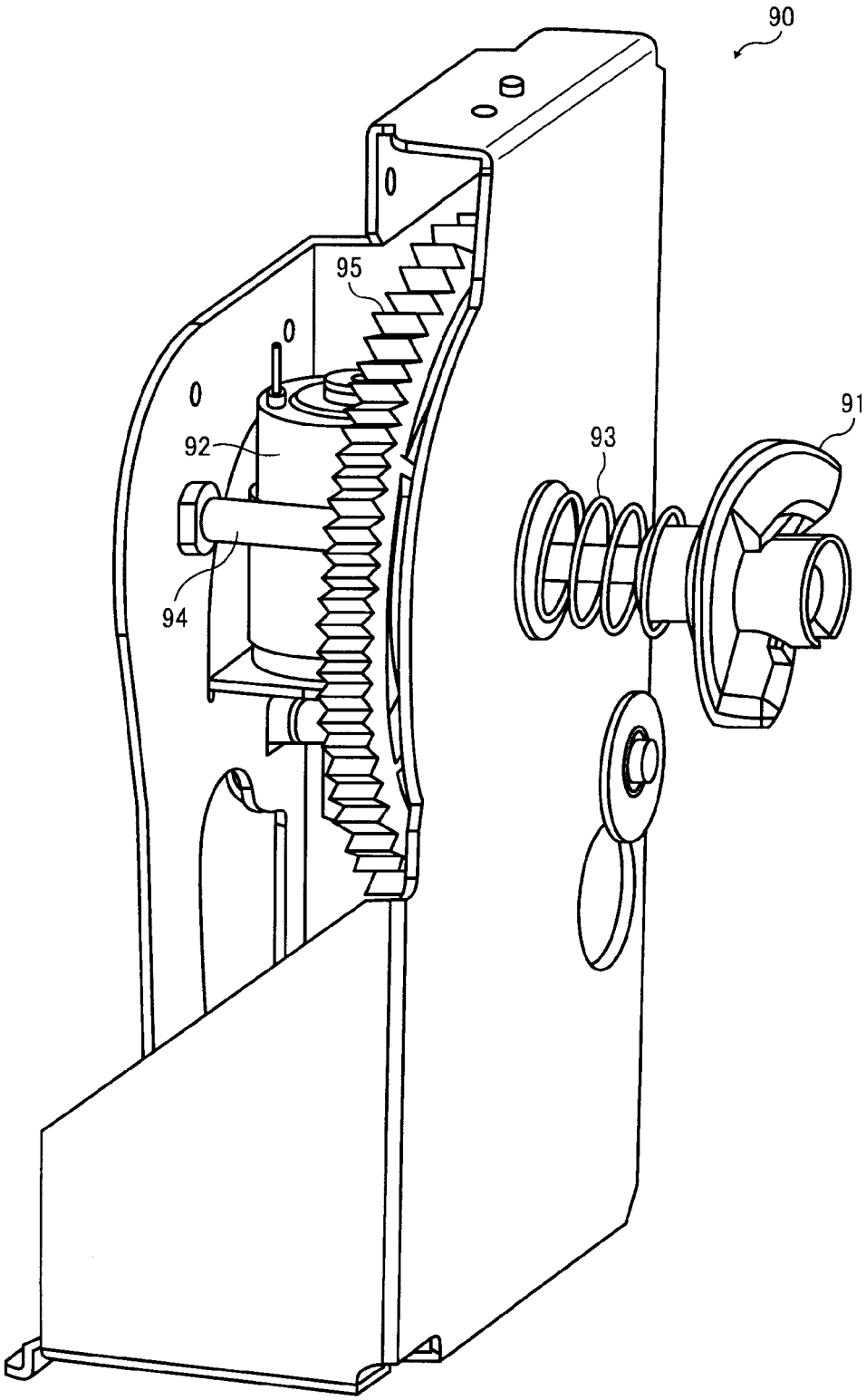
FIG. 5 is a perspective view of a bottle driving unit.

The spiral protrusion 32Y2*a* is formed on the inner circumferential surface of the toner container 32Y for discharging the toner in the container body 32Y2 to a space (toner reservoir 32Y1*k* shown in FIG. 26) inside the cap 32Y1 when the container body 32Y2 is rotated in a direction indicated by arrow Y4 shown in FIG. 3 by the bottle driving unit 90 (shown in FIG. 5) provided in the main body 100 of the image forming apparatus 200. As shown in FIG. 5, the driving unit 90 includes a motor 92, driving coupling 91, a spring 93, and the like. It is to be noted that, reference character 32Y2*b* shown in FIG. 3 represents a pair of driving input parts. That is, the container body 32Y2 of the toner container 32Y is rotated by the bottle driving unit 90 as required, thus supplying the toner from the toner container 32Y through the toner outlet 32Y1*a* formed in the bottom of the space 32Y1*k* in the cap 32Y1 to the development device 5.

It is to be noted that, when the respective service life of the toner containers 32Y, 32M, 32C, and 32K have expired, that is, when almost all toner in the toner container 32 have been consumed, the old one is replaced with a new one. The structure of the toner container 32 is described in further detail later.

Next, referring to FIG. 3, the toner supply device 60Y to supply the toner contained in the toner container 32Y to the development device 5Y is described in further detail below.

The respective color toners contained in the toner containers 32Y, 32M, 32C, and 32K in the toner container mount 31 are supplied to the corresponding developing devices 5Y, 5M, 5C, and 5K by the toner supply devices 60Y, 60M, 60C, and 60K according to the amount of the corresponding toner consumed. The four toner supply devices 60 have a similar configuration except the color of the toner used therein. The toner supply device 60 includes a screw pump 61, a conveyance pipe 68, and a tube 69 connected to the screw pump 61. The screw pump 61 includes a stator 62, a suction inlet 63, a universal joint 64, a rotor 65, and a motor 66.

The plug 32Y3 is contained in a nozzle connection compartment or insertion hole 32Y1*b* (shown in FIG. 6) of the toner container 32Y, and thus the nozzle connection compartment 32Y1*b* serves as a tube connection compartment. A nozzle 72, serving as a tube, of the toner container mount 31 is inserted into the nozzle connection compartment 32Y1*b* in conjunction with the installation of the toner container 32Y. At that time, the plug 32Y3 to close the toner container 32Y is clamped between the nozzle 72 and a pawl 75 and opens the toner outlet 32Y1*a* (powder outlet). Then, the toner outlet 32Y1*a* communicates with a toner inlet 72*a* (shown in FIGS. 6 and 7), serving as a powder inlet, formed in one end (first end) portion of the nozzle 72, and accordingly the toner contained in the container body 32Y2 is conveyed through the toner outlet 32Y1*a* into the nozzle 72.

The other end portion (second end portion) of the nozzle 72 is connected to a first end of the tube 69 forming a toner supply route. The tube 69 is formed of a flexible material resistant to toner, and a second end of the tube 69 is connected to the screw pump 61. For example, the screw pump 61 is a uniaxial eccentric screw pump.

The tube 69 has an inner diameter of within a range of from 4 mm to 10 mm. Examples of the material of the tube 69 include rubbers of polyurethane, nitrile, ethylene-propylene-diene monomer (EPDM), silicone, and the like; and resins of polyethylene, nylon, and the like. Using the flexible tube 69 can enhance flexibility in layout of the toner supply route. Thus, the image forming apparatus 200 can be more compact.

In the present embodiment, the screw pump 61 is a suction-type uniaxial eccentric screw pump. The rotor 65, the stator 62, the universal joint 64, and the like are housed in a casing. The stator 62 is shaped like a female screw or internal thread formed of an elastic material such a rubber, and a double-pitch spiral groove is formed inside the stator 62. The rotor 65 is formed of a rigid material such as metal and shaped like a male screw, that is, twisted into a spiral. The rotor 65 is inserted in the stator 62 rotatably. One end of the rotor 65 is connected to the motor 66 via the universal joint 64.

The screw pump 61 as described above generates a suction force at the suction inlet 63 by rotating the rotor 65 inside the stator 62 in a predetermined direction with the motor 66. In other words, the screw pump 61 generates a negative pressure inside the tube 69 by evacuating air from the tube 69. Thus, the toner inside the toner container 32Y is sucked into the suction inlet 63 via the tube 69 together with the air inside the toner container 32Y. Then, the toner is attracted into the gap between the stator 62 and the rotor 65 from the suction inlet 63 and conveyed to the side opposite the suction inlet 63. The toner is further conveyed through the conveyance pipe 68 to the development device 5Y as indicated by broken arrow Y5 shown in FIG. 3.

It is to be noted that, a hopper may be installed between the screw pump 61 and the development device 5Y for temporarily storing the toner supplied to the development device 5Y.

Next, the toner container mount 31 of the image forming apparatus 200 in which the toner containers 32 are installed is described in further detail below with reference to FIGS. 5 through 18.

FIG. 5 is a perspective view of the bottle driving unit 90 provided on the downstream side (dismal side) in the direction in which the toner container 32 is installed (hereinafter "installation direction of the toner container 32"). The bottle driving unit 90 includes the driving coupling 91, the motor 92, the spring 93, and a shaft 94 as shown in FIG. 5. The driving coupling 91 is positioned to engage the driving input parts 32Y2*b* formed on the bottom of the container body 32Y2 (in FIG. 3, on the right) opposite the cap 32Y1 (see also FIG. 20). The driving coupling 91 and the motor 92 are connected with each other via the shaft 94 and a gear 95 provided at the shaft 94. The driving force of the motor 92 is transmitted to the driving coupling 91 via the shaft 94 and the gear 95 and rotates the container body 32Y2 of the toner container 32Y that engages the driving coupling 91 in the predetermined direction. The spring 93 is wound around the shaft 94 and biases the driving coupling 91 to the upstream side (proximal side) in the installation direction of the toner container 32Y.

Figure 6:
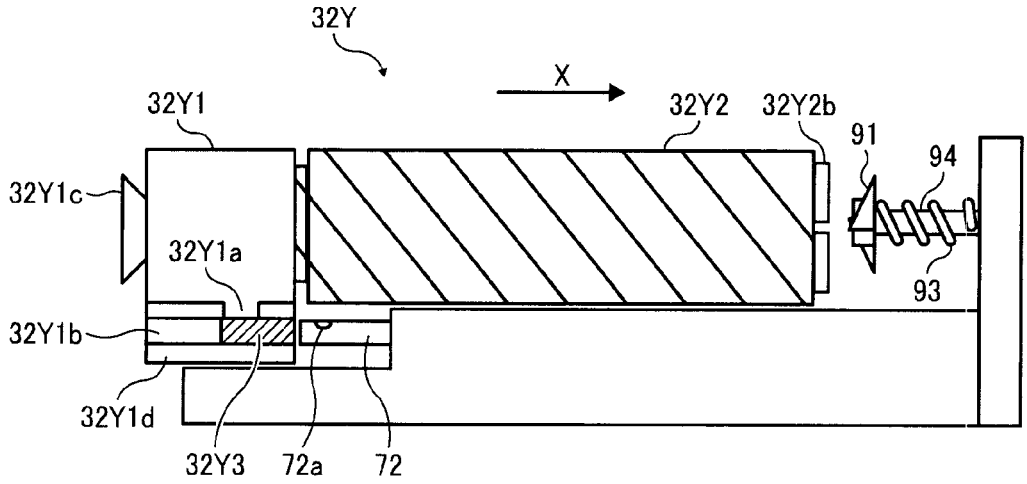
FIG. 6 is a schematic diagram that illustrates an engagement process of the toner container between the bottle driving unit.
Figure 7:
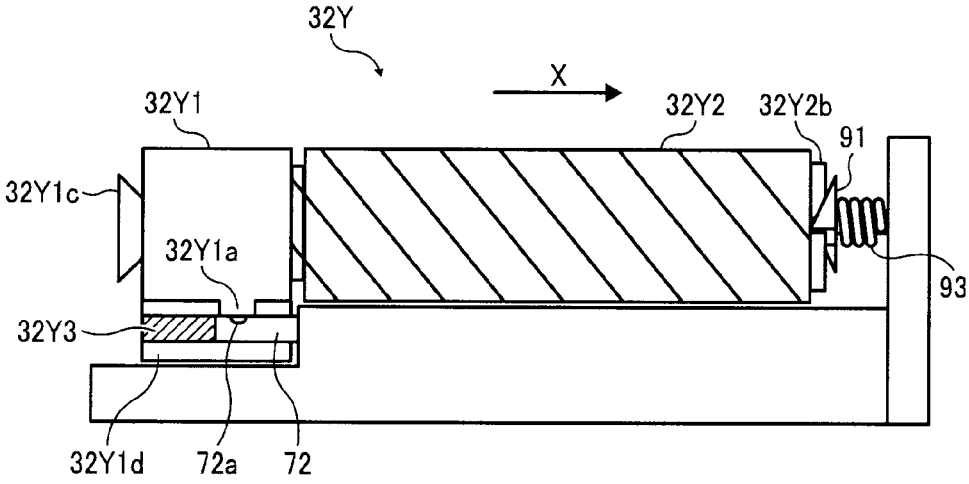
FIG. 7 is a schematic diagram that illustrates the toner container engaged with the bottle driving unit.

More specifically, referring to FIGS. 6 and 7, the driving coupling 91 is movable reciprocally in parallel to the installation direction of the toner container 32Y is biased to the upstream side in the installation direction of the toner container 32Y (to the left in FIG. 6) by the spring 93. When the toner container 32Y moves in the direction indicated by arrow X shown in FIG. 6 and is set in the toner container mount 31, the driving coupling 91 engaging the driving input part 32Y2 moves to the downstream side in the installation direction of the toner container 32Y (to the right in FIG. 6), pushed by the toner container 32Y (see also FIG. 7). At that time, the driving coupling 91 presses the toner container 32Y to the upstream side in the installation direction of the toner container 32Y (to the left in FIG. 7), urged by the spring 93. Additionally, as shown in FIGS. 6 and 7, the toner container 32Y further includes a handle 32Y1*c* provided on a head side (proximal side) of the container body 32Y2, which is on the left in FIGS. 6 and 7, opposite the dismal side of the container body 32Y2 on which the driving input parts 32Y2*b* are provided.

In removing the toner container 32Y from the toner container mount 31, when the toner container 32Y is released from the toner container mount 31, the spring 93 pushes the toner container 32Y in the direction in which the toner container 32 32Y is removed (hereinafter "removal direction"), which is to the left in FIG. 7. In other words, the toner container 32Y pops out from an insertion opening (insertion portion) 71, shown in FIG. 8, formed in the bottle fixing portion 70 of the toner container mount 31 (pop-up action). Then, users can grip the handle 32Y1*c* and remove the toner container 32Y from the main body 100 of the image forming apparatus 200 easily. It is to be noted that the insertion opening 71Y is defined by an interior of a cap holder 71Y-1 (shown in FIG. 9) in which the cap of the toner container 32Y is contained.

Next, the bottle fixing portion 70 is described in further detail below with reference to FIG. 8.

The bottle fixing portion 70 includes the insertion opening 71 (also shown in FIG. 18), the nozzle 72, an antenna board 74 serving as a communication circuit, the pawl 75 to bias the plug 32Y3 in the direction to close the toner outlet 32Y1*a* of the toner container 32Y, a fixing and release lever 76 (hereinafter also simply "lever 76") to fix and release the toner container 32Y from the toner container mount 31, a pair of positioning protrusions 78.

The bottle fixing portion 70 holds the caps 32Y1, 32M1, 32C1, and 32K1 of the toner containers 32Y, 32M, 32C, and 32K not to rotate. That is, the bottle fixing portion 70 includes four cap holders in which the respective caps of the toner containers 32 are housed. The bottle fixing portion 70 includes an upper front case 701 and a lower front case 702 of the bottle fixing portion 70.

Figure 9:
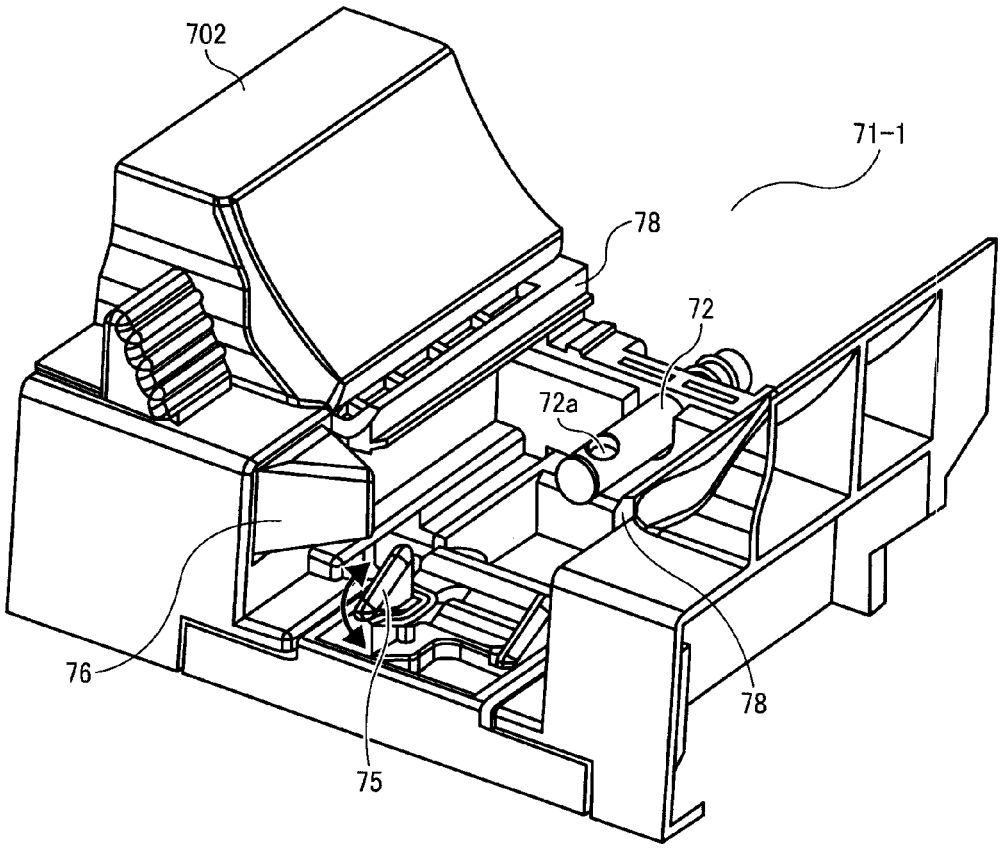
FIG. 9 is a perspective view that illustrates a vicinity of a lower front case of the bottle fixing portion.
Figure 10:
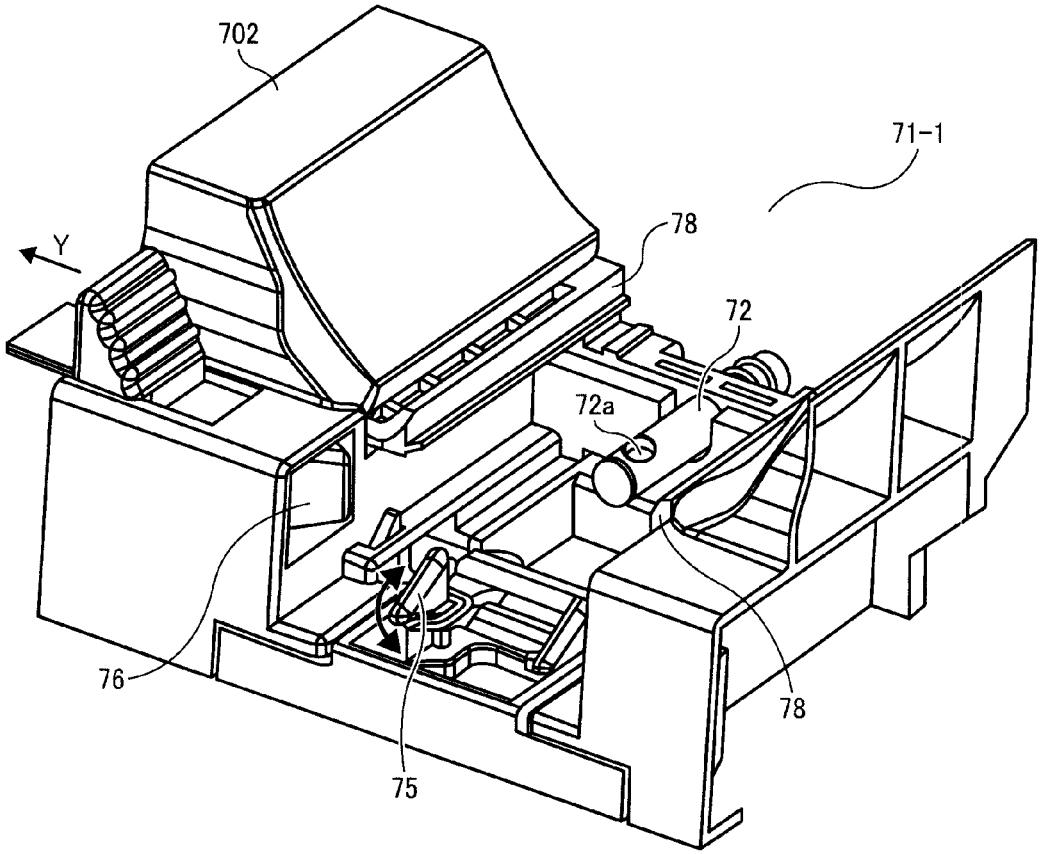
FIG. 10 is another perspective view that illustrates the vicinity of the lower front case.

FIGS. 9 and 10 are enlarged perspective views of the lower front case 702. In FIGS. 9 and 10, reference character 71-1 represents the cap holder. Referring to FIG. 9, the lower front case 702 includes the positioning protrusions 78 to set the cap 32Y1 in position in conjunction with installation of the cap 32Y1. In the present embodiment, the positioning protrusions 78 protrude from the inner face of the bottle fixing portion 70 defining the cap holder 71Y1 in which the cap 32Y1 is held. The positioning protrusions 78 extend in the installation direction of the toner container 32Y and are provided on either side symmetrically about a long axis, that is, a line passing through a center axis of the nozzle 72.

In each cap holder 71Y-1 of the bottle fixing portion 70, the nozzle 72 extends horizontally, that is, in the installation direction of the toner container 32. The toner inlet 72*a* serving as the powder inlet is formed in a top portion of the first end portion of the nozzle 7. That is, the toner inlet 72*a* faces up so as to receive toner from above.

The pawl 75 is positioned in a bottom portion of the bottle fixing portion 70, beneath the cap 32Y1 when the cap 32Y1 is fixed in the cap holder 71-1 of the bottle fixing portion 70. The pawl 75 serves as a biasing member that biases the plug 32Y3 in the direction in which the toner outlet 32Y1*a* is closed in conjunction with removal of the cap 32Y1. The pawl 75 is supported on the lower case 702 rotatably around a shaft 75*a* (shown in FIGS. 34 and 37) in both directions as indicated by arrow shown in FIG. 9. A leaf spring 77 (shown in FIG. 33) provided beneath the pawl 75, biases the pawl 75 from a position where the pawl 75 does not hinder installation and removal of the cap 32Y1 to a position to contact the plug 32Y3. That is, the pawl 75 is biased upward.

Additionally, the lever 76 to fix and release the toner container 32Y from the bottle fixing portion 70 is provided on the front of the insertion opening 71 and a lateral side of the insertion opening 71.

Figure 11:
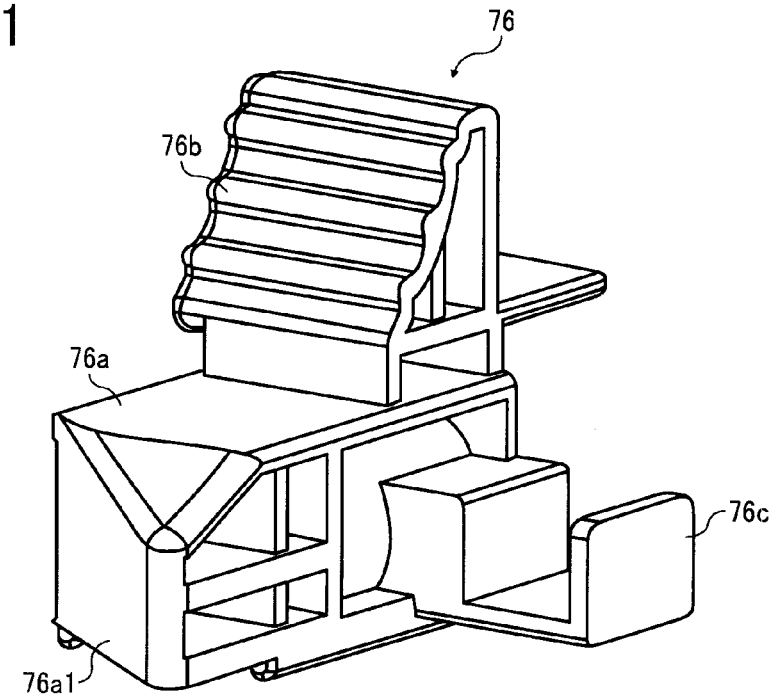
FIG. 11 is a perspective view of a lever for fixing and releasing the toner container.

FIG. 11 is a perspective view of the lever 76. Referring to FIG. 11, the lever 76 includes a pawl 76*a* to set the toner container 32Y in position and retain it, a lever portion 76*b*, and a rib 76*c*. Referring to in FIGS. 9 and 10, the lever 76 can move reciprocally in a horizontal direction (lateral direction in FIGS. 9 and 10) substantially perpendicular to the installation direction of the toner container 32Y, which is the direction indicated by arrow Y and the opposite direction. The lever 76 is biased by a spring 76*d* (shown in FIG. 12) to the insertion opening 71, that is, to the right in FIGS. 9 and 10. As shown in FIG. 10, the user can slide the lever 76 to the position (release position) not to protrude into the insertion opening 71 in the direction indicated by arrow Y, opposite the direction in which the spring 76*d* biases the lever 76, by pushing the lever portion 76*b* with his/her finger. It is to be noted that, in FIG. 11, reference character 76*a*1 represents a sloped surface 76*a* of the pawl 76*a*.

Figure 12:
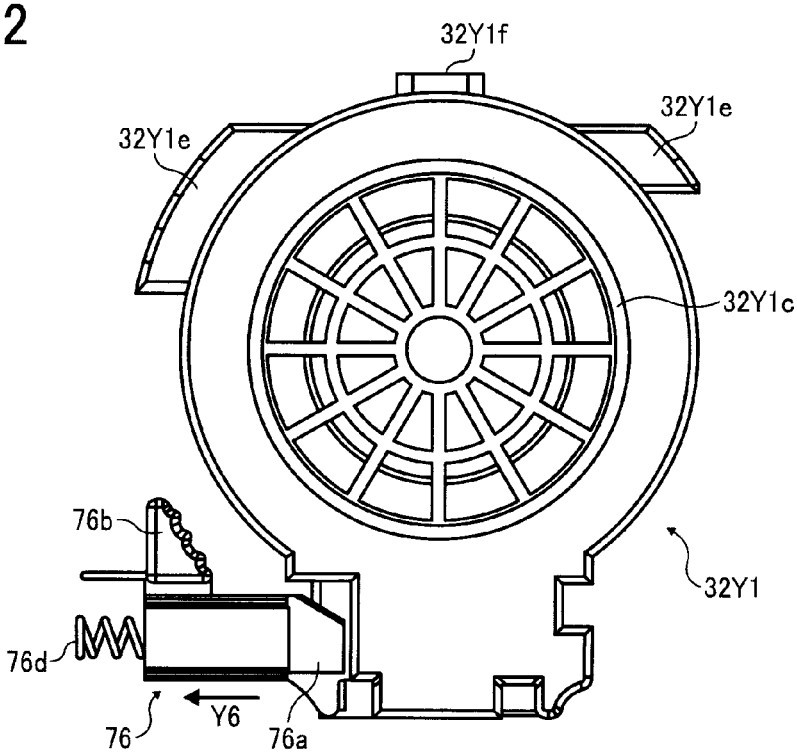
FIG. 12 is a front view that illustrates the lever when the toner container is installed in the toner container mount.
Figure 13:
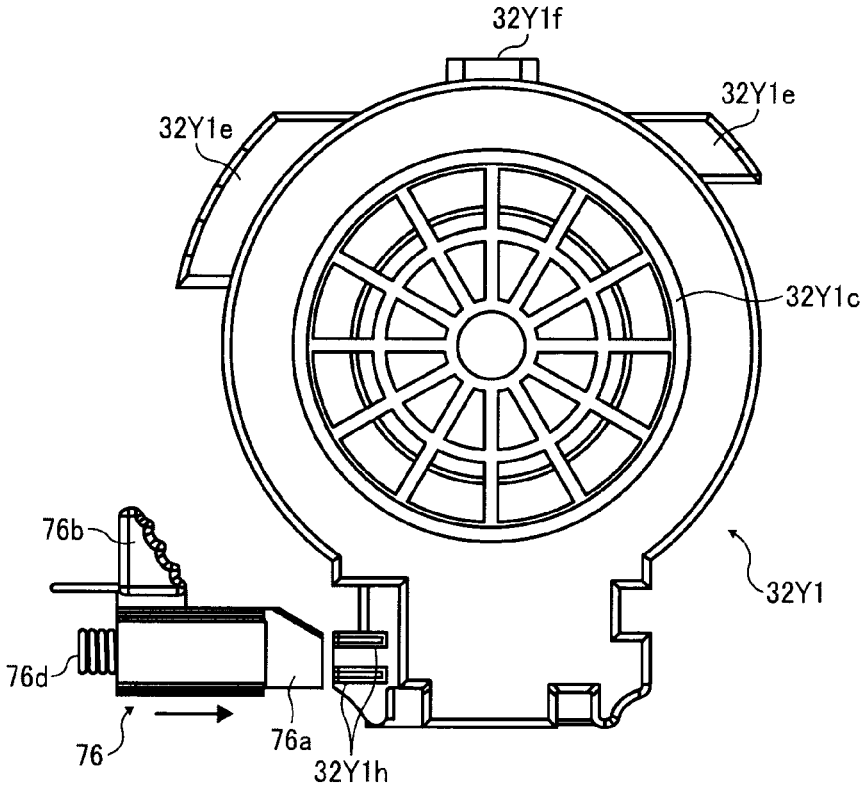
FIG. 13 is a front view that illustrates the lever when the toner container is being inserted into the toner container mount.

FIGS. 12 and 13 are end-on axial views that illustrate relative positions of the cap 32Y1 of the toner container 32Y contained in the toner container mount 31 and the lever 76 from the proximal (upstream) side in the installation direction of the toner container 32Y. Reference characters 32Y1*e*, 32Y1*f*, and 32Y1*h* respectively represent color discrimination protrusions, an identification chip (ID chip) that is an electronic board (electronic data storage unit), and a pressed portion against which the pawl 76*a* is pressed. In FIG. 12, the cap 32Y1 is fixed in position and retained in the bottle fixing portion 70 by the lever 76, and, in FIG. 13, the lever 76 is moved in the direction indicated by arrow Y (to the left in FIG. 13), and thus the toner container 32 is unlocked.

As described above with reference to FIGS. 6 and 7, the toner container 32Y installed in the toner container mount 31 is biased by the driving coupling 91 to the upstream side in the installation direction of the toner container 32Y (to the front side of paper on which FIG. 12 is drawn). The lever 76 urged by the spring 76*d*, however, hinders removal of the toner container 32Y when the lever 76 is at the retaining position shown in FIG. 12, that is, when the lever 76 protrudes into the insertion opening 71Y (see also FIG. 18), biased by the spring 76*d*. Thus, the lever 76 can retain the toner container 32Y in the toner container mount 31.

Next, operation of the fixing and release lever 76 is described in further detail below.

Figure 14:
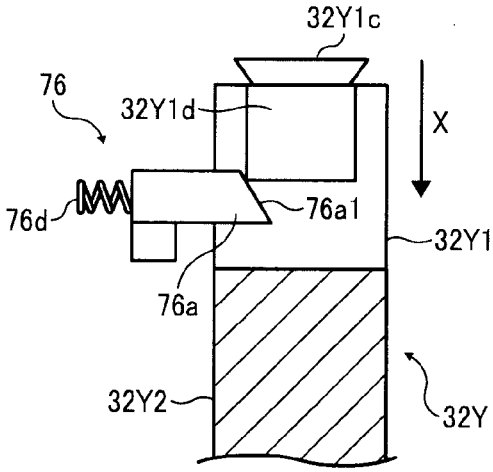
FIG. 14 is a schematic view that illustrates installation of the toner container into the toner container mount as viewed from the bottom of the toner container.

FIGS. 14 through 17 are schematic views that illustrate installation of the toner container 32Y into the toner container mount 31 as viewed from the bottom side of the toner container 32Y on which the toner discharge portion 32Y1*d* is provided. Arrow X indicates the installation direction of the toner container 32Y in the toner container mount 31 (hereinafter "the installation direction X"). Referring to FIG. 14, when the toner container 32Y is inserted into the toner container mount 31 in the installation direction X, the toner discharge portion 32Y1*d* of the toner container 32Y contacts the sloped surface 76*a*1 of the pawl 76*a* protruding into the insertion opening 71Y.

Figure 15:
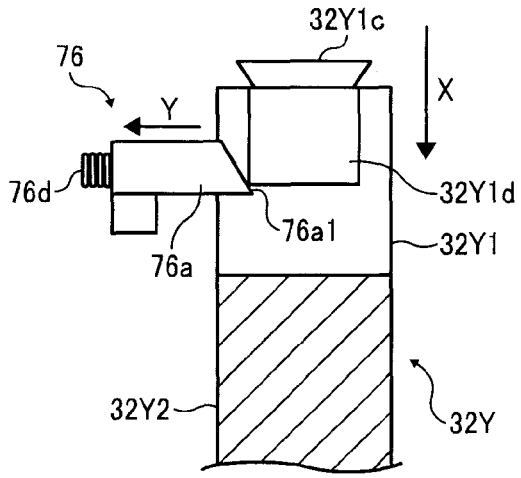
FIG. 15 is schematic view that illustrates a state subsequent to that shown in FIG. 14 in installation of the toner container as viewed from the bottom of the toner container.
Figure 16:
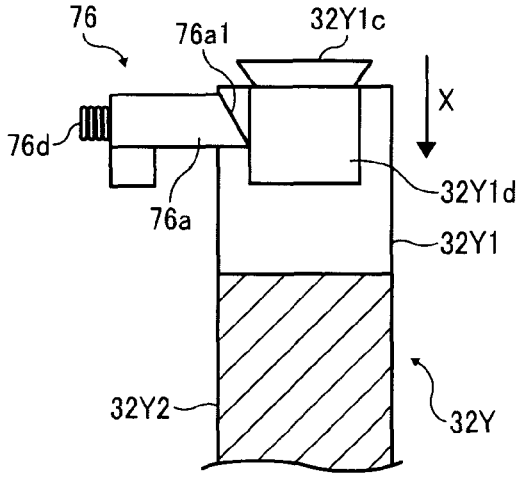
FIG. 16 is schematic view that illustrates a state subsequent to that shown in FIG. 15 in installation of the toner container as viewed from the bottom of the toner container.

Referring to FIG. 15, when the toner container 32Y is inserted further, the portion of the toner discharge portion 32Y1*d* in contact with the sloped surface 76*a*1 slides along the sloped surface 76*a*1 and pushes the lever 76 in the direction indicated by arrow Y (hereinafter "direction Y"), opposite the direction in which the spring 76*d* biases the lever 76. When the pawl 76*a* of the lever 76 is pushed to the release position not to protrude into the insertion opening 71Y, the lever 76 does not hinder installation of the toner container 32Y. Then, as shown in FIG. 16, the toner container 32Y moves further in the installation direction X with the toner discharge portion 32Y1*d* in sliding contact with a tip portion of the pawl 76*a*.

When the toner container 32Y is fully inserted into the toner container mount 31, the toner discharge portion 32Y1*d* of the toner container 32Y is positioned downstream (on dismal side) from the lever 76 in the installation direction X. That is, the lever 76 is positioned beneath the lever 76 in FIG. 17. In this state, the lever 76 that has been in contact with the toner discharge portion 32Y1*d* and thus been pressed by it is no longer moved by the toner discharge portion 32Y1*d*. Accordingly, the lever 76 moves back in the direction indicated by arrow Z shown in FIG. 17 to the retaining position where the lever 76 protrudes into the insertion opening 71 as shown in FIG. 12. The toner container 32Y is clamped between the driving coupling 91 of the bottle driving unit 90 and the lever 76, thereby fixed in position and retained at that position in the installation direction.

Next, removal of the toner container 32 from the toner container mount 31 of the image forming apparatus 200 is described below.

Figure 17:
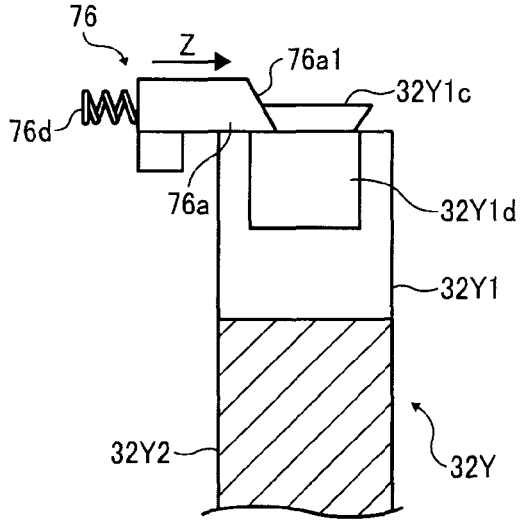
FIG. 17 is a schematic view that illustrates the toner container secured in the toner container mount as viewed from the bottom of the toner container.

When the user moves the lever portion 76*b* with his/her finger in the direction opposite the direction indicated by arrow Z shown in FIG. 17, in which the spring 76*d* biases the lever 76, thereby sliding the lever 76 with the toner container 32Y installed in the toner container mount 31, the pawl 76*a* moves to the release position not to protrude into the insertion opening 71. Thus, the toner container 32Y is released. Because the driving coupling 91 of the bottle driving unit 90 biases the toner container 32Y, the toner container 32Y pops out from the insertion opening 71 in the direction opposite the installation direction X shown in FIG. 16. Therefore, the pawl 76*a* of the lever 76 comes into contact with the toner discharge portion 32Y1*d* of the toner container 32Y, which prevents the lever 76 from moving to the retaining position. That is, the lever 76 is kept at the release position. Subsequently, when the user grips the handle 32Y1*c* and moves the toner container 32Y in the direction (hereinafter "removal direction") opposite the installation direction X out from the toner container mount 31, the contact between the pawl 76*a* and the toner discharge portion 32Y1*d* is released. Accordingly, the lever 76 returns to the retaining position shown in FIG. 14, biased by the spring 76*d*.

Figure 40A:
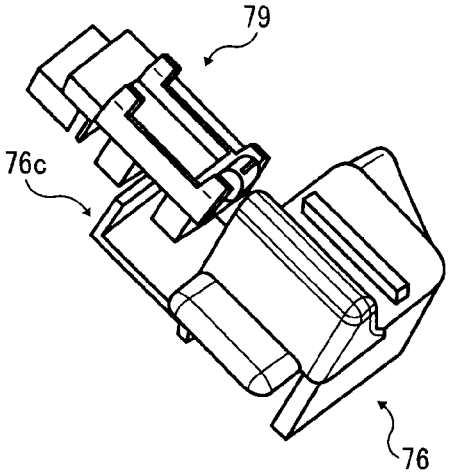
FIGS. 40A and 40B are a perspective view and a top view of the lever for fixing and releasing the toner container at a retaining position, respectively.
Figure 40B:
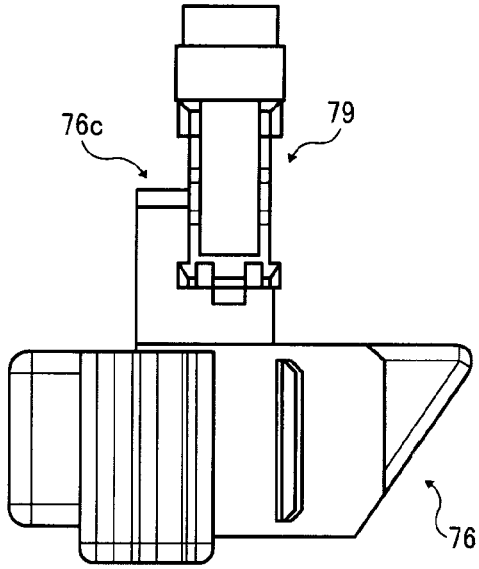
Figure 40C:
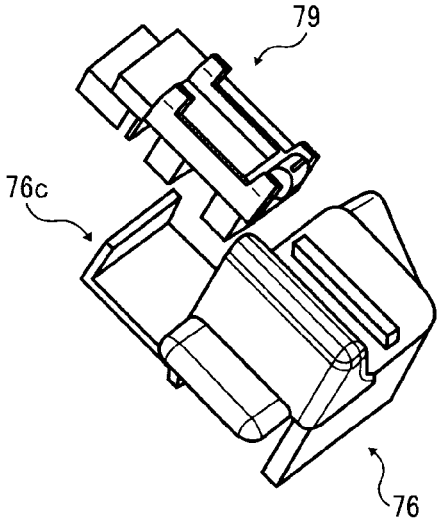
FIGS. 40C and 40D are a perspective view and a top view of the lever at a release position, respectively.
Figure 40D:
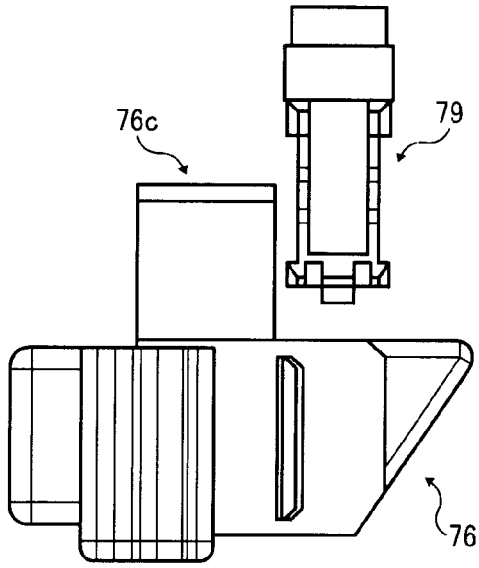

In the first embodiment, the bottle fixing portion 70 further includes a lever position detector 79 shown in FIGS. 40A through 40D for detecting the position of the lever 76. For example, the lever position detector 79 is a photosensor. More specifically, referring to FIGS. 40A through 40D, the lever position detector 79 that in the present embodiment is a transmissive photosensor is positioned adjacent to the lever 76. FIG. 40A is a perspective view that illustrates relative positions of the lever 76 and the lever position detector 79 when the lever 76 is at the retaining position. FIG. 40B is a schematic top view that illustrates the relative positions of the lever 76 and the lever position detector 79 when the lever 76 is at the retaining position. FIG. 40C is a perspective view that illustrates relative positions of the lever 76 and the position detector 79 when the lever 76 is at the release position. FIG. 40D is a schematic top view that illustrates the relative positions of the lever 76 and the position detector 79 when the lever 76 is at the release position.

The lever position detector 79 is positioned so that, when the lever 76 is positioned at the retaining position, the rib 76*c* of the lever 76 is positioned between the light-emitting element and the light-receiving element of the lever position detector 79, thus blocking the light emitted from the light-emitting element of the lever position detector 79 as shown in FIGS. 40A and 40B. Thus, the lever position detector 79 can recognize that the lever 76 is at the retaining position, and the output of the photosensor is on in this state. By contrast, when the lever 76 is moved to the release position, the rib 76*c* moves away from the position between the light-emitting element and the light-receiving element of the lever position detector 79. Thus, the light-receiving element can receive the light from the light-emitting element, and the output of the photosensor is off in this state.

Although the transmission-type photosensor is used as the position detector in the present embodiment, alternatively, a reflection-type photosensor may be used to detect the lever 76. Moreover, although in the description above, the rib 76*c* provided on the lever 76 is used in detecting the lever 76 and switching the output of the lever position detector 79, the output of the lever position detector 79 may be switched differently. For example, the output from the lever position detector 79 may be switched by detecting another component that moves in conjunction with the movement of the lever 76.

Next, the insertion opening 71 is described in further detail below.

Figure 18:
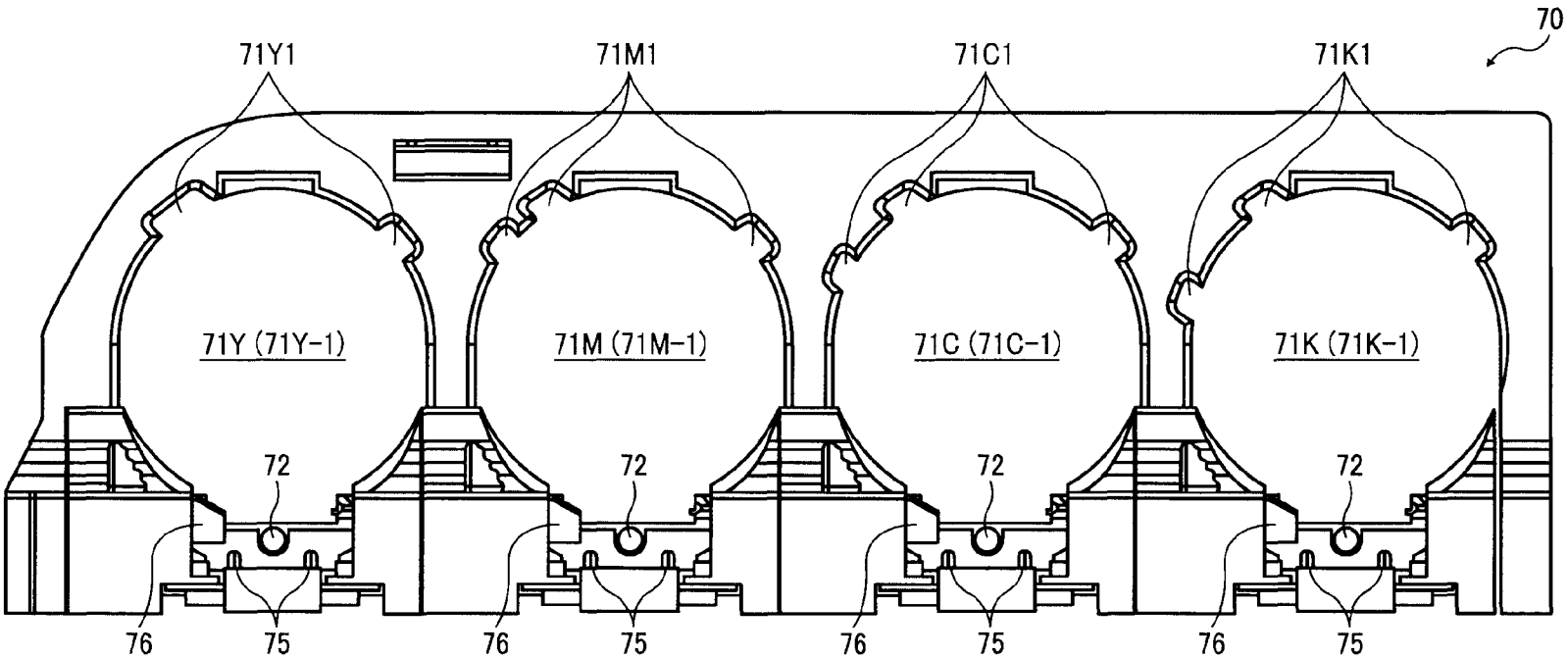
FIG. 18 is a front view of insertion openings in which the respective toner containers are inserted.

When a cover (not shown) provided on the front side of the main body 100 is opened, the toner container mount 31 is exposed. More specifically, as shown in FIG. 18, the bottle fixing portion 70 in which the four insertion openings 71 are formed is exposed when the cover of the main body 100 is opened. Attachment and removal of the toner containers 32Y, 32M, 32C, and 32K are performed from the front side of the image forming apparatus 200 in the longitudinal direction of the toner containers 32Y, 32M, 32C, and 32K.

It is to be noted that the shape of the insertion openings 71Y, 71M, 71C, and 71K are different.

More specifically, referring to FIG. 18, the interiors of the can holders 71Y-1, 71M-1, 71C-1, and 71K-1 defining the insertion openings 71Y, 71M, 71C, and 71K include first guide grooves 71Y1, 71M1, 71C1, and 71K1 that engage the color discrimination protrusions 32Y1*e*, 32M1*e*, 32Ce, and 32Ke provided on the caps of the toner containers 32Y, 32M, 32C, and 32K, respectively. The color discrimination protrusions 32Y1*e*, 32M1*e*, 32Ce, and 32Ke are shown in FIGS. 22 and 28 through 31. At least one of the shapes, the arrangement, and the quantities of the first guide grooves 71Y1, 71M1, 71C1, and 71K1 are different among the four colors so that the insertion opening 71 of specific color can accommodate the toner container 32 of corresponding color, thus prevent a toner container of wrong color from being set in the insertion opening 71 or the toner supply device 60. In the configuration shown in FIG. 18, three first guide grooves 71Y1, 71M1, 71C1, and 71K1 are formed for each color.

Figure 8:
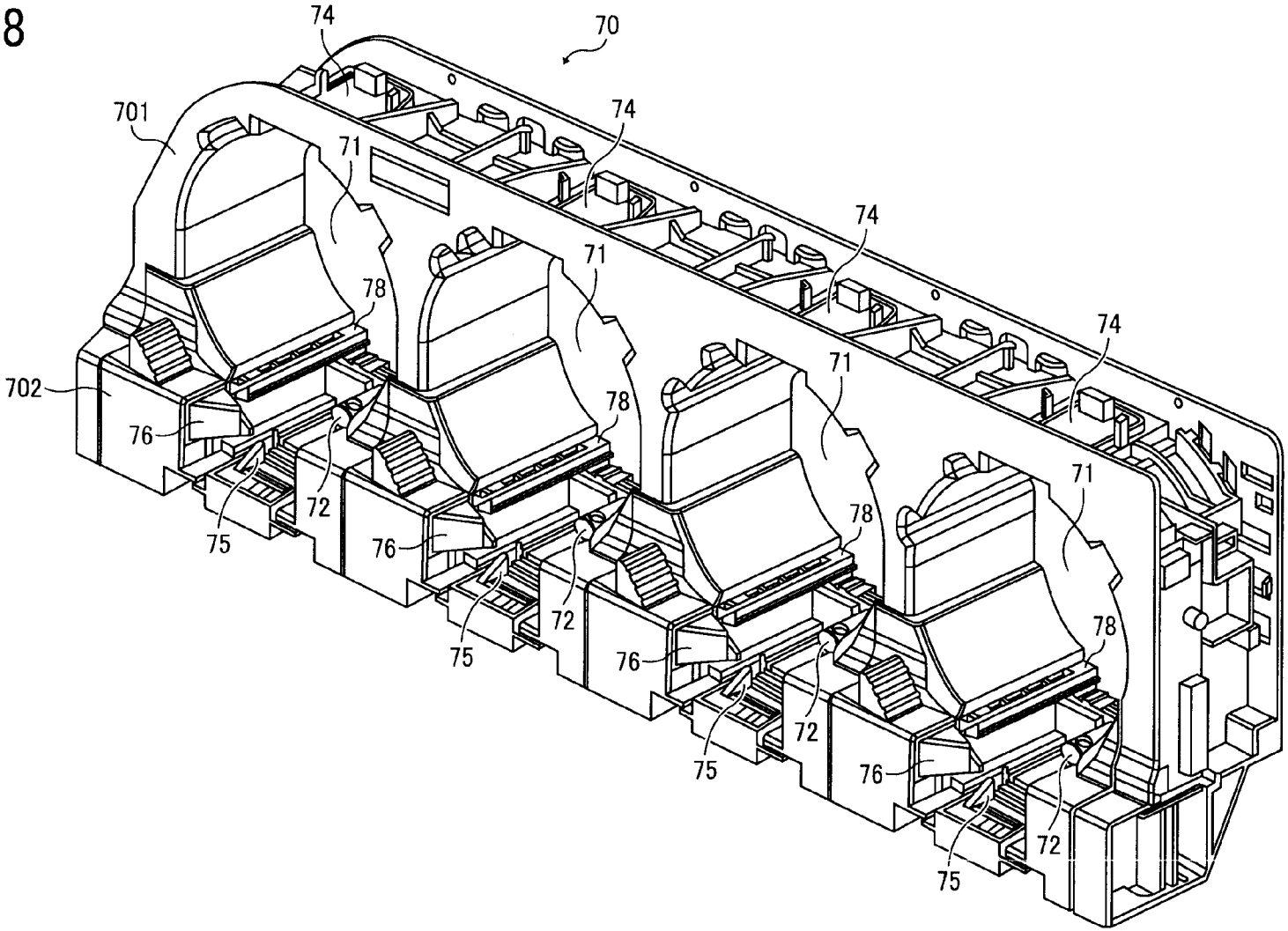
FIG. 8 is a perspective view of a bottle fixing portion.

Additionally, referring to FIG. 8, the antenna boards 74 are set in the upper front case 701 of the bottle fixing portion 70 (toner supply devices 60Y, 60M, 60C, and 60K) in which the toner containers 32Y, 32M, 32C, and 32K are removably installed in parallel to each other. More specifically, the antenna boards 74 are arranged on an identical face in an upper portion of the upper front case 701 so as to face the electronic boards 32Y1*f*, 32M1*f*, 32C1*f*, and 32K1*f* provided on circumferential surfaces of the toner containers 32Y, 32M, 32C, and 32K inserted through the bottle fixing portion 70, a part of which is formed by the upper font case 701, and arranged in parallel to each other. The electronic boards 32Y1*f*, 32M1*f*, 32C1*f*, and 32K1*f* are shown in FIGS. 22 and 28 through 31.

The electronic boards 32Y1*f*, 32M1*f*, 32C1*f*, and 32K1*f* of the toner containers 32Y, 32M, 32C, and 32K exchange data with the main body 100 in which the antenna boards 74 are provided. The data exchanged between the toner container 32Y, 32M, 32C, and 32K and the image forming apparatus 200 includes, for example, the production serial number of the toner container, the number of times the toner container is reused, the production lot number, the production date, the color of the toner, and usage history of the image forming apparatus 200. Other data may also be included. Further, data including the amount of toner remaining in the toner container 32 (hereinafter "the amount of remaining toner") is written in the electronic boards 32Y1*f*, 32M1*f*, 32C1*f*, and 32K1*f* as required in accordance with the amount of toner consumed.

It is to be noted that, in the first embodiment, the antenna boards 74 are positioned above the respective toner containers 32 as shown in FIG. 8. In other words, a receiving face of each antenna board 74 faces down.

This arrangement can eliminate the possibility of drop of toner on the receiving face of the antenna board 74, thus preventing decreases in the communication sensitivity caused by the toner present between the electronic boards 32Y1*f*, 32M1*f*, 32C1*f*, and 32K1*f* and the respective antenna boards 74 if toner drops on the antenna boards 74.

Next, the toner containers 32 are described in further detail below with reference to FIGS. 19 through 37.

Figure 19:
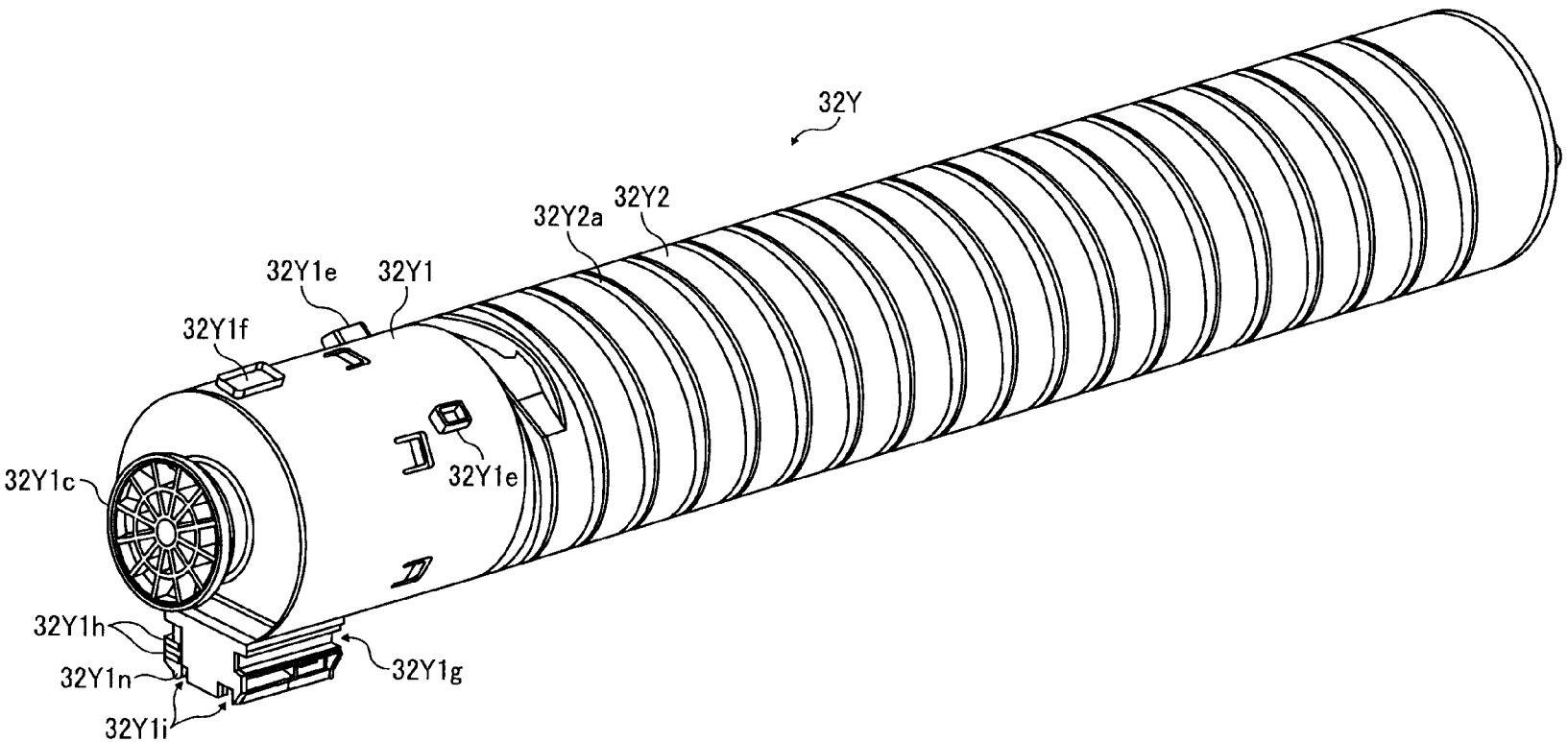
FIG. 19 is a perspective view of the toner container.
Figure 20:
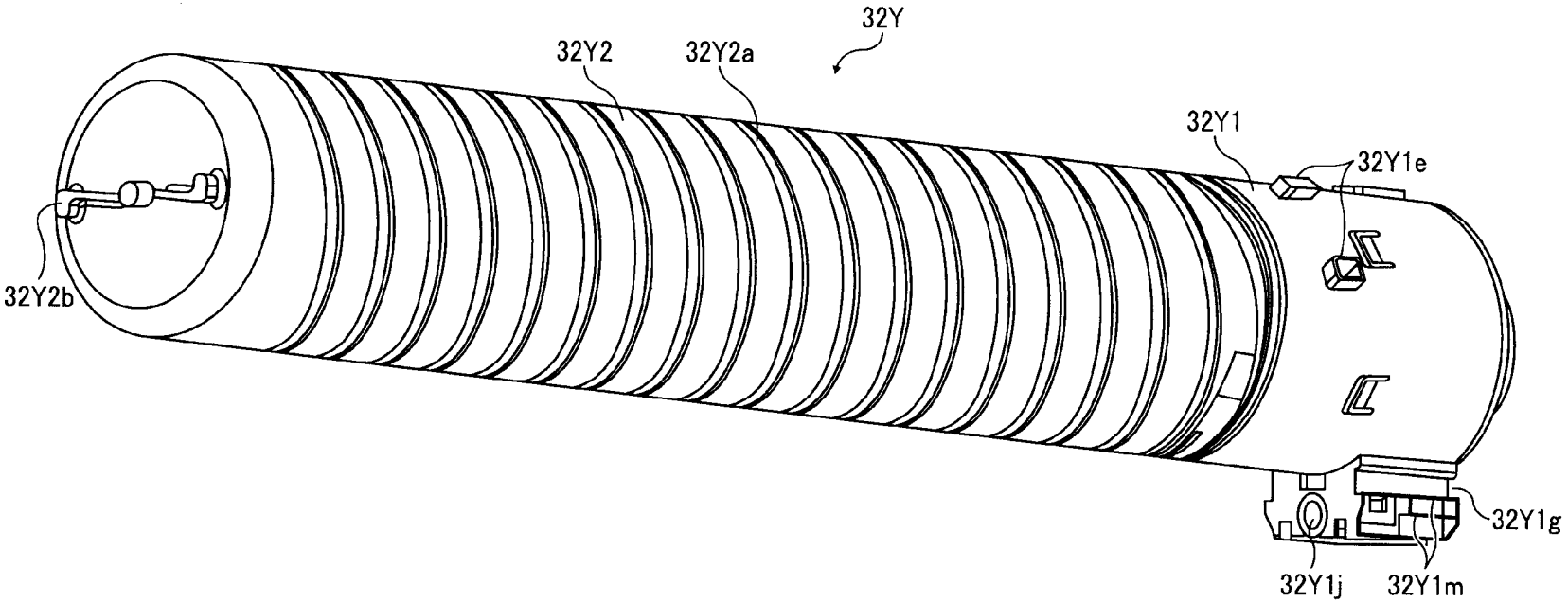
FIG. 20 is a perspective view of the toner container as viewed from another angle.

FIGS. 19 and 20 are perspective views illustrating the toner container 32Y. In FIG. 19, reference character 32Y1*i* represents a pair of second grooves, 32Y1*g* represents a pair of first grooves, and 32Y1*n* represents a face of the cap 32Y1 perpendicular to the installation direction. In FIG. 20, reference character 32Y1*m* represents ribs (sliding contact portions) extending in the installation direction, and reference character 32Y1 represents a nozzle inlet.

Figure 21:
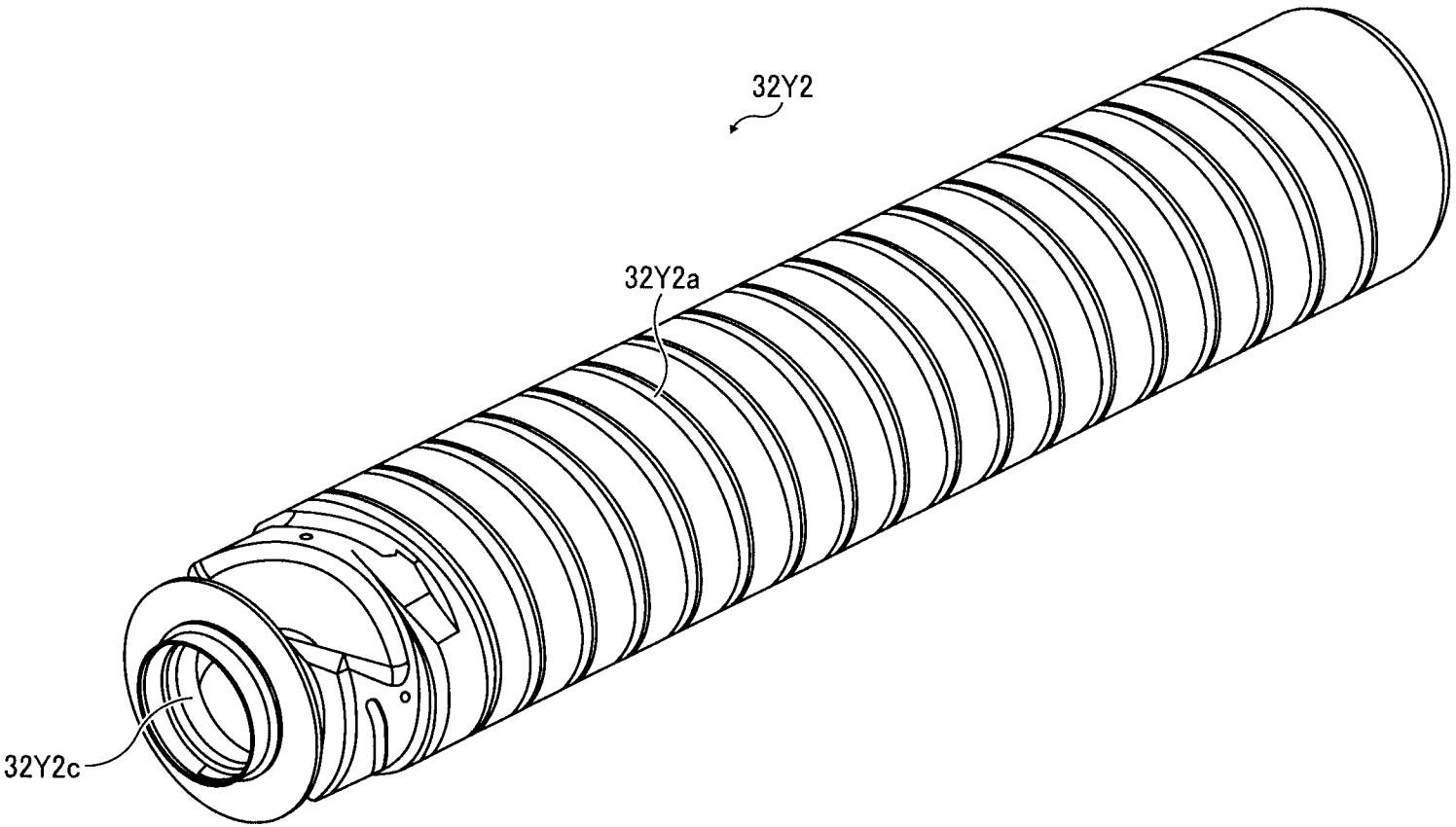
FIG. 21 is a perspective view that illustrates an exterior of a container body of the toner container.

FIG. 21 is a perspective view of the container body 32Y2. As shown in FIG. 21, the container body 32Y2 includes an opening 32Y2*c* formed in a head portion, which is on the upstream side (proximal side) in the installation direction of the toner container 32Y into the image forming apparatus 200, and thus the interior of the container body 32Y2 communicates with the interior of the cap 32Y1. The spiral-shaped protrusion 32Y2*a* is formed in the inner circumferential surface of the container body 32Y2. Further, as shown in FIG. 20, the driving input parts 32Y2*b* are provided on the bottom of the container body 32Y2, which is on the downstream side (dismal side) in the installation direction of the toner container 32Y. The driving input parts 32Y2*b* engage the driving coupling 91 of the main body 100. With this configuration, the container body 32Y2 rotates in the predetermined direction, receiving the driving force from the driving coupling 91 of the main body 100, thereby transporting the toner contained therein to the opening 32Y2*c*. The toner discharged from the opening 32Y2*c* of the container body 32Y2 is then stored in the space (toner reservoir 32Y1*k* shown in FIG. 26) inside the cap 32Y1. The toner stored in that space is supplied to the development device 5Y through the toner outlet 32Y1*a* formed beneath that space as also shown in FIG. 27.

It is to be noted that, as shown in FIG. 20, the two driving input parts 32Y2*b* that engage the two pawls of the driving coupling 91, respectively, are arranged at angle positions different 180 degrees from each other with reference to the center of rotation of the container body 32Y2 in the first embodiment. Alternatively, the driving coupling 91 may have three pawls and the number of the driving input parts 32Y2*b* provided in the toner container 32Y may be three accordingly. The three driving input parts 32Y2*b* can be arranged at identical angle intervals with reference to the center of rotation of the container body 32Y2. Although such an arrangement can alleviate fluctuations in the torque when the toner container 32Y rotates, the probability of interference between the driving input parts 32Y2*b* and the pawls of the driving coupling 91 can increase as the number of the driving input parts 32Y2*b* (pawls) increases. Therefore, it is preferred to determine the number of the driving input parts 32Y2*b* (pawls) considering the adverse effects of the fluctuation in the torque on discharge performance of the toner from the toner container 32Y as well as the interference between the driving input parts 32Y2*b* and the pawls of the driving coupling 91 that inhibits reliable attachment of the toner container 32.

Next, the cap 32Y1 according to the first embodiment is described in further detail below with reference to FIGS. 22 through 31.

Figure 22:
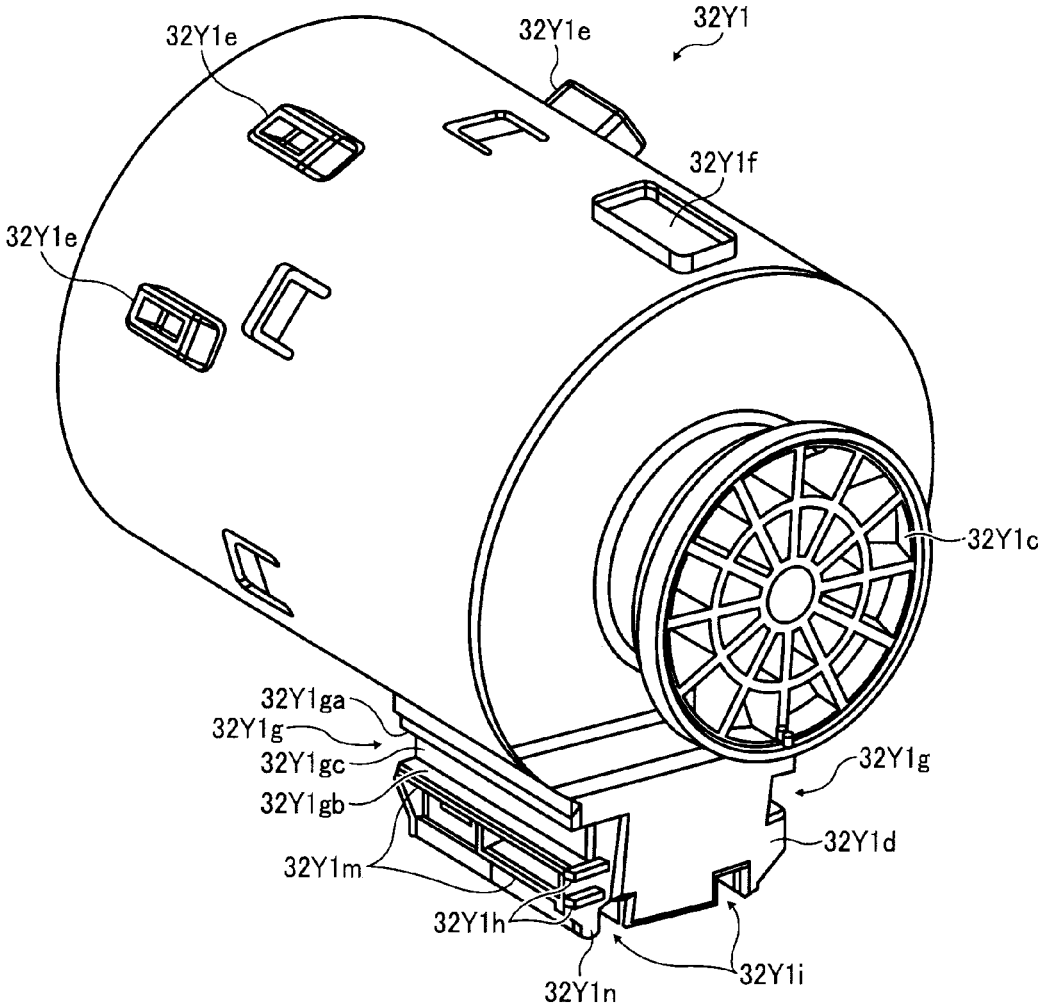
FIG. 22 is a perspective view that illustrates an exterior of a cap of the toner container.
Figure 23:
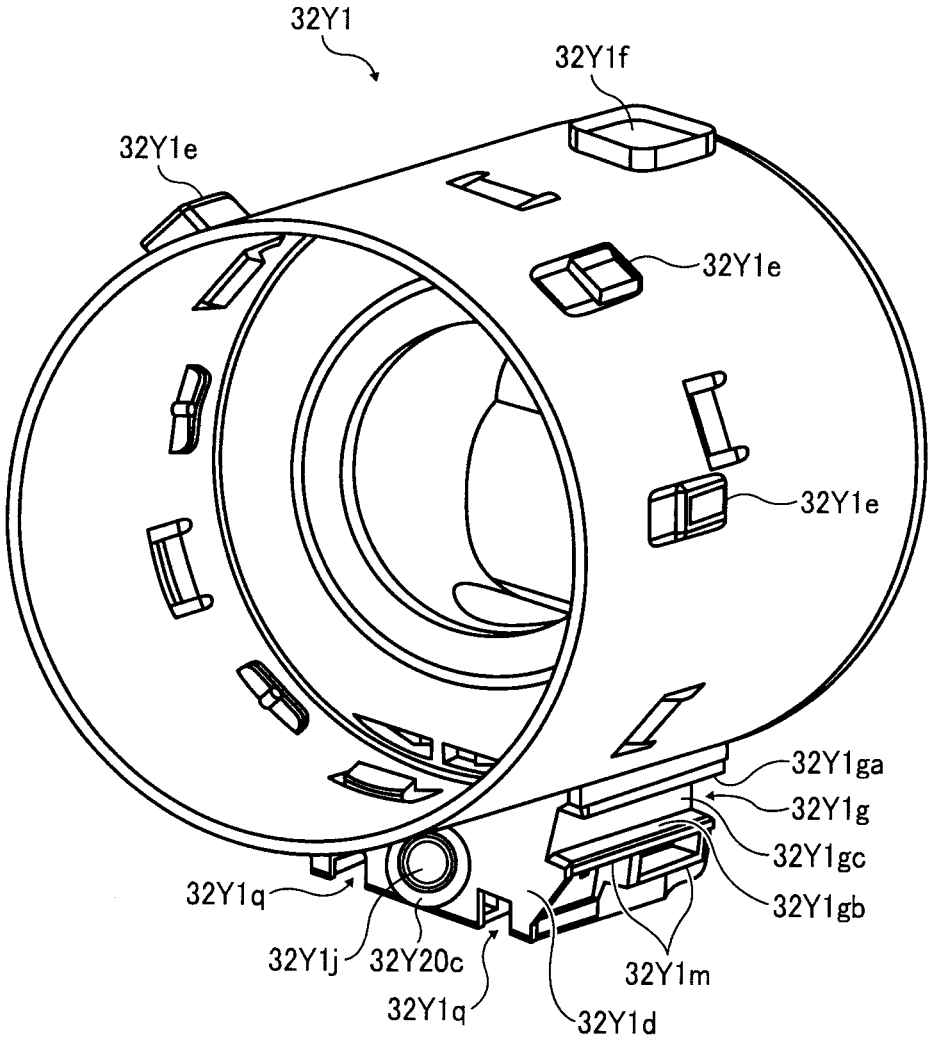
FIG. 23 is another perspective view that illustrates the exterior of the cap.
Figure 24:
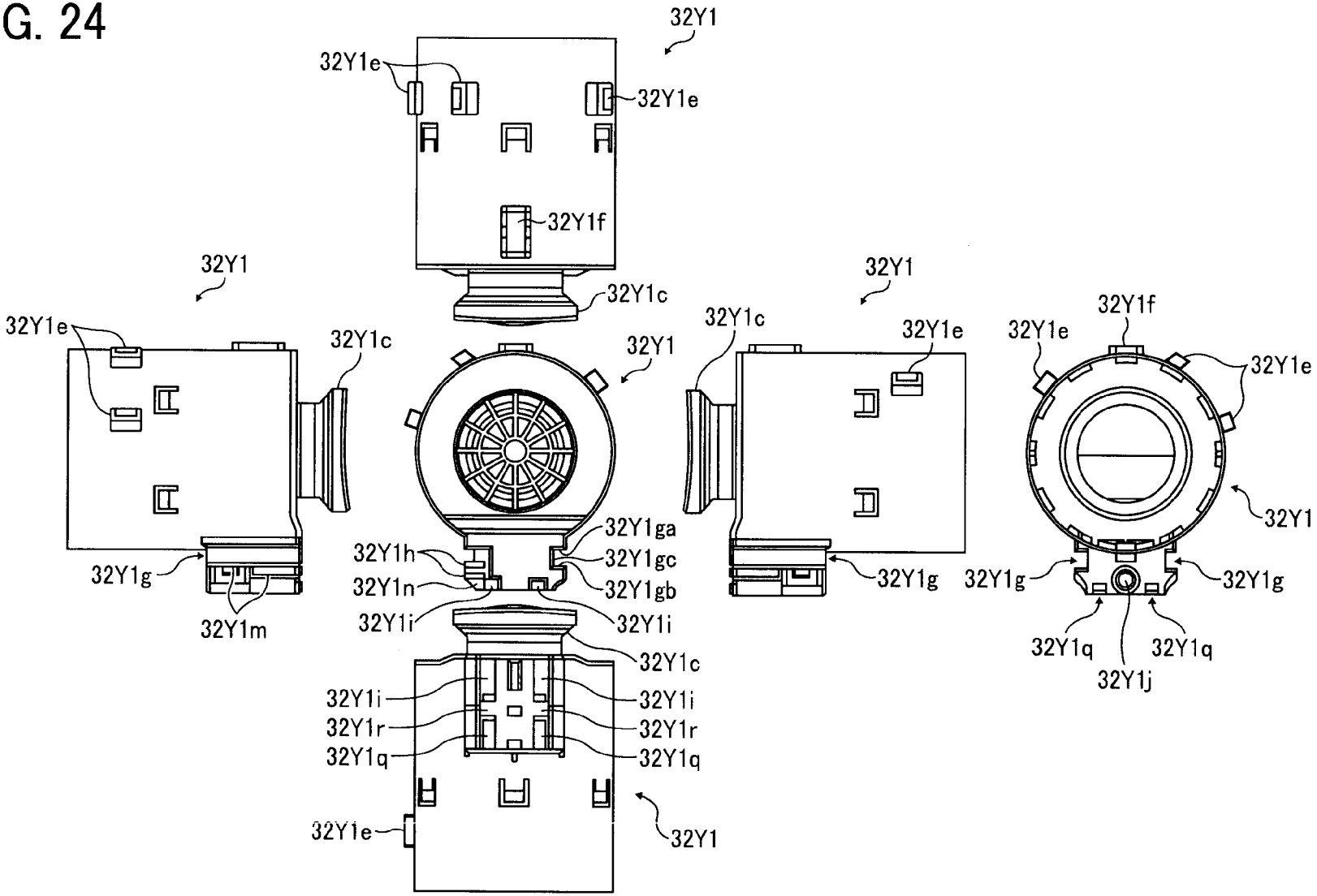
FIG. 24 is a set of six sides views of the cap.

FIGS. 22 and 23 are perspective views of the cap 32Y1, and FIG. 24 is a set of six sides views. It is to be noted that reference character 32Y1*q* represents a pair of third grooves.

When inserted into the toner container mount 31, the cap 32Y1 is held and fixed in position relative to the toner container mount 31 (main body 100). In other words, after fully inserted into the toner container mount 31, the cap 32Y1 does not rotates, and only the container body 32Y2 can rotates relative to the main body 100.

Figure 26:
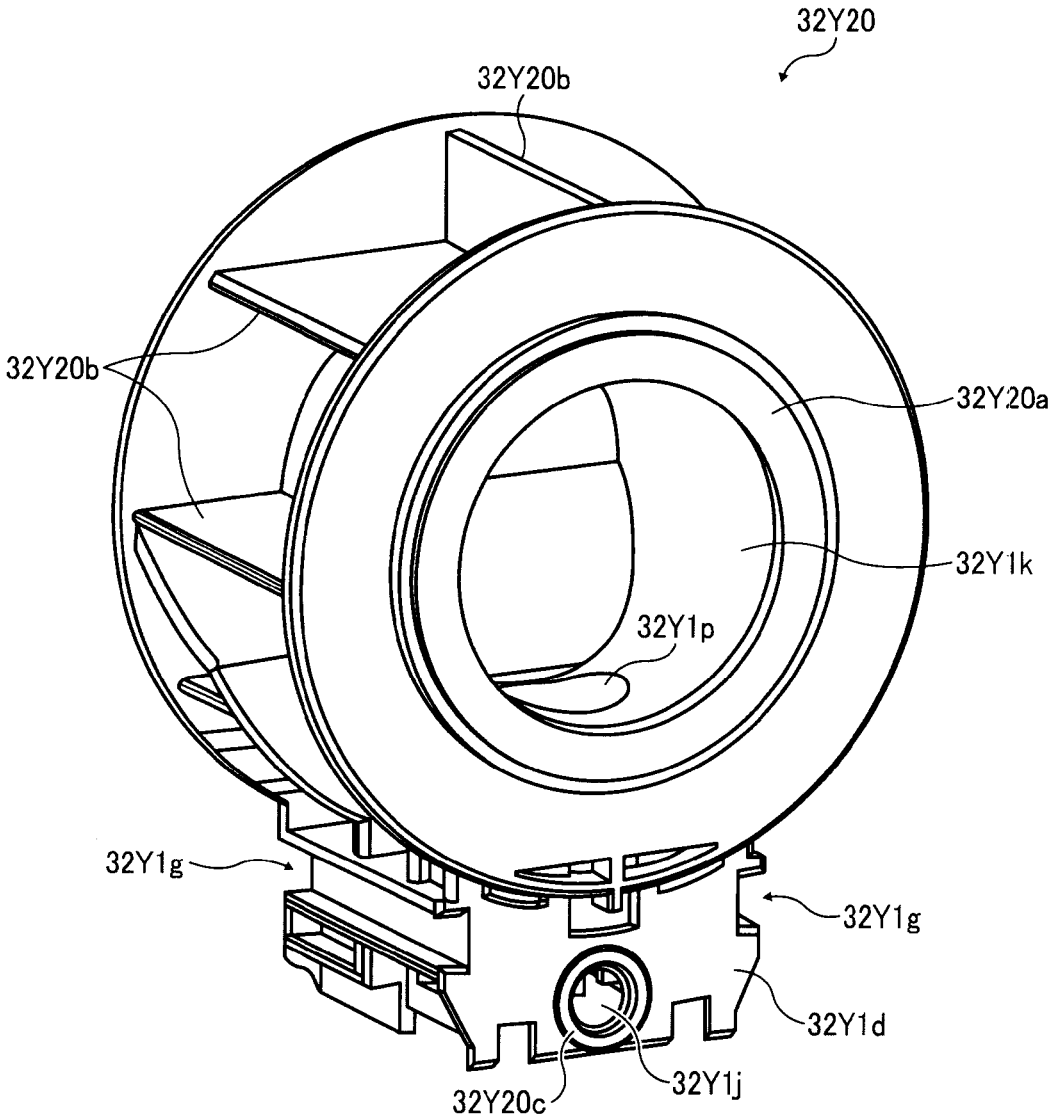
FIG. 26 is a perspective view of a handle body.
Figure 27:
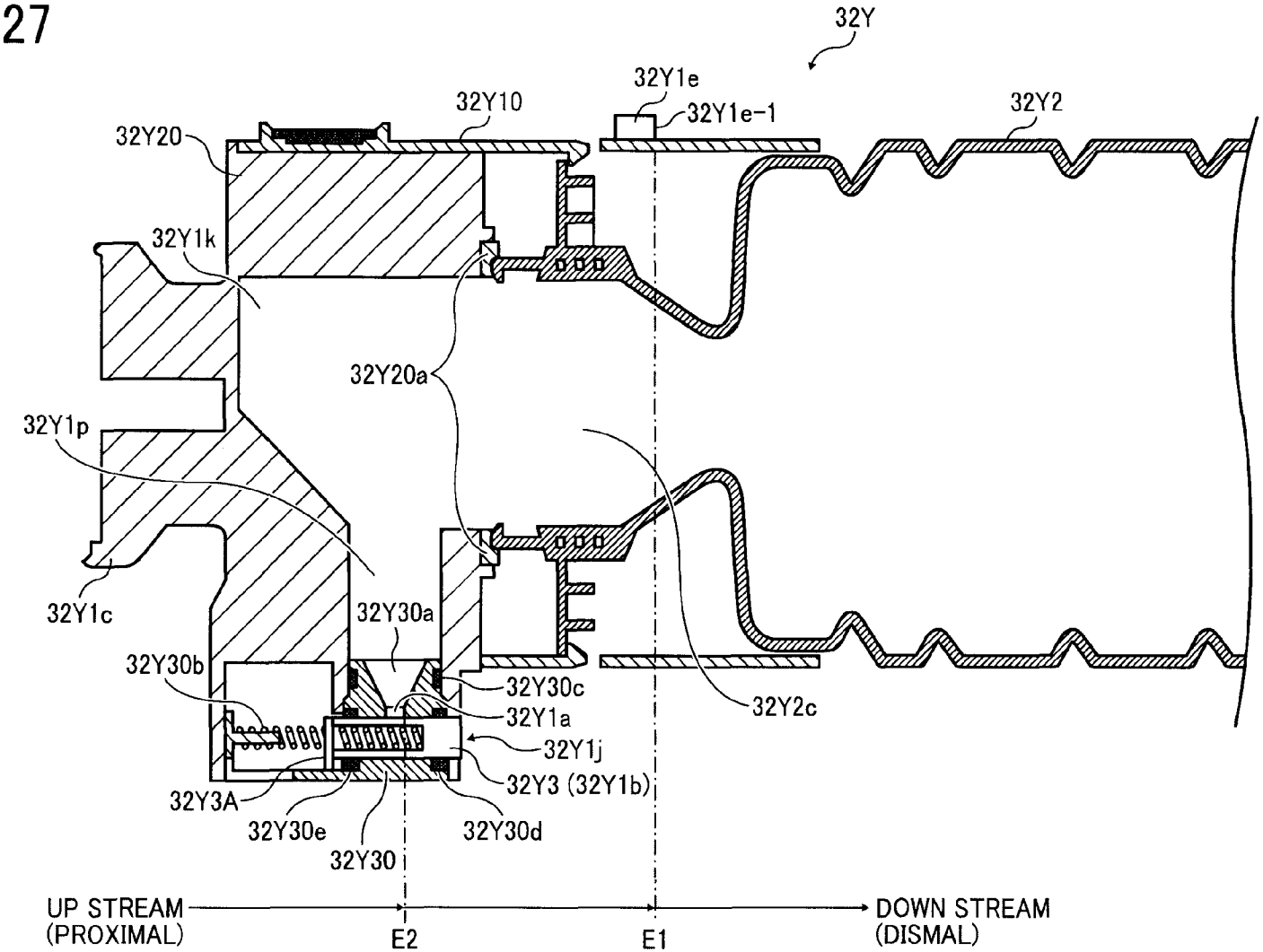
FIG. 27 is a cross-sectional view of a vicinity of the cap.
Figure 28:
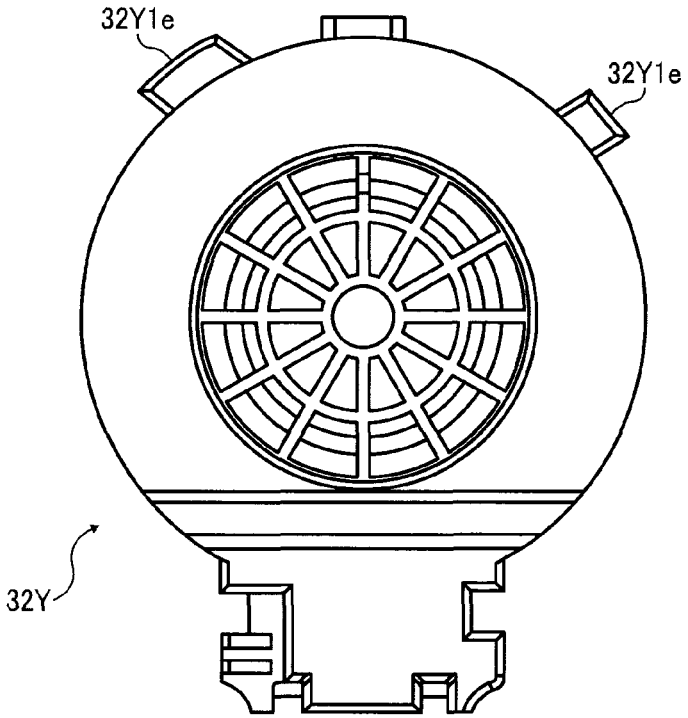
FIG. 28 is a front view of the cap of the yellow toner container.
Figure 29:
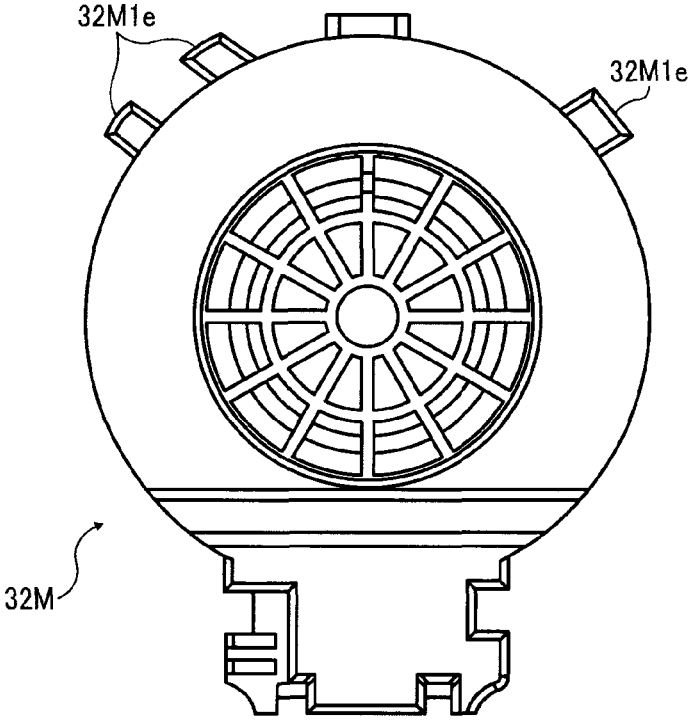
FIG. 29 is a front view of the cap of the magenta toner container.
Figure 30:
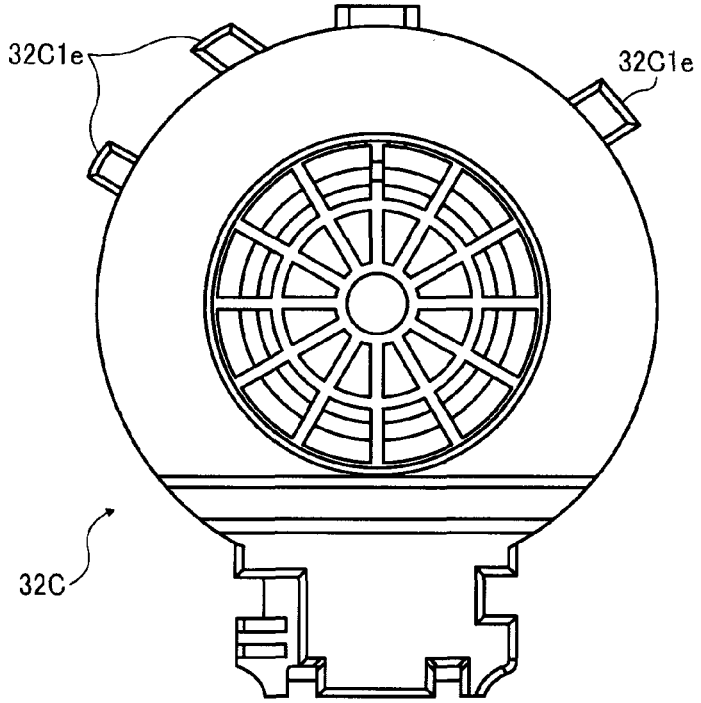
FIG. 30 is a front view of the cap of the cyan toner container.

It is to be noted that, referring to FIGS. 26 and 27, the gap between the cap 32Y1 and the container body 32Y2 is filled with a seal 32Y20*a* attached to a handle body 32Y20 of the cap 32Y1, securing the sealing therebetween. More specifically, a rim of the container body 32Y2 defining the opening 32Y2*c* extends into the seal 32Y20*a* and slides on the seal 32Y20*a*, and thus toner does not leak out from the gap between the container body 32Y2 and the cap 32Y1.

Referring to FIGS. 22 and 23, the cap 32Y1 includes the electronic board 32Y1*f*, the protrusions 32Y1*e* for color discrimination, the handle 32Y1*c*, and the toner discharge portion 32Y1*d* as described above. Additionally, the pair of first grooves 32Y1*g* is provided in either side surface (in parallel to the installation direction) of the toner discharge portion 32Y1*d* of the cap 32Y1 as engagement portions that engage the respective positioning protrusions 78 of the toner container mount 31. Referring to FIGS. 22 and 24, each first groove 32Y1*g* is defined by a pair of horizontal faces 32Y1*ga* and 32Y1*gb* facing each other, extending in the installation direction of the toner container 32Y in the main body 100, and a vertical face 32Y1*gc* positioned between the and horizontal faces 32Y1*ga* and 32Y1*gb*, extending in the installation direction as well. The cap 32Y1 does not rotate in conjunction with the rotation of the container body 32Y2 but is retained stationary by the bottle fixing portion 70 of the toner container mount 31 with the first grooves 32Y1*g* engaged with the positioning protrusions 78.

Figure 25:
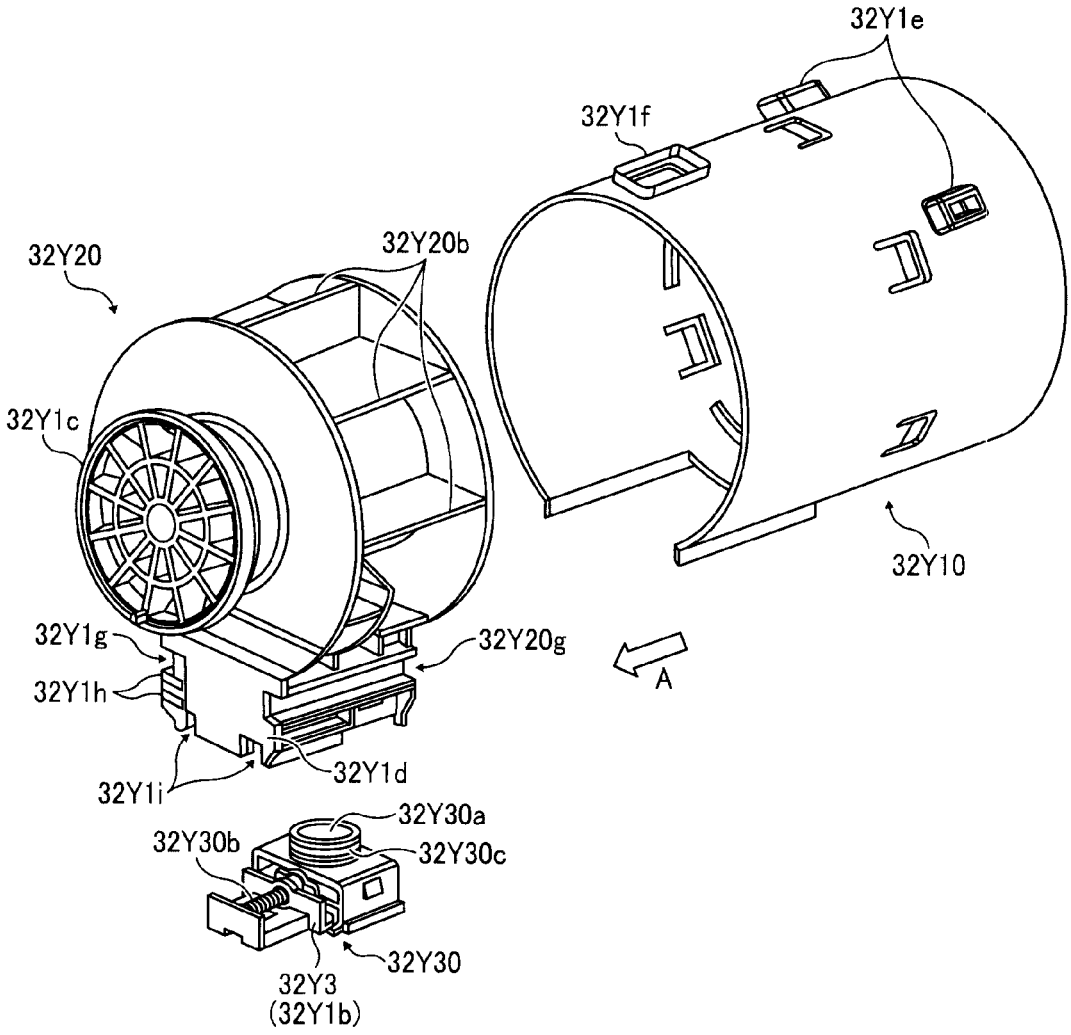
FIG. 25 is an exploded perspective view of the cap.

FIG. 25 is an exploded perspective view of the cap 32Y1. The cap 32Y1 includes a cap body 32Y10, the handle body 32Y20, and a nozzle insertion portion 32Y30. FIG. 26 is a perspective view of the handle body 32Y20 as viewed in the direction indicated by arrow A shown in FIG. 25. FIG. 27 is a cross-sectional view around the cap 32Y1 of the toner container 32.

The handle body 32Y20 is fitted into the cap body 32Y10, that is, the handle body 32Y20 is partly covered with the cap body 32Y10. In the configuration shown in FIGS. 25 and 26, the handle body 32Y20 includes multiple ribs 32Y20*b*, and edge faces of the ribs 32Y20*b* are bonded or welded to an inner circumferential face of the cap body 32Y10. A recess is formed in a lower portion of the handle body 32Y20 in FIG. 26, and the nozzle insertion portion 32Y30 is fitted in the recess as shown in FIG. 27.

Referring to FIG. 25, the electronic board 32Y1*f* and the protrusions 32Y1*e* for color discrimination are provided on the outer circumferential surface of the cap body 32Y10. The handle body 32Y20 further includes the handle 32Y1*c*, projecting in parallel to the installation direction of the toner container 32Y from a circular face of a cylindrical portion of the handle body 32Y20, and the toner discharge portion 32Y1*d* positioned beneath the cylindrical portion. Referring to FIG. 26, inside the cylindrical portion, the toner reservoir 32Y1*k* (hollow) for temporarily storing toner and a cylindrical communication portion 32Y1*p* through which the toner reservoir 32Y1*k* and the toner discharge portion 32Y1*d* communicate with each other are provided. The toner discharge portion 32Y1*d* includes the pair of first grooves 32Y1*g*, the pressed portion 32Y1*h*, and the nozzle inlet 32Y1*j*. Additionally, a seal 32Y30*c* enclosing the nozzle inlet 32Y1*j* is provided. The seal 32Y30*c* can prevent leakage of toner from the gap between the nozzle 72 and the nozzle inlet 32Y1*j* when the toner container 32Y is set in the toner container mount 31. The seal 32Y30*c* also serves as a cushion for absorbing the impact when the toner container 32Y is slid in the toner container mount 31 and then is fully inserted therein.

Further, referring to FIGS. 25 and 27, the nozzle insertion portion 32Y30 includes the nozzle connection compartment 32Y1*b* (also shown in FIG. 6) to accommodate the plug 32Y3, the toner outlet 32Y1*a* positioned above the nozzle connection compartment 32Y1*b*, through which the toner reservoir 32Y1*k* communicates with the nozzle connection compartment 32Y1*b*, and a toner discharge path 32Y30*a* formed inside the cylindrical communication portion 32Y1*p* formed beneath the toner reservoir 32Y1*k*. The toner is discharged from the toner reservoir 32Y1*k* through the toner discharge path 32Y30*a* to the toner outlet 32Y1*a*. and the nozzle connection compartment 32Y1*b* into which the nozzle 72 of the toner container mount 31 is inserted. The handle 32Y1*c* is When the nozzle insertion portion 32Y30 is fitted the recess formed in the toner discharge portion 32Y1*d*, the nozzle connection compartment 32Y1*b* communicates with the nozzle inlet 32Y1*j* of the toner discharge portion 32Y1*d*.

As shown in FIG. 27, the plug 32Y3 housed inside the nozzle connection compartment 32Y1*b* includes a cylindrical portion and a planar projection provided on an end of the cylindrical portion, projecting symmetrically. The plug 32Y3 moves inside the nozzle connection compartment 32Y1*b*, thereby opening and closing the toner outlet 32Y1*a*. A planar projection 32Y3A is provided on the upstream end (proximal end) of the plug 32Y3 in the installation direction of the toner container 32Y and extends horizontally, in the direction perpendicular to the center axis of the cylindrical portion. The pawl 75 of the toner container mount 31 engages the planar projection 32Y3A (see also FIG. 34) of the plug 32Y3, and accordingly the pawl 75 pushes the plug 32Y3 in the direction to close the toner outlet 32Y1*a* in conjunction with removal of the toner container 32Y from the toner container mount 31.

Additionally, a spring 32Y30*b* to bias the plug 32Y3 in the direction to close the toner outlet 32Y1*a* may be provided. The spring 32Y30*b* also can move the plug 32Y3 in the direction to close the toner outlet 32Y1*a* with its bias force when the toner container 32Y is removed. The spring 32Y30*b* is preferable in that leakage of toner from the toner outlet 32Y1*a* can be reduced because the spring 32Y30*b* can accelerate the initial action of the plug 32Y3 moving in the direction to close the toner outlet 32Y1*a*. Although the plug 32Y3 can be moved in the direction to close the toner outlet 32Y1*a* by either the engagement between the plug 32Y3 and the pawl 75 or the bias by the spring 32Y30*b*, using both is preferable because the leakage of toner from the toner outlet 32Y1*a* can be better prevented. It is to be noted that, in the first embodiment, the image forming apparatus 200 includes both of the pawl 75 and the spring 32Y30*b*.

In FIG. 27, the plug 32Y3 for opening and closing the toner outlet 32Y1*a* in conjunction with removal of the toner container 32Y is positioned in the nozzle connection compartment 32Y1*b*.

O-rings 32Y30*d* and 32Y30*e* are provided on both ends of the plug 32Y3 to prevent leakage of toner from the gap between the plug 32Y3 and the nozzle connection compartment 32Y1*b*. Additionally, an O-ring 32Y30*c* is fitted around a circumferential surface of the portion of the nozzle insertion portion 32Y30 forming the toner discharge path 32Y30*a* to prevent leakage of toner from the gap between the handle body 32Y20 and the nozzle insertion portion 32Y30. The downstream end or dismal end (on the right in FIG. 27) of the nozzle connection compartment 32Y1*b* in the installation direction of the toner container 32Y into the main body 100 communicates with the nozzle inlet 32Y1*j*. The nozzle 72 is inserted into the nozzle inlet 32Y1*j* in conjunction with installation of the toner container 32Y in the toner container mount 31 as shown in FIGS. 6 and 7.

Further, the pair of second grooves 32Y1*i* is formed in the outer bottom surface of the cap 32Y1. The plug 32Y3 moves relatively to the cap 32Y1 as the cap 32Y1 moves with the second grooves 32Y1*i* engaged with the pawl 75 of the main body 100. Moreover, the pair of third grooves 32Y1*q* is formed in the outer bottom surface of the cap 32Y1 in line with the second grooves 32Y11. That is, when viewed in the installation direction of the toner container 32Y, the second grooves 32Y11 overlap with the third grooves 32Y1*q*. A slidable surface 32Y1*r* to slide down the pawl 75 is formed between the second grooves 32Y1*i* and the third grooves 32Y1*q* so that the pawl 75 does not hinder installation of the toner container 32Y. An edge of the slidable surface 32Y1*r* on the side of the pair of third grooves 32Y1*q* is sloped to push down the pawl 75 smoothly.

The electronic board 32Y1*f* provided on the upper face of the cap 32Y1 is a radio frequency identification (RFID) chip, for example, and is used for exchanging the data relating to the toner container 32Y and the main body 100 with the main body 100 (antenna board 74) as described above with reference to FIG. 8. The electronic board 32Y1*f* is positioned opposite the nozzle connection compartment 32Y1*b* relative to the long axes of the toner container 32Y. This arrangement can prevent toner adhering to a vicinity of the nozzle connection compartment 32Y1*b* from dropping on the electronic board 32Y1*f* and a resultant deterioration in the communication sensitivity.

Further, referring to FIG. 22, the handle 32Y1*c* is provided on the upstream side of the cap 32Y1 in the installation direction of the toner container 32Y, and the user can grip the handle 32Y1*c* to install or remove the toner container 32Y from the main body 100. The handle 32Y1*c* is provided on the face of the cap 32Y1 opposite the face in which the nozzle inlet 32Y1*j* is formed, projecting in the removal direction of the toner container 32Y from the main body 100. This arrangement can reduce the possibility that the user unintentionally touches the nozzle inlet 32Y1*j*, to which toner tends to adhere, when the user grips the handle 32Y1*c*.

Referring to FIGS. 22 and 28 through 31, descriptions are given below of preventing toner containers of wrong type from being inserted into the insertion opening 71 and preventing leakage of the toner therefrom when users mistakenly try to install the toner container of the wrong type in the toner container mount 31.

Figure 31:
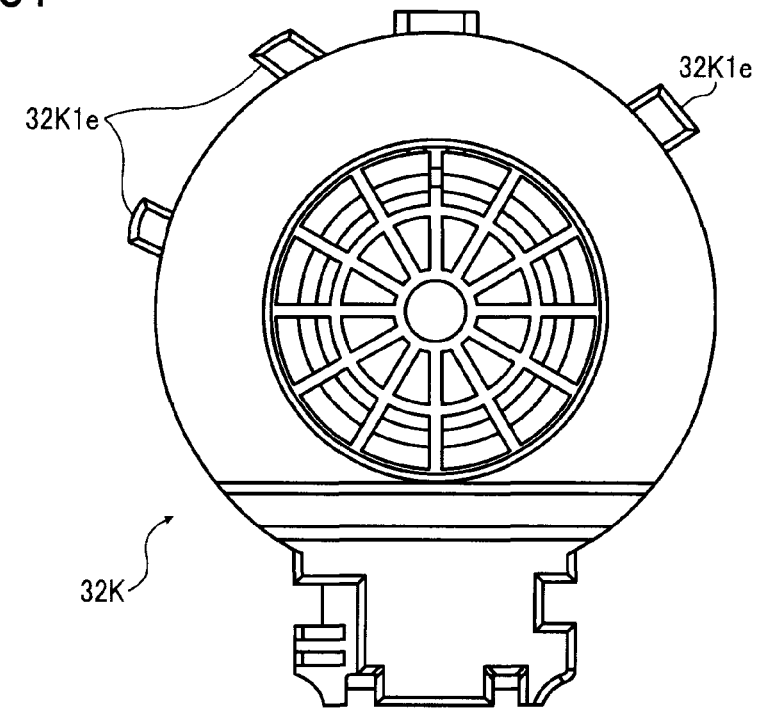
FIG. 31 is a front view of the cap of the black toner container.

The color discrimination protrusions 32Y1*e* are configured to prevent toner containers 32M, 32C, and 32K of other colors from being inserted into the insertion opening 71Y (toner supply device 60Y) for yellow as described above with reference to FIG. 18. More specifically, the color discrimination protrusions 32Y1*e* for yellow shown in FIG. 28, the color discrimination protrusions 32M1*e* for magenta shown in FIG. 29, the color discrimination protrusions 32C1*e* for cyan shown in FIG. 30, and the color discrimination protrusions 32K1*e* for black shown in FIG. 31 are different in at least one of arrangement, shape, and quantity so as to fit only the first guide grooves 71Y1, 71M1, 71C1, and 71K1 of the corresponding insertion openings 71Y, 71M, 71C, and 71K (shown in FIG. 18), respectively.

In the first embodiment, referring to FIG. 27, in the installation direction of the toner container 32Y into the main body 100, a downstream end (dismal end) of the rim defining the toner outlet 32Y1*a* is positioned at a position E2 upstream (proximal side) from a position E1 of a downstream end 32Y1*e*-1 of the protrusions 32Y1*e* for color discrimination. With this arrangement, even when the toner container 32 of wrong color is inserted into the insertion opening 71Y for yellow, that toner container 32 cannot be inserted further from the downstream end of the color discrimination protrusions 32M1*e*, 32C1*e*, or 32K1*e* in the installation direction because the color discrimination protrusions 32M1*e*, 32C1*e*, or 32K1*e* interfere with insertion opening 71Y. Consequently, the nozzle 72 is not inserted into the nozzle inlet 32M1*j*, 32C1*j*, or 32K1*j*, and the toner outlet 32M1*a*, 32C1*a*, or 32K1*a* is not opened. Thus, toner does not leak out through the toner outlet 32M1*a*, 32C1*a*, or 32K1*a*, or drop inside the toner container mount 31. Also, toner does not scatter in the portion of the toner container mount 31 for different color.

When the toner container 32Y is installed in the toner container mount 31, the pressed portion 32Y1*h* is pressed against the pawl 76*a* of the lever 76 and thus held in the toner container mount 31. More specifically, the pressed portion 32Y1*h* is positioned to be pressed against the lever 76 when the position of the toner container 32Y, which is biased by the driving coupling 91 and held by the lever 76, is determined in the installation direction. Referring to FIG. 22, the pressed portion 32Y1*h* is constructed of the face 32Y1*n* of the cap 32Y1 perpendicular to the installation direction and two projections, such as ribs, projecting in the direction in the removal direction of the toner container 32Y. The pressed portion 32Y1*h* is pressed against the lever 76 with the bias force from the dismal side to the proximal side, exerted by the driving coupling 91. The apexes of the two projections can enhance accuracy in the registration of the toner container 32Y in the installation direction.

Referring to FIG. 22, the ribs (sliding contact portion) 32Y1*m* extending in the installation direction are provided on the back side of the face 32Y1, opposite the side on which the pressed portion 32Y1*h* is formed. In other words, the ribs 32Y1*m* extend in parallel to the direction in which the pressed portion 32Y1*h* projects. As described above with reference to FIGS. 14 through 17, the sliding contact portion 32Y1*m* slides on the lever 76 and keeps the position of the lever 76 at the release position, at which the lever 76 does not prevent insertion or removal of the toner container 32Y, when the toner container 32Y is inserted or removed from the toner container mount 31. Additionally, the sliding contact portion 32Y1*m* can secure the strength of the face 32Y1 on which the pressed portion 32Y1*h* is formed. Further with reference to FIG. 22, the upper one of the two ribs serving as the sliding contact portion 32Y1*m* forms the horizontal face 32Y1*gb* that forms the first groove 32Y1*g*.

Descriptions are given below of opening and closing the toner outlet 32Y1*a* when the toner container 32Y is installed and removed from the toner container mount 31 with reference to FIGS. 32 through 37.

Figure 32:
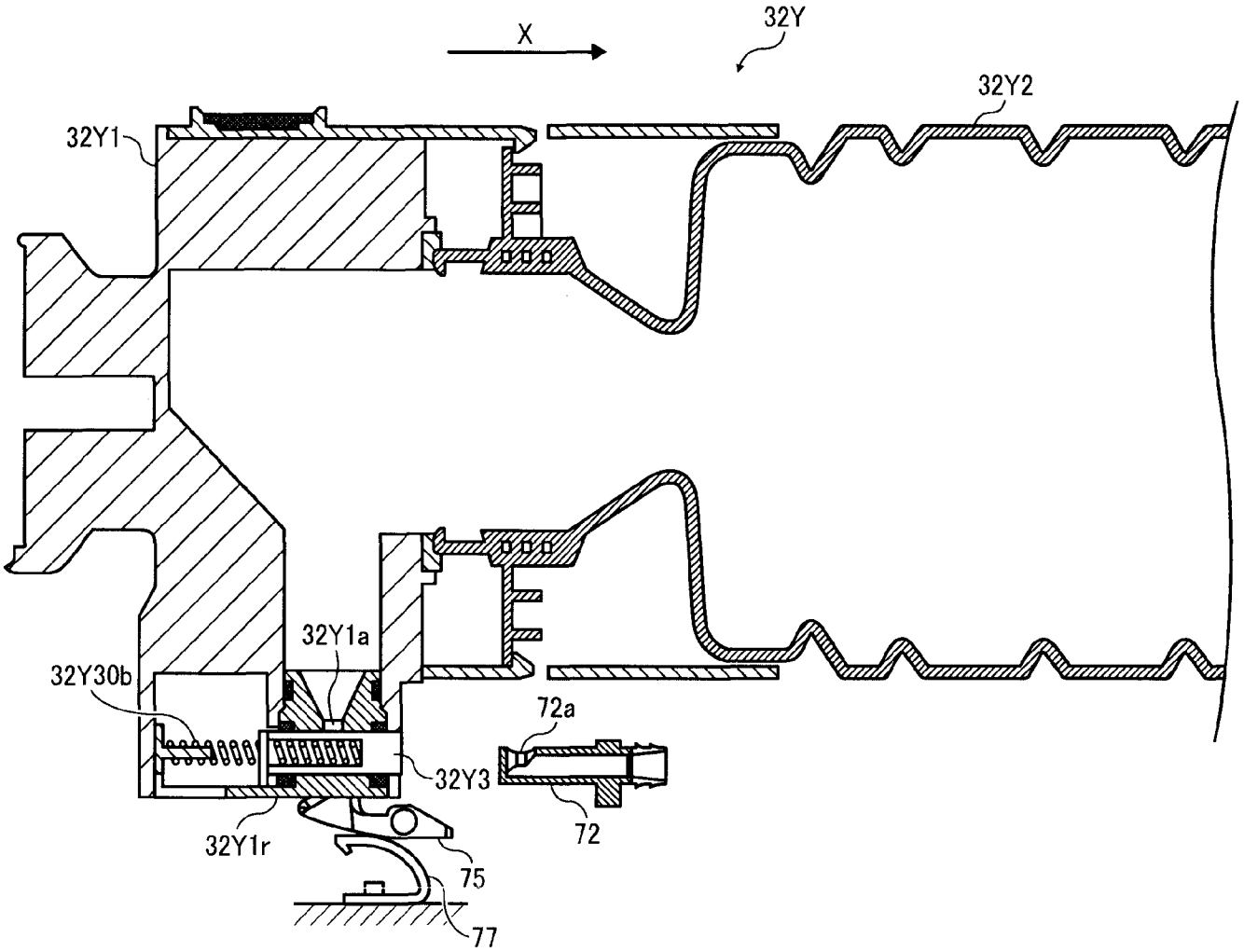
FIG. 32 is a schematic cross-sectional view that illustrates installation of the toner container into the toner container mount.
Figure 33:
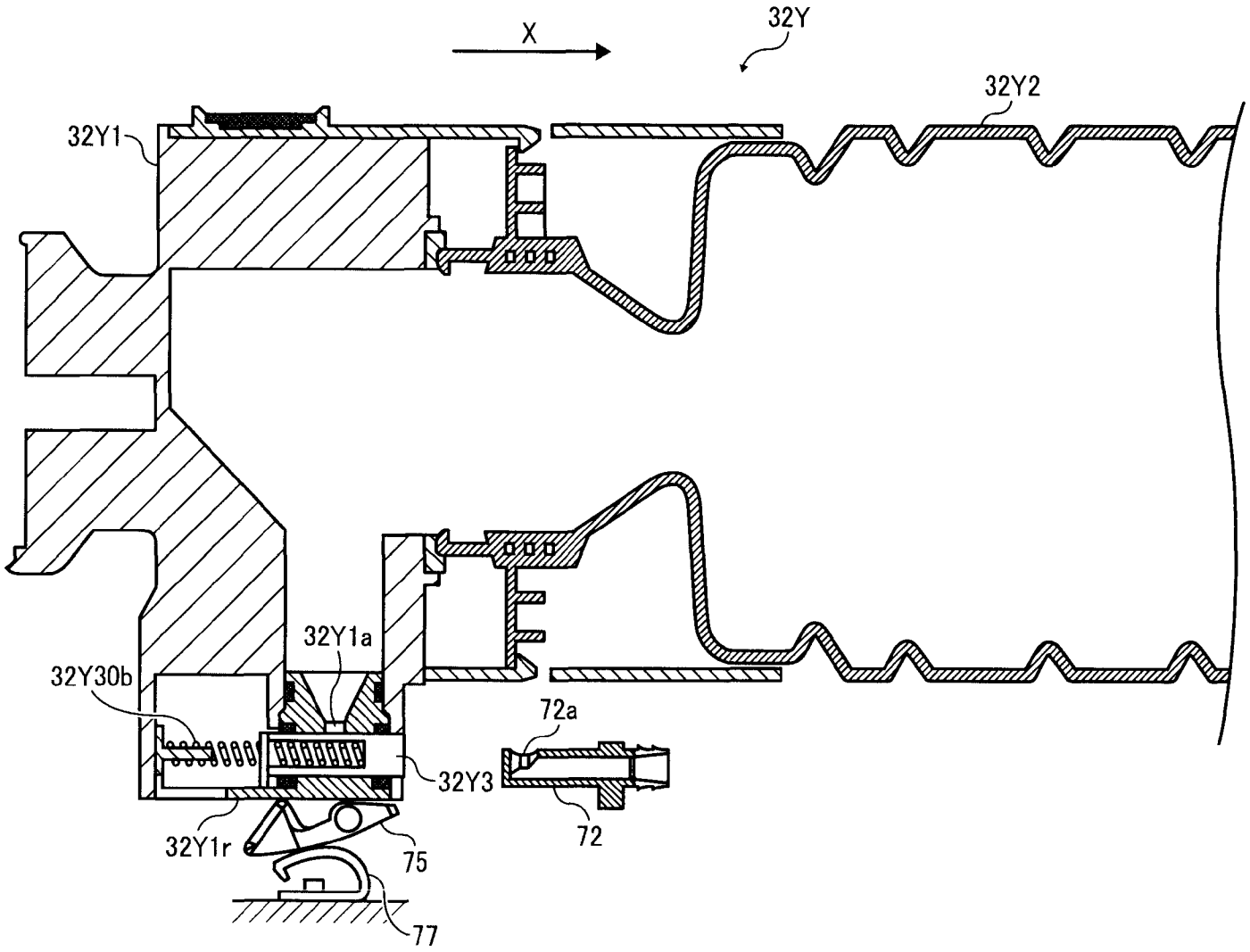
FIG. 33 is schematic cross-sectional view that illustrates a state subsequent to that shown in FIG. 32 in installation of the toner container.
Figure 34:
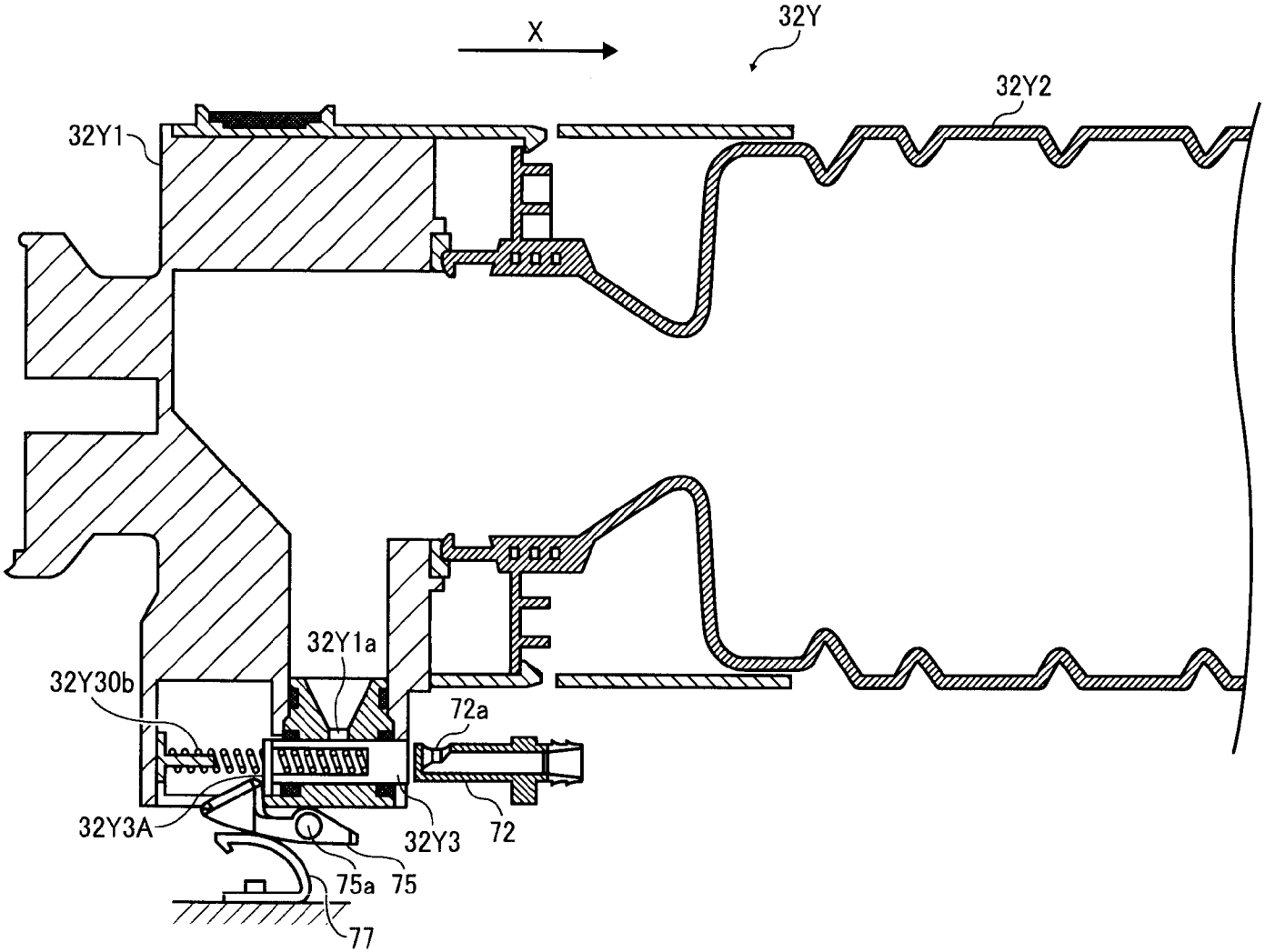
FIG. 34 is schematic cross-sectional view that illustrates a state subsequent to that shown in FIG. 33 in installation of the toner container.
Figure 35:
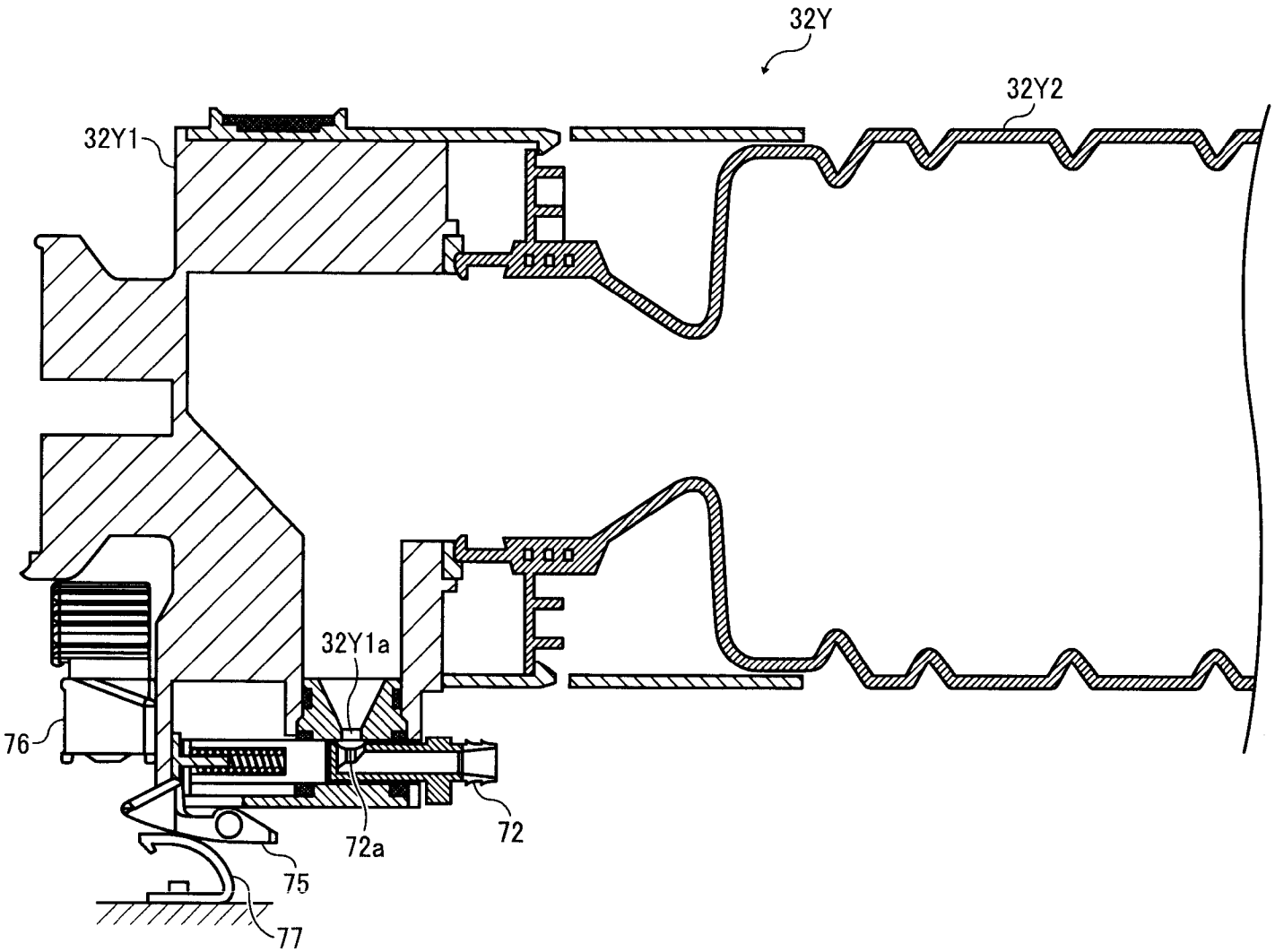
FIG. 35 is a cross-sectional view that illustrates the toner container set in the toner container mount.
Figure 36:
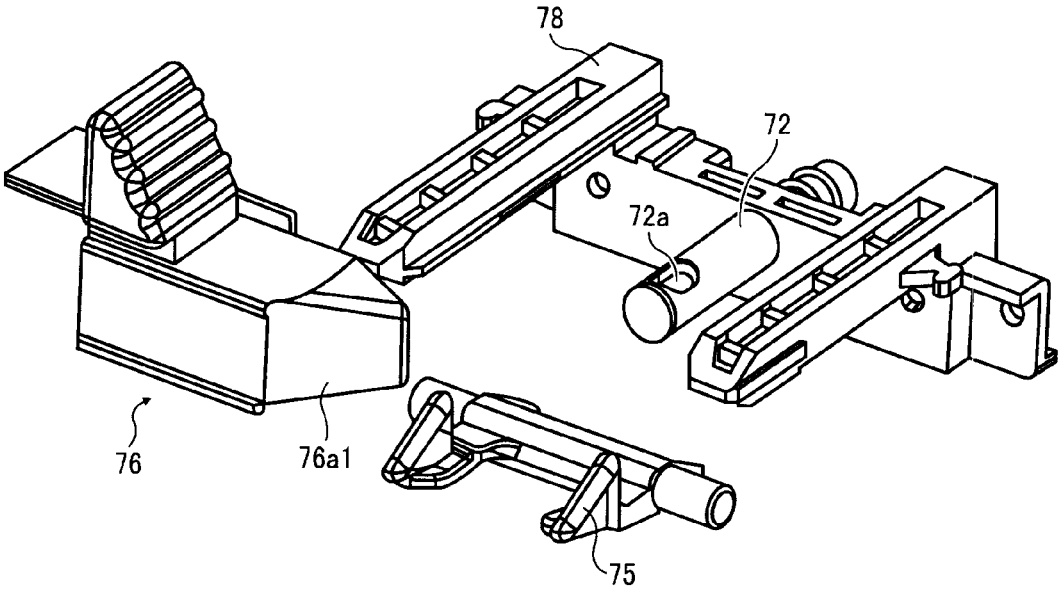
FIG. 36 is a perspective view that illustrates relative positions of a nozzle, a pawl, and the lever for fixing and releasing the toner container.
Figure 37:
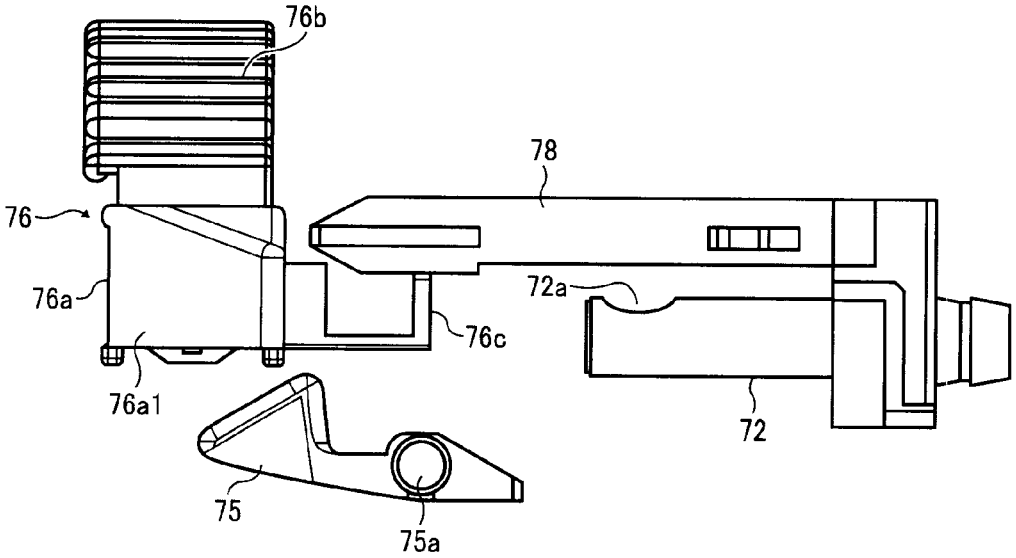
FIG. 37 is a side view that illustrates the relative positions of the nozzle, the pawl, and the lever for fixing and releasing the toner container.

FIGS. 32 through 34 are schematic cross-sectional views in parallel to the long axis of the toner container 32Y that illustrate progress of insertion of the toner container 32Y into the toner container mount 31 in the installation direction X. FIG. 35 is a schematic cross-sectional views in parallel to the long axis of the toner container 32Y that illustrate in the toner container 32Y fully inserted in the toner container mount 31 and the toner outlet 32Y1*a* is opened fully. FIG. 36 is a perspective view that illustrates relative positions of the nozzle 72, the pawl 75, and the lever 76 provided in the toner container mount 31. FIG. 37 is a side view in parallel to the long axis of the toner container 32Y that illustrates relative positions of the nozzle 72, the pawl 75, and the lever 76. In FIG. 37, the toner container 32Y to be inserted into the toner container mount 31 moves from the left to the right. Referring to FIG. 37, the lever 76, the pawl 75, and the nozzle 72 are arranged, in that order, in the installation direction of the toner container 32Y.

To mount the toner container 32Y in the toner container mount 31 of the main body 100, initially the cover provided on the front side of the main body 100 is opened, and thus the toner container mount 31 (insertion openings 71) is exposed on the front side.

Subsequently, the user grips the handle 32Y1*c* and push the toner container 32Y into the toner container mount 31. More specifically, the toner container 32Y is inserted into the toner container mount 31 along the longitudinal direction of the toner container 32Y with the cap 32Y1 positioned upstream from the container body 32Y2 in the installation direction.

At that time, downstream end portions of the ribs 32Y1*m* (shown in FIG. 22) in the installation direction, serving as the sliding contact portion, contact the sloped surface 76*a*1 of the pawl 76*a* of the lever 76. The sloped surface 76*a*1 of the pawl 76*a* of the lever 76 is sloped so that the pawl 76*a* extends closer to the toner container 32Y downstream in the installation direction of the toner container 32Y as shown in FIGS. 14 through 17. Accordingly, as insertion of the toner container 32Y progresses, the lever 76 is pushed by the downstream end portions of the ribs 32Y1*m* to the release position not to hinder the insertion of the toner container 32Y. As the toner container 32Y is further inserted with an edge portion of the lever 76 at the release position in sliding contact with the ribs 32Y1*m*, the pawl 75 engages the pair of third grooves 32Y1*q* provided on the bottom face of the toner container 32Y as shown in FIG. 32. At that time, the first grooves 32Y1*g* of the cap 32Y1 engage the positioning protrusions 78 of the toner container mount 31, thus starting registration of the toner container 32Y.

When the pawl 75 of the toner container mount 31 comes in contact with the slidable surface 32Y1*r* of the cap 32Y1 as the toner container 32Y is inserted further, the pawl 75 is pushed down by a sloped face on the rim of the slidable surface 32Y1*r*. Thus, the pawl 75 is moved to the release position not to hinder insertion of the cap 32Y1. The toner container 32Y is further inserted as the pawl 75 pushed down slides on the slidable surface 32Y1*r* as shown in FIG. 33.

Subsequently, when the pawl 75 reaches the second groove 32Y1*i* as the toner container 32Y is inserted further, the pawl 75 moves from the release position shown in FIG. 33 and projects to the position engaging the plug 32Y3 so as to fit in the second groove 32Y1*i*. That is, the pawl 75 rotates about the shaft 75*a* (shown in FIG. 34). In other words, the slidable surface 32Y1*r* no longer pushes the pawl 75, and then the pawl 75 is pushed up by the leaf spring 77. At that time, a downstream end portion of the plug 32Y3 in the installation direction of the toner container 32Y reaches a position to contact the nozzle 72, and the position of the plug 32Y3, clamped by the nozzle 72 and the pawl 75, is determined relative to the toner container mount 31Y as shown in FIG. 34.

As the toner container 32Y is inserted further in the installation direction X, the nozzle 72 fits in the nozzle inlet 32Y1*j* with the positioning protrusions 78 fitted in the first grooves 32Y1*g*. Accordingly, the plug 32Y3 moves in the nozzle connection compartment 32Y1*b* relatively, thereby opening the toner outlet 32Y1*a*.

Then, referring to FIG. 35, the plug 32Y3 opens the toner outlet 32Y1*a* fully, and the nozzle 72 is inserted into the cap 32Y1 so that the toner inlet 72*a* of the nozzle 72 communicates with the toner outlet 32Y1*a*. Simultaneously, the lever 76 that has moved to the release position and slid on the ribs 32Y1*m* reaches upstream end portions of the ribs 32Y1*m* in the installation direction X and is no longer pushed by the ribs 32Y1*m*. Then, the lever 76 returns to the retaining position, pushed by the spring 76*d* as shown in FIG. 12. Thus, installation of the toner container 32Y is completed.

To remove the toner container 32Y from the toner container mount 31, the above-described processes are executed in the reverse order to that in insertion of the toner container 32Y.

When the lever 76 is moved to the release position, the driving coupling 91 of the toner container mount 31 pushes the toner container 32Y in the removal direction (to the left in FIG. 35). Simultaneously, the spring 32Y30*b* and the pawl 75 in contact with the plug 32Y3 push the plug 32Y3 in the nozzle connection compartment 32Y1*b*, thereby closing the toner outlet 32Y1*a*. At that time, while keeping the release position, the lever 76 slides on the ribs 32Y1*m* on the cap 32Y1 and does not move to the retaining position to hinder removal of the toner container 32Y. Subsequently, when the toner container 32Y is moved from the state shown in FIG. 34, further in the removal direction opposite the installation direction X, the pawl 75 is pushed down to the position not to hinder removal of the cap 32Y1 as shown in FIG. 33. As the toner container 32Y is moved further in the removal direction, the pawl 75 is no longer pushed by the slidable surface 32Y1*r* and then is pushed up by the leaf spring 77. Then, the pawl 75 fits in the third groove 32Y1*q* as shown in FIG. 32. When the cap 32Y1 is removed completely from the toner container mount 31, the lever 76 is not pushed by the rib 32Y1*m* but is moved by the spring 76*d* to the retaining position.

Next, supply of toner from the toner containers 32 according to the first embodiment when one of them is removed (replaced) is described in detail below.

In the image forming apparatus 200 according to the present embodiment, when one of the yellow, cyan, magenta, and black toner containers 32 is removed, for example, for replacement, supply of the toner from other toner containers 32 is not stopped. In other words, the motors 92 for the respective toner containers 32 can be driven independently, and other toner containers 32 in the toner container mount 31 than the one removed therefrom receive driving forces from the respective motors 92. When the cover provided on the front side of the main body 100 is opened, although the toner containers 32 set in the toner container mount 31 are exposed, the container bodies (e.g., 32Y2) that rotate are positioned on the back of the respective caps (e.g., 32Y1). Because the container body 32Y2 is not exposed through the insertion opening 71Y, the possibility that the user touches the rotating container body 32Y2 and gets injured is eliminated even when the toner container 32Y is being driven by the bottle driving unit 90.

The user, however, might get injured in case the driving force is transmitted from the bottle driving unit 90 to the toner container 32 to be removed in removal of that toner container 32. Therefore, the first embodiment can make sure to stop driving of the toner container removed from the toner container mount 31 with driving of other toner containers 32 kept when one of the toner containers is removed.

As described above, the bottle fixing portion 70 includes the position detectors 79 shown in FIGS. 40A through 40D for detecting the positions of the respective levers 76. In the first embodiment, start and stop rotating the toner containers 32, writing data in the electronic boards (ID chips) 32Y1*f*, and supplying toner from the toner containers 32 can be controlled with signals output from the respective position detectors 79. More specifically, the image forming apparatus 200 includes the controller 101 to control start and stop of the bottle driving units 90, data writing in the electronic boards (ID chips) 32Y1*f*, and the toner supply, and the controller 101 performs these control operations according to the signals output from the position detectors 79.

When the output from the lever position detector 79 is on, that is, in the state shown in FIGS. 40A and 40B, the controller 101 drives the motor 92Y as required. The controller 101, however, stops the motor 92Y compulsively even if driving the motor 92Y is necessary, when the output from the lever position detector 79 is off, that is, in the state shown in FIGS. 40C and 40D. More specifically, when the toner container 32Y is set in the toner container mount 31, the lever 76 is at the retaining position, thus retaining the toner container 32Y. At that time, the lever position detector 79 detects the lever 76 and outputs a detection signal. After the toner container 32Y is removed from the toner container mount 31, the lever 76 moves to the retaining position similarly, biased by the spring 76*d*. At that time, if the motor 92 is driven, it is possible that an excessive amount of electrical current might be supplied to the motor 92 because the load is low. Therefore, even when the lever 76 is moved to the retaining position, the controller 101 does not drive the motor 92 unless a container detector detects that the toner container 32Y is set in the toner container mount 31. Thus, the controller 101 drives the motor 92 as required only when the lever position detector 79 detects that the lever 76 is at the retaining position and the container detector detects that the toner container 32Y is set in the toner container mount 31. For example, the antenna boards 74 can serve as the container detector, which is described in detail later.

It is to be noted that, the antenna boards 74 can serve as the container detectors in the present embodiment. More specifically, when it is detected that the antenna board 74Y can communicate the electronic board 32Y1*f*, the controller 101 recognizes that the toner container 32Y is detected. Alternatively, the toner container 32Y may be detected in a manner different from that using the antenna board 74. For example, an insertion detecting switch may be used.

By contrast, in removal of the toner container 32Y, the output from the lever position detector 79 is turned off when the lever 76 is slid to the release position. When the output from the lever position detector 79 is off, the controller 101 stops the motor 92Y compulsively even if the antenna board 74 detects the toner container 32Y, that is, the antenna board 74Y can communicate the electronic board 32Y1*f*, and driving of the motor 92Y is necessary. With this control, the motor 92 can be stopped before removal of the toner container 32Y from the toner container mount 31 is started.

With this configuration, because the motor 92 to rotate the toner container 32Y is started only after the toner container 32Y is retained therein properly, unnecessary downtime is not caused even when the cover of the main body 100 is not closed fully. Even when the cover is left open, the toner containers 32 that are not to be replaced, set in the toner container mount 31, can be kept rotating, and thus eliminating unnecessary downtime.

Further, in installation of the toner container 32Y, although it is possible that the antenna board 74Y can detect the toner container 32Y before the toner container 32Y is inserted fully, that is, moved to an installation position, the motor 92 is not started immediately. The motor 92 is started only after the user moves the toner container 32Y to the installation position, the lever 76 is moved to the retaining position, and the lever position detector 79 detects that the lever 76 is at the retaining position. Additionally, in removal of the toner container 32Y, before removal of the toner container 32Y is started, the motor 92 is stopped immediately when the lever 76 is moved to the release position and the lever position detector 79 detects that. This configuration can prevent the possibilities that the motor 92 is started before the toner container 32Y is set in at the installation position, and that the motor 92 is kept rotating after the toner container 32Y is removed, thus supplying electrical current excessively to the motor 92. Thus, damage to the motor 92, the driving coupling 91, and the driving input parts 32Y2*b*, caused by driving the motor 92 at improper timing, can be prevented or reduced.

Figure 41A:
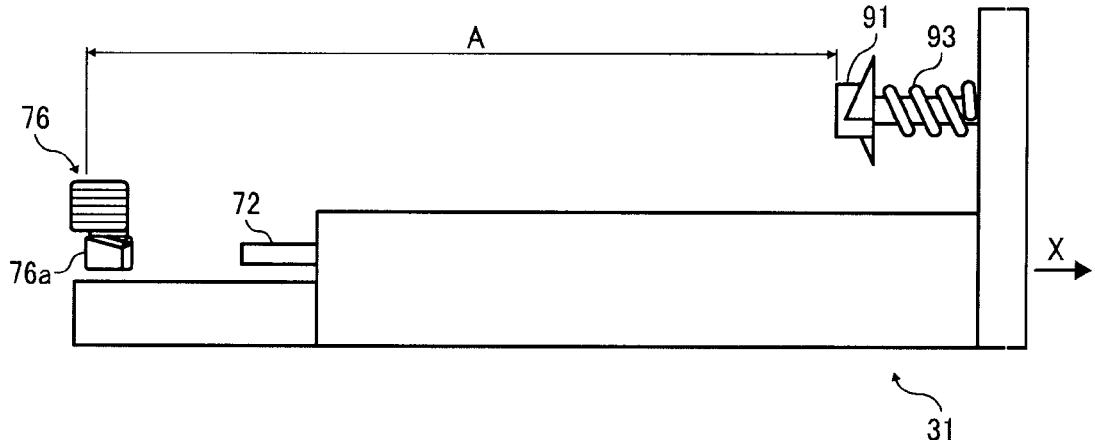
FIGS. 41A and 41B are schematic side views of the toner container and the toner container mount.
Figure 41B:
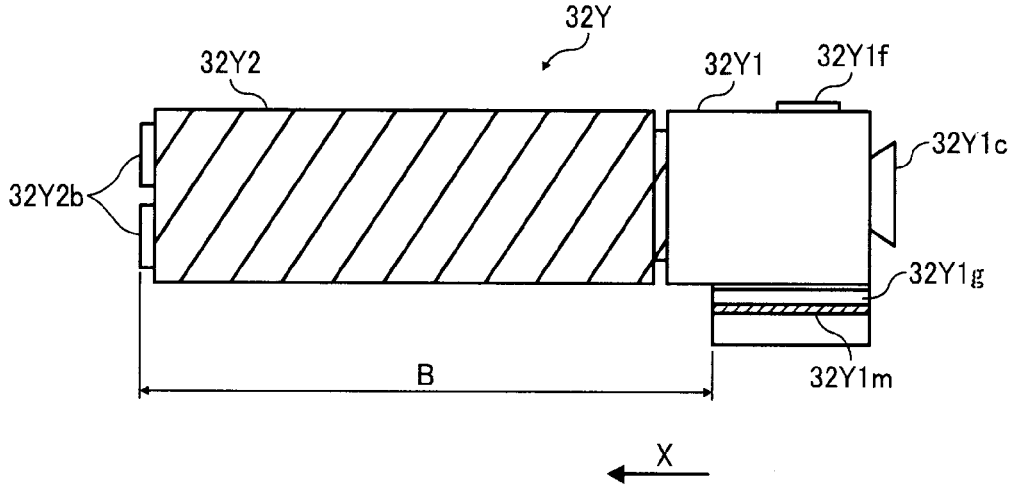

FIG. 41A is a schematic side view that illustrates relative positions of the lever 76 and the bottle driving unit 90 in the installation direction of the toner container 32Y, and FIG. 41B is a schematic side view of the toner container 32Y. For simplification and ease of understanding, the toner container mount 31 and the toner container 32Y shown in FIGS. 41A and 41B are those as viewed from the opposite sides. That is, the toner container 32Y is inserted into the toner container mount 31 from the left to the right in FIG. 41A. By contrast, the toner container 32Y is inserted into the toner container mount 31 from the right to the left in FIG. 41B.

In FIG. 41A, a distance A is a horizontal length of the toner container mount 31 from an upstream end (proximal end) of the pawl 76*a* of the lever 76 to the driving coupling 91 in the installation direction. In FIG. 41B, a distance B is a horizontal length from the downstream end portion of the sliding contact portion 32Y1*m* of the toner container 32Y to the driving input parts 32Y2*b* in the installation direction. In the present embodiment, the distance B is longer than the distance A.

With this configuration, in inserting the toner container 32Y into the toner container mount 31, the driving input parts 32Y2*b* do not come into contact with the driving coupling 91 when the toner container 32Y is inserted to a position where the downstream end portion of the sliding contact portion 32Y1*m* of the toner container 32Y starts to contact the pawl 76*a* (shown in FIG. 14). When the toner container 32Y is inserted further backward, the lever 76 slides to the release position, and thus the output from the lever position detector 79 is turned off. Accordingly, driving of the motor 92 of the bottle driving unit 90 is stopped. Therefore, even when the driving input parts 32Y2*b* contact the driving coupling 91, the container body 32Y2 of the toner container 32Y does not rotate. As described above, when the distance A shown in FIG. 41A is greater than the distance B shown in FIG. 41B (A>B), unintentional rotation of the container body 32Y2 can be prevented when the toner container 32Y is installed or removed from the toner container mount 31.

The controller 101 prohibits data writing on the IC chip of the electronic board 32Y1*f* unless the container detector detects that the toner container 32Y is set in the toner container mount 31 even when the lever 76Y is moved to the retaining position. The controller 101 enables the data writing on the IC chip 32Y1*f* as required only when the lever position detector 79 serving as a retaining state detector detects that the lever 76 is at the retaining position and the container detector detects that the toner container 32Y is set in the toner container mount 31.

In removal of the toner container 32Y, the output from the lever position detector 79 is turned off when the lever 76 is slid to the release position. When the output from the lever position detector 79 is off, the controller 101 stops data writing on the IC chip 32Y1*f* compulsively even if the antenna board 74Y detects the toner container 32Y, that is, the antenna board 74Y can communicate the electronic board 32Y1*f*. This control can inhibits data writing on the IC chip (electronic board) 32Y1*f* when the toner container 32Y is removed from the toner container mount 31. That is, data writing is not attempted when it is inexecutable. Thus, write errors can be prevented or reduced.

Figure 42A:
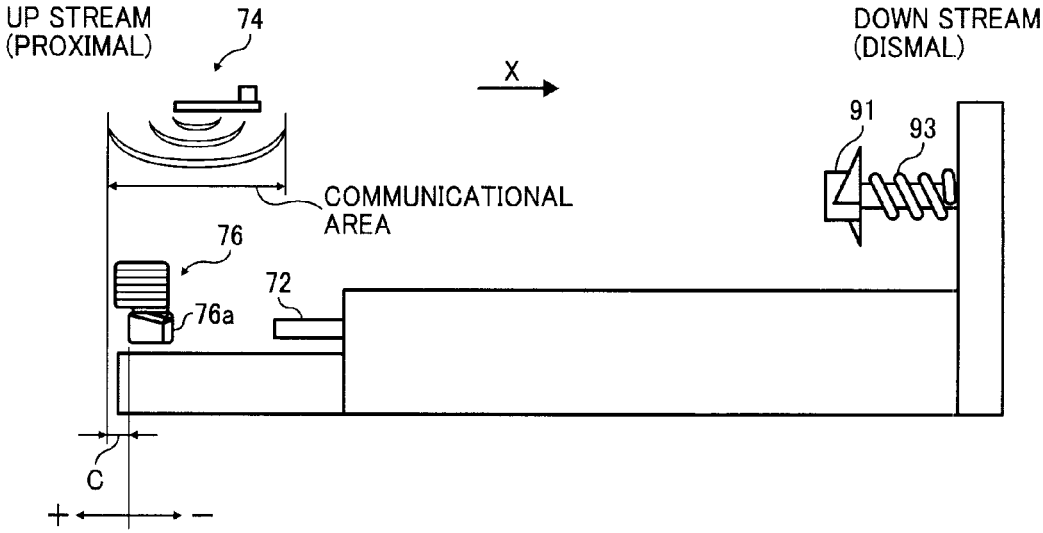
FIGS. 42A and 42B are schematic side views of the toner container and the toner container mount.
Figure 42B:
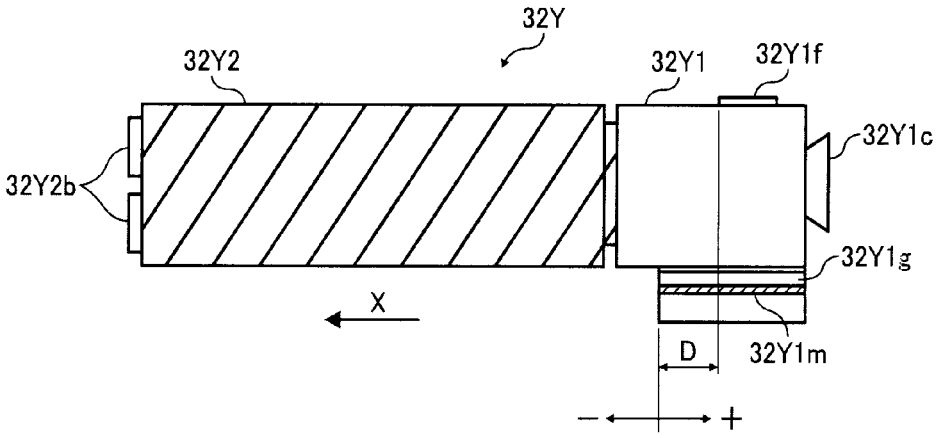

FIG. 42A is a schematic side view that illustrates relative positions of the lever 76 and the antenna board 74 in the installation direction of the toner container 32Y, and FIG. 42B is a schematic side view of the toner container 32Y. For simplification and ease of understanding, the toner container mount 31 and the toner container 32Y shown in FIGS. 42A and 42B are those as viewed from the opposite sides. That is, the toner container 32Y is inserted into the toner container mount 31 from the left to the right in FIG. 42A. By contrast, the toner container 32Y is inserted into the toner container mount 31 from the right to the left in FIG. 42B.

In FIG. 42A, a distance C is a horizontal distance, in the installation direction of the toner container 32Y, from the upstream end of the pawl 76*a* of the 76 to an upstream end (proximal limit position) of a communicational area in which the antenna board 74 can communicate the electronic board 32Y1*f*. In FIG. 42B, a distance D is a horizontal distance, in the installation direction of the toner container 32Y, from the downstream end portion of the sliding contact portion 32Y1*m* to a downstream end portion of the electronic board 32Y1*f*.

In the present embodiment, the distance D shown in FIG. 42B is greater than the distance C shown in FIG. 42A (D>C). The distance C is regarded as positive (+) when the proximal limit position of the communicational area is upstream from the proximal end portion the pawl 76*a* in the installation direction X and as negative (−) when the upstream side limit position of the communicational area is downstream from the upstream end portion (proximal end) of the pawl 76*a* in the installation direction X. The distance D is regarded as positive (+) when the downstream end of the electronic board 32Y1*f* is upstream from the downstream end portion of the sliding contact portion 32Y1*m* in the installation direction X and as negative (−) when the downstream end of the electronic board 32Y1*f* is downstream from the downstream end portion the sliding contact portion 32Y1*m* in the installation direction X.

When the distance D is thus greater than the distance C, in inserting the toner container 32Y into the toner container mount 31, the electronic board 32Y1*f* does not yet enter the communicational area of the antenna board 74 when the downstream end portion of the sliding contact portion 32Y1*m* of the toner container 32Y starts to contact the pawl 76*a* (shown in FIG. 14). Therefore, before installation of the toner container 32Y in the toner container mount 31 is completed, driving of the motor 92 and data writing on the electronic board 32Y1*f* can be stopped because the output from the antenna board 74 is off outside the communicational area (shown in FIG. 42A) even of the output of the lever position detector 79 is on.

In the state shown in FIG. 14, the toner container 32Y can move because the first grooves 32Y1*g* do not fit around the positioning protrusions 78. If data is written in or read out from the electronic board 32Y1*f* in this state, it is possible that the electronic board 32Y1*f* is moved outside the communicational area of the antenna board 74 during data writing or reading, resulting in a communication error. Thus, the electronic board 32Y1*f* or the antenna board 74, or both can be damaged seriously. Therefore, the relative positions of the toner container 32Y and the toner container mount 31 are set so that the distance D is greater than the distance C. With this arrangement, rotation of the toner container 32Y, and the data writing and reading from the electronic board 32Y1*f* can be executed only after the toner container 32Y is secured in the toner container mount 31.

Additionally, even when the lever 76 is moved to the retaining position, the controller 101 does not drive the motor 66Y for driving the screw pump 61Y unless the container detector detects that the toner container 32Y is set in the toner container mount 31. Thus, the controller 101 drives the motor 66Y as required only when the position detector detects that the lever 76 is at the retaining position and the container detector detects that the toner container 32Y is set in the toner container mount 31.

In removal of the toner container 32Y, the output from the lever position detector 79 is turned off when the lever 76 is slid to the release position. When the output from the lever position detector 79 is off, the controller 101 stops the motor 66Y compulsively even if the antenna board 74 detects the toner container 32Y, and driving of the motor 66Y is necessary. With this control, driving of the screw pump 61Y can be stopped before removal of the toner container 32Y from the toner container mount 31 is started and the nozzle 72 is removed from the cap 32Y1.

Further, in installation of the toner container 32Y, although the antenna board 74 can detect the toner container 32Y before the toner container 32Y is inserted fully, that is, moved to the installation position, the motor 66Y is not started immediately. The motor 66Y is started only after the user moves the toner container 32Y to the installation position, the lever 76 is moved to the retaining position, and the lever position detector 79 detects that the lever 76 is at the retaining position. Consequently, the screw pump 61Y can be driven only after the nozzle 72 is inserted into the cap 32Y1 securely.

Therefore, in the present embodiment, the screw pump 61Y can be prevented from sucking in air in installation or removal of the toner container 32Y.

Table 1 illustrates relations among time of the various operations, on and off states of outputs from the detectors, and the movements of the respective components.

TABLE 1

| Operational timing | Lever position detector | Antenna board communication (insertion detection) | Toner container rotation | Writing on electronic board | Screw pump driving |
|---|---|---|---|---|---|
| Toner container secured | ON | OK | Permitted | Permitted | Permitted |
| Lever released | OFF | OK | Prohibited | Prohibited | Prohibited |
| Toner container removed | ON | Not available | Prohibited | Prohibited | Prohibited |
| Installation of new container started | OFF | Switched to OK | Prohibited | Prohibited | Prohibited |
| New container secured | ON | OK | Permitted | Permitted | Permitted |

When the toner container 32Y is secured at the installation position, the output from the lever position detector 79 is on and the antenna board 74 detects that the toner container 32Y is "present", that is set in the toner container mount 31. In this state, rotation of the toner container 32Y, data writing on the IC chip (electronic board) 32Y1*f*, and driving of the screw pump 61Y are allowed as required. When the lever 76 is released to remove the toner container 32Y from the toner container mount 31, the output from the lever position detector 79 is turned off. In this state, rotation of the toner container 32Y, data writing on the IC chip (electronic board) 32Y1*f*, and driving of the screw pump 61Y are forbidden or stopped compulsively, as described above, even when the antenna board 74 detects that the toner container 32Y is present. When the toner container 32Y is removed and is not present in the toner container mount 31, the output from the lever position detector 79 is on and the antenna board 74 does not detect the toner container 32Y, that is, regards it as "absent". In this state, rotation of the toner container 32Y, data writing on the IC chip (electronic board) 32Y1*f*, and driving of the screw pump 61Y are yet forbidden. Further, while a new toner container 32Y is being installed in the toner container mount 31, the output from the lever 79 is off and the state of the toner container 32Y detected by the antenna board 74 changes from "absent" to "present". Because insertion of the toner container 32Y is not yet completed even when the presence of the toner container 32Y in the toner container mount 31 is detected, the output from the lever position detector 79 remains off. Accordingly, the rotation of the toner container 32Y, data writing on the IC chip (electronic board) 32Y1*f*, and the driving of the screw pump 61Y are yet forbidden. When the new toner container 32Y is set at the installation position, the output from the lever position detector 79 is turned on and the antenna board 74 detects that the toner container 32Y is present. Therefore, the rotation of the toner container 32Y, data writing on the IC chip (electronic board) 32Y1*f*, and the driving of the screw pump 61Y are allowed as required.

Figure 48:
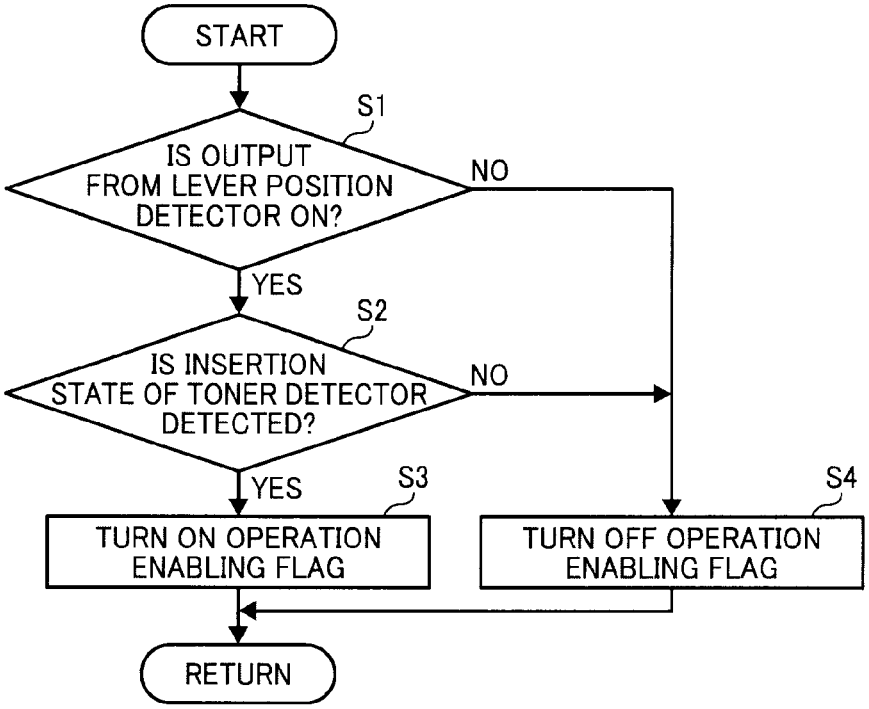
FIG. 48 is a flowchart that illustrates a sequence of processes for setting operation enabling flag by a controller of the image forming apparatus according to an illustrative embodiment.

FIG. 48 is a flowchart that illustrates a sequence of processes for setting operation enabling flags by the controller 101 of the image forming apparatus 200 according to the first embodiment.

The operation enabling flag setting is performed repeatedly, independently for each of yellow, cyan, magenta, and black, when a main power of the image forming apparatus 200 is on. Referring to FIG. 48, at S1 the controller 101 checks the output from the lever position detector 79 and, at S2, checks the insertion state of the toner container 32 detected by the antenna board 74. When the output from the lever position detector 79 is on (Yes at S1) and it is detected that the toner container 32 is present (Yes at S2), at S3 the operation enabling flag is turned on. In other cases, at S4 the operation enabling flag is turned off.

Figure 49:
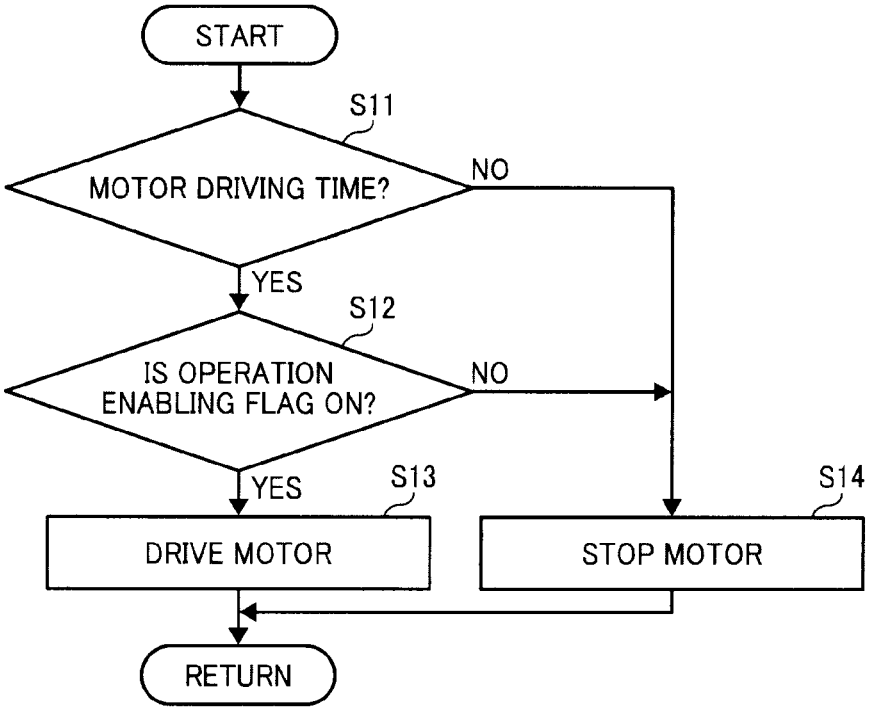
FIG. 49 is a flowchart that illustrates a sequence of processes for allowing or forbidding rotation of the toner container by the controller.

FIG. 49 is a flowchart that illustrates a sequence of processes for allowing or forbidding rotation of the toner container 32 by the controller 101 according to the first embodiment.

The controller 101 allows or inhibits rotation of the toner container 32 for yellow, cyan, magenta, and black, independently. Referring to FIG. 49, at S11 the controller 101 checks whether or not a predetermined driving time has come and, at S12, checks whether the operation enabling flag is on. When the predetermined driving time has come (Yes at S11) and the operation enabling flag is on (Yes at S12), at S13 the motor 92 is driven. In other cases, at S14 the motor 92 is stopped or is prevented from rotating. With this control, the motor 92 for rotating the toner container 32 can be preventing from rotating at improper timing, that is, during installation and removal of the toner container 32.

It is to be noted that processes for allowing and prohibiting data writing on the IC chip (electronic board) 32Y1*f* for each color are similar to the above-described allowance and prohibition of the motor 92 for rotating the toner container 32. More specifically, data writing on the IC chip (electronic board) 32Y1*f* is executable only when a predetermined data writing time has come and the operation enabling flag is on. In other cases, data writing is topped or prohibited. With this control, data writing on the IC chip (electronic board) 32Y1*f* can be prevented at improper timing, thus preventing occurrence of resulting write errors.

Figure 50:
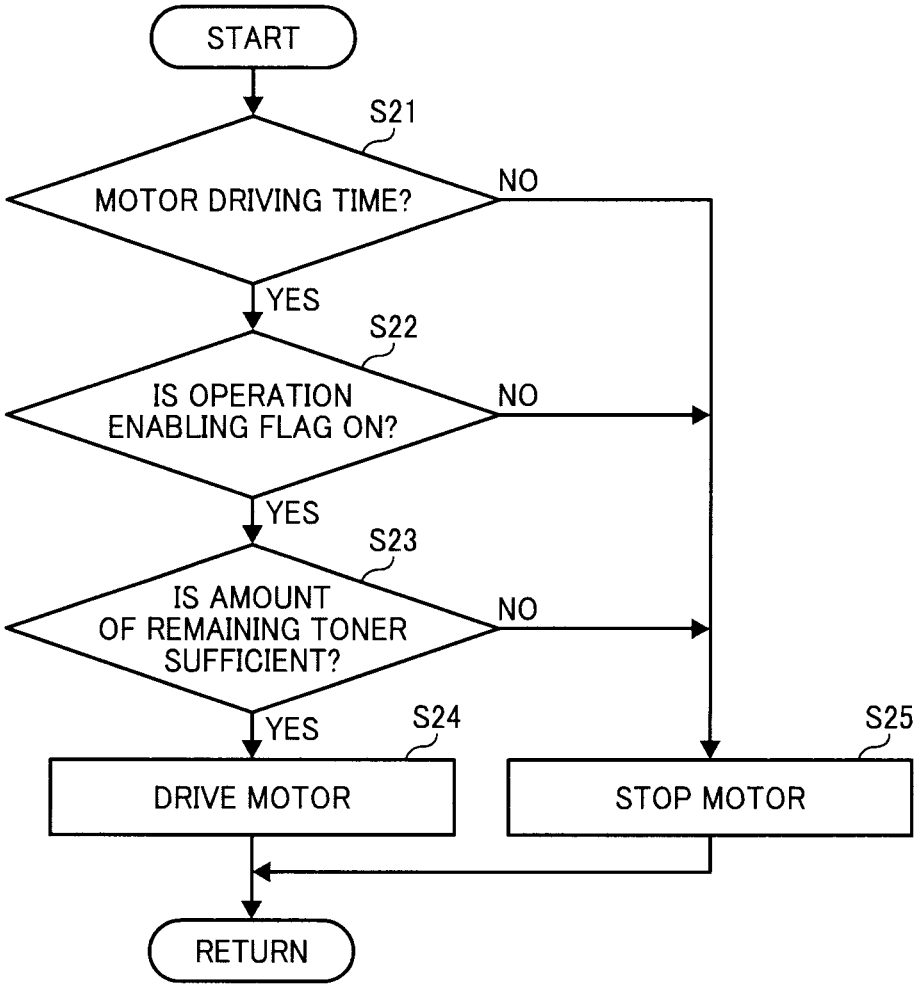
FIG. 50 is a flowchart that illustrates processes for allowing and forbidding driving of a screw pump by the controller.

FIG. 50 is a flowchart that illustrates processes for allowing and forbidding driving of the screw pump 61 by the controller 101.

Allowing and forbidding driving of the screw pump 61 are performed for yellow, cyan, magenta, and black, independently. Allowing and forbidding driving of the screw pump 61 are performed on the premises that the controller 101 calculates the amount of toner remaining in the toner container 32 based on printing time, for example, and regularly renews the amount of remaining toner stored on the IC chip (electronic board) 32Y1*f* of the toner container 32, that is, replaces the stored amount of remaining toner with the latest amount of remaining toner calculated. Therefore, even when the toner container 32 is replaced with used one, the controller 101 can recognize the amount of toner remaining in that toner container 32.

Referring to FIG. 50, at S21 the controller 101 checks whether or not a predetermined driving time for driving the motor (e.g., 66Y) to drive the screw pump 61 has come and, at S22, checks whether the operation enabling flag is on. The processes for allowing and forbidding driving of the screw pump 61 are similar to those for rotating the toner container 32 shown in FIG. 49 so far. Subsequently, the controller 101 makes a determination that is not included in the processes shown in FIG. 49. More specifically, at S23 the controller 101 retrieves the amount of remaining toner stored on the IC chip (electronic board) 32Y1*f* of the toner container 32. Then, the controller 101 determines whether or not the retrieved amount of remaining toner is greater than a given threshold amount, that is, the amount of toner remaining in the toner container 32 is sufficient. At S24, the controller 101 drives the motor 66 for driving the screw pump 61 only when the predetermined driving time has come (Yes at S21), the operation enabling flag is on (Yes at S 22), and the amount of remaining toner in the toner container 32 is sufficient (Yes at S23). In other cases, the controller 101 stops or prevent the motor 66 from rotating. With this control, the screw pump 61 can be preventing from rotating at improper timing, that is, during installation and removal of the toner container 32. Additionally, even when the toner container 32 is retained at the installation position, driving of the screw pump 61 is not allowed when the amount of remaining toner is insufficient. Accordingly, the screw pump 61 can be prevented from sucking in air through the empty toner container 32.

It is to be noted that the amount of remaining toner to be stored on the ID chip can be calculated using the cumulative number of dots output after the toner container 32 is replaced, obtained from image data for each printing or each output sheet. Alternatively, the amount of remaining toner may be calculated based on the cumulative time period during which the toner container 32 is rotated after the toner container 32 is replaced. Yet alternatively, the amount of remaining toner may be calculated based on the driving torque of the motor 92 for rotating the toner container 32, detected by a torque detector.

Second Embodiment

A second embodiment is described below with reference to FIG. 38.

Figure 38:
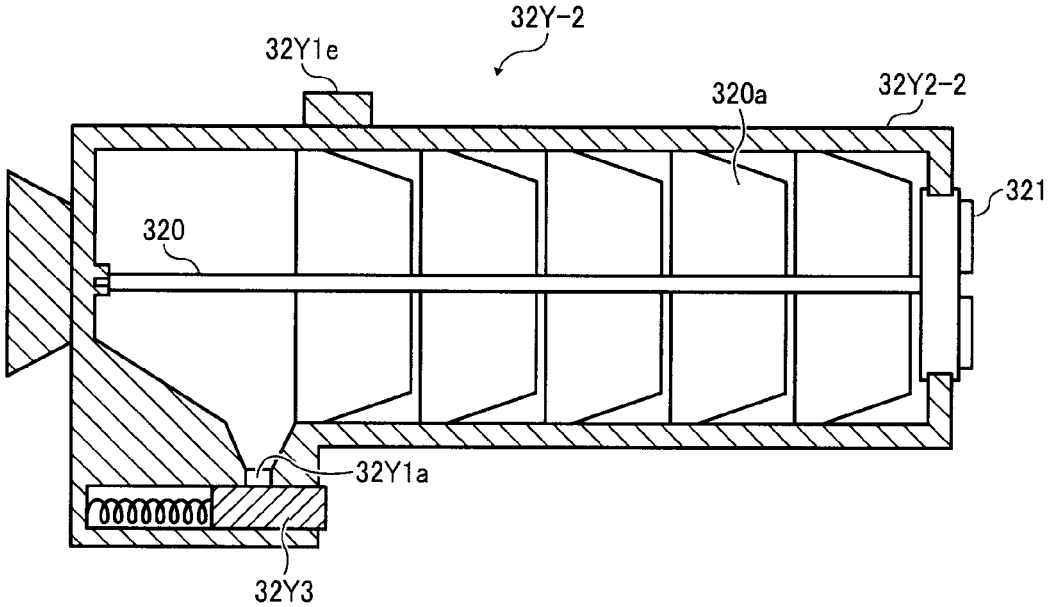
FIG. 38 is a schematic cross-sectional view of a toner container according to another embodiment.

FIG. 38 is a schematic cross-sectional view of a toner container 32Y-2 according to the second embodiment. The toner container 32Y-2 according to the second embodiment is different from the toner container 32Y in the first embodiment in that a conveyance member 320 is provided in a container body 32Y2-2.

As shown in FIG. 38, the toner container 32Y-2 in the second embodiment includes the container body 32Y2-2 and the conveyance member 320 provided inside the container body 32Y2-2. The container body 32Y2-2 is retained such a way as not to rotate by the main body 100 when the toner container 32Y-2 is installed in the toner container mount 31. Although, in the first embodiment, the toner is conveyed along the spiral protrusion 32Y2*a* (shown in FIG. 21) formed in the inner circumferential face of the container body 32Y2 as the container body 32Y2 rotates, the toner is conveyed by the conveyance member 320 in the second embodiment. Because the container body 32Y2-2 does not rotate, a cap and the container body 32Y-2 may be united as a single unit. Needless to say, the toner container 32Y-2 may include a separate cap similarly to the first embodiment.

A shaft of the conveyance member 320 is rotatively supported by the head side and the bottom side of the container body 32Y2-2. The member 320 includes multiple agitation blades 320*a* connected to or continuous with the shaft of the conveyance member 320 and a driving input part 321 provided on the bottom side, that engages the driving coupling 91. The driving input part 321 may be a driven coupling, for example. With this configuration, the conveyance member 320 rotates and transports the toner inside the toner container 32Y-2 in its longitudinal direction (in FIG. 38, to the left), receiving a driving force from the driving coupling 91 of the main body 100. Thus, the toner is discharged through the toner outlet 32Y1*a* to the nozzle 72.

In the second embodiment, the container body 32Y2-2 includes the toner outlet 32Y1*a*, the nozzle connection compartment 32Y1*b*, the protrusions 32Y1*e* for color discrimination, the pressed portion 32Y1*h*, and the electronic board 32Y1*f* similarly. The handle 32Y1*c* is provided on the container body 32Y2-2.

Third Embodiment

A third embodiment is described below with reference to FIG. 39.

Figure 39:
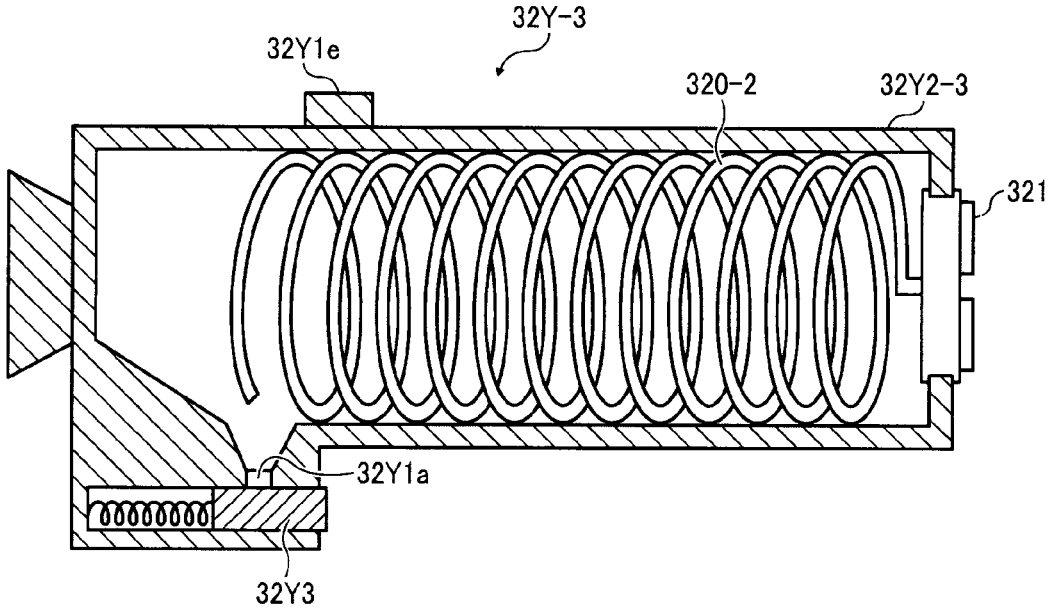
FIG. 39 is a schematic cross-sectional view of another configuration of the toner container.

FIG. 39 is a schematic cross-sectional view of a toner container 32Y-3 according to the third embodiment. The toner container 32Y-3 according to the third embodiment is different from the toner container 32Y in the first embodiment in that a conveyance member 320-2 is provided in a container body 32Y2-3.

As shown in FIG. 39, the toner container 32Y-3 in the third embodiment includes the container body 32Y2-3 and the conveyance member 320-2 provided inside the container body 32Y2-32. The container body 32Y2-3 is retained such a way as not to rotate by the main body 100 of the image forming apparatus 200 when the toner container 32Y-3 is installed in the toner container mount 31.

One end of the conveyance member 320-2, in particular, that on the bottom side, is rotatively supported by the bottom of the container body 32Y2-3. The conveyance member 320-2 is coil-shaped. A driving input part 321 is provided on the bottom side and engages the driving coupling 91. The driving input part 321 may be a driven coupling, for example. With this configuration, the conveyance member 320 rotates and transports the toner inside the toner container 32Y-2 in its longitudinal direction (in FIG. 39, to the left), receiving a driving force from the driving coupling 91 of the main body 100. Thus, the toner is discharged through the toner outlet 32Y1*a* to the nozzle 72.

In the third embodiment, the container body 32Y2-3 includes the toner outlet 32Y1*a*, the nozzle connection compartment 32Y1*b*, the protrusions 32Y1*e* for color discrimination, the pressed portion 32Y1*h*, and the electronic board 32Y1*f* similarly. The handle 32Y1*c* is provided on the container body 32Y2-3. Because the container body 32Y2-3 does not rotate, a cap and the container body 32Y-3 may be united as a single unit. Needless to say, the toner container 32Y-3 may include a separate cap similarly to the first embodiment.

In the above-described second and third embodiments, the downstream end portion of the toner outlet 32Y1*a* is positioned upstream from downstream end portion of the protrusions 32Y1*e* for color discrimination in the installation direction of the toner container 32Y-2 or 32Y-3, similarly to the first embodiment described above. This arrangement can eliminate the possibility that the toner container 32Y-2 or 32Y-3 of different color is set in the toner container mount 31 and that portion of the toner container mount 31 is stained with toner of different color.

Fourth Embodiment

A fourth embodiment is described below with reference to FIGS. 43 through 47B.

The toner container 32Y-4 according to the fourth embodiment includes a cap 32Y1-4 and a container body 32Y2 similarly to the first embodiment described above.

Figure 43:
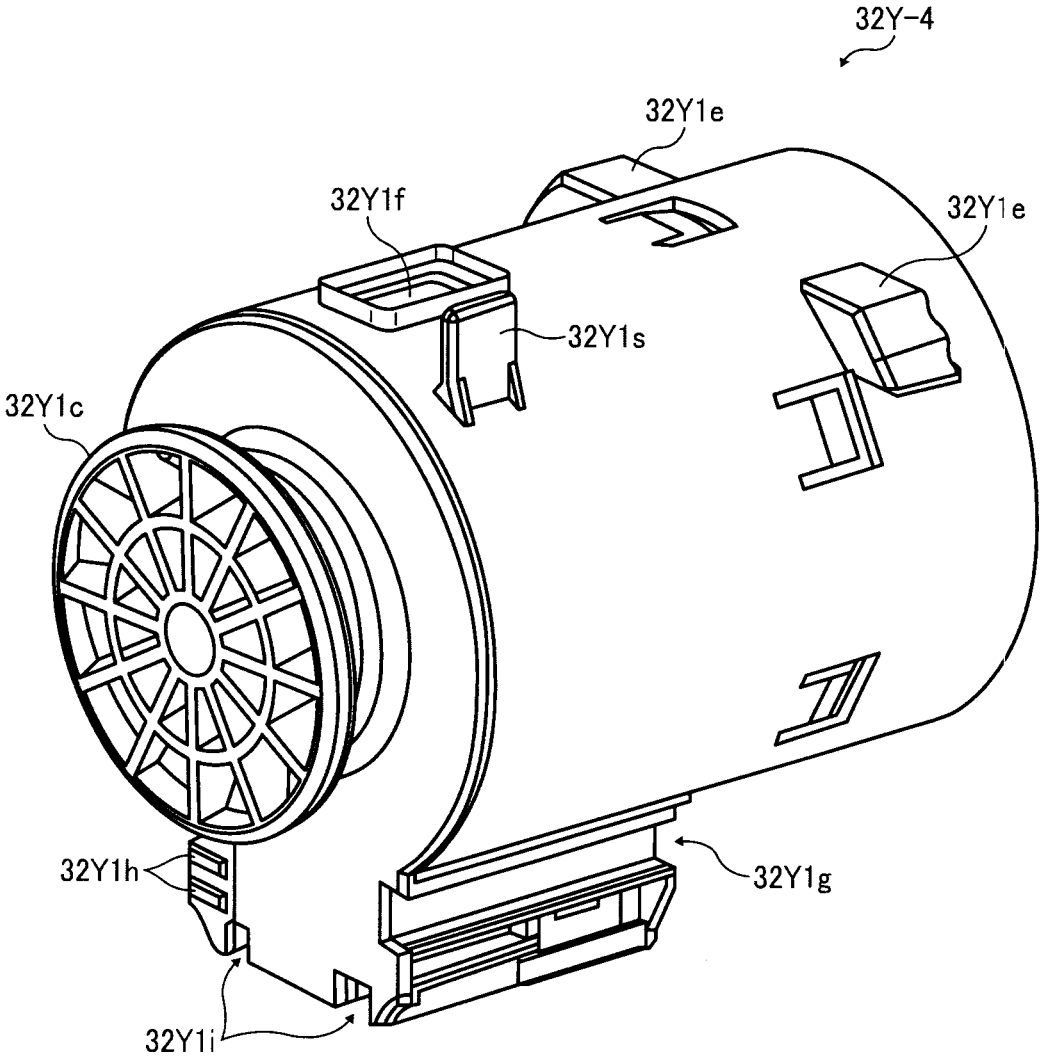
FIG. 43 is a perspective view of a cap of a toner container according to another illustrative embodiment.

FIG. 43 is a perspective view of the cap 32Y1-4 of the toner container 32Y-4 according to the fourth embodiment.

In the fourth embodiment, the cap 32Y1-4 of the toner container 32Y-4 includes the toner outlet 32Y1*a*, the plug 32Y3, the pressed portion 32Y1*h*, the electronic board 32Y1*f*, the protrusions 32Y1*e* for color discrimination, the handle 32Y1*c*, and the first grooves 32Y1*g*, similarly. Further, an interlock release rib 32Y1*s* is provided in a top portion of the cap 32Y1-4, adjacent to the electronic board 32Y1*f*.

Next, the toner container mount 31 according to the fourth embodiment is described in further detail below.

Figure 44:
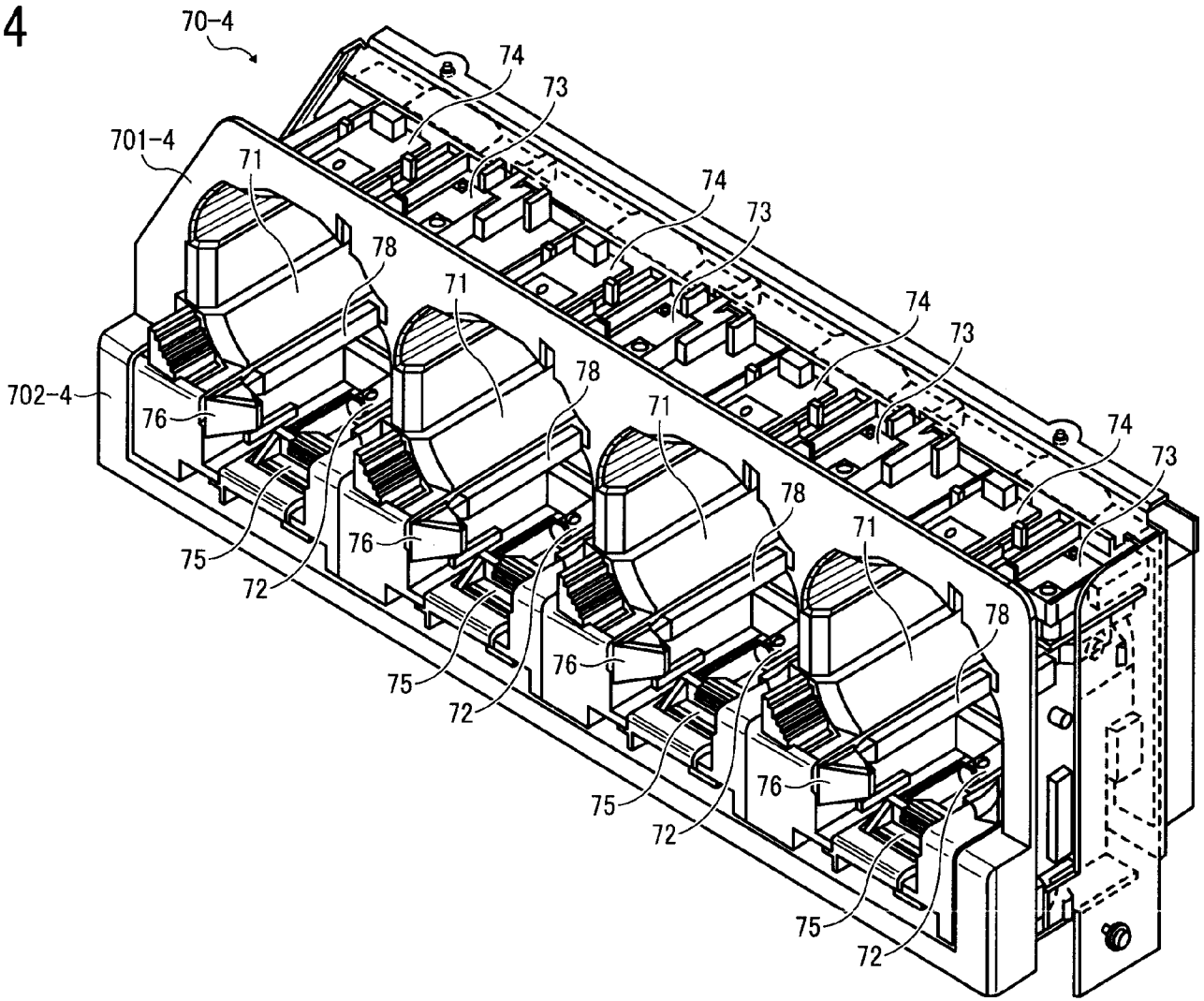
FIG. 44 is a schematic perspective view of a bottle fixing portion according to another illustrative embodiment.
Figure 45:
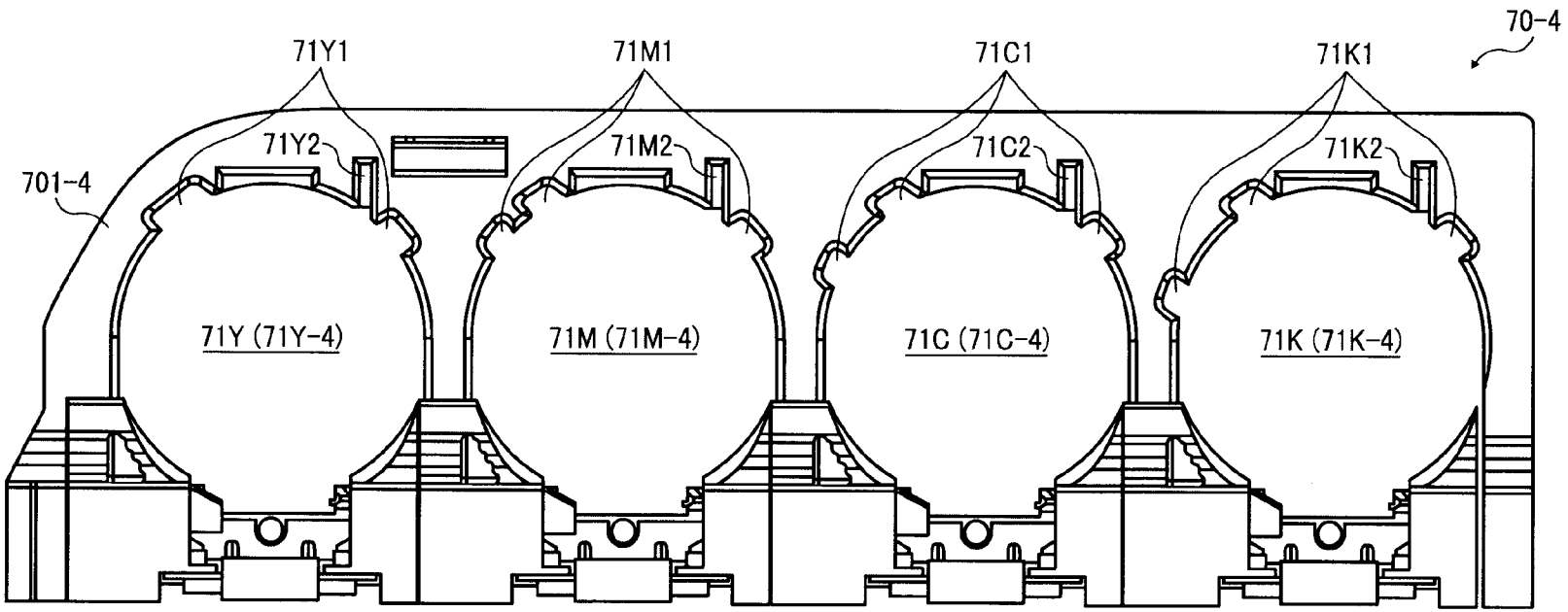
FIG. 45 is a schematic front view of the bottle fixing portion shown in FIG. 44.

FIG. 44 is a perspective view of a bottle fixing portion 70-4 of the toner container mount 31 according to the fourth embodiment. FIG. 45 is a front view of the bottle fixing portion 70-4 as viewed on the upstream side in the installation direction of the toner container.

Referring to FIG. 44, the bottle fixing portion 70-4, constructed of an upper front case 701-4 and a lower front case 702-4, includes an insertion opening 71, a nozzle 72, an antenna board 74, pawl 75, a lever 76 for fixing and releasing the toner container, and a pair of positioning protrusions 78 for each color. Additionally, the upper front case 701-4 of the bottle fixing portion 70-4 includes interlock switches 73 for the respective colors.

Referring to FIG. 45, interiors of cap holders 71Y-4, 71M-4, 71C-4, and 71K-4, respectively defining insertion openings 71Y, 71M, 71C, and 71K, include second guide grooves 71Y2 that fit around the interlock release ribs 32Y1*s*, 32M1*s*, 32C1*s*, and 32K1*s* (shown in FIG. 43) formed on the caps 32Y1-4, 32M1-4, 32C1-4, and 32K1-4 in addition to the first guide grooves 71Y1, 71M1, 71C1, and 71K1 that engage the color discrimination protrusions 32Y1*e*, 32M1*e*, 32Ce, and 32Ke (shown in FIG. 43) provided on the caps 32Y1-4, 32M1-4, 32C1-4, and 32K1-4.

Next, a configuration and operation of the interlock switch 73 are described in further detail below. It is to be noted that, because the interlock switches 73 for the respective colors have a similar configuration, only the interlock switch 73 for yellow is described below.

Figure 46A:
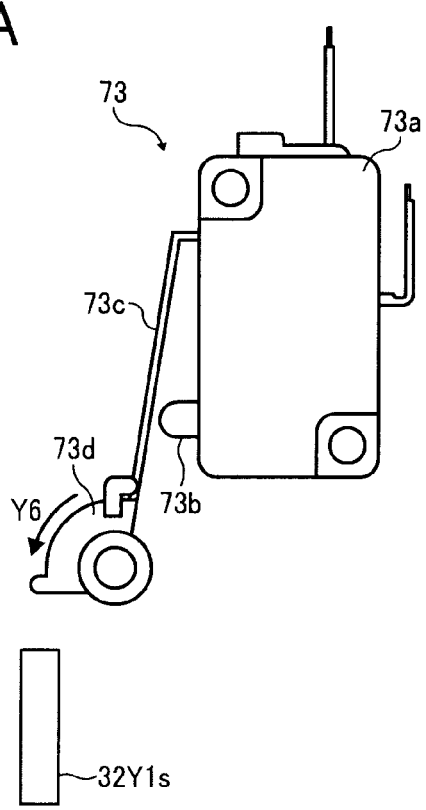
FIGS. 46A and 46B are top views of an interlock switch.
Figure 46B:
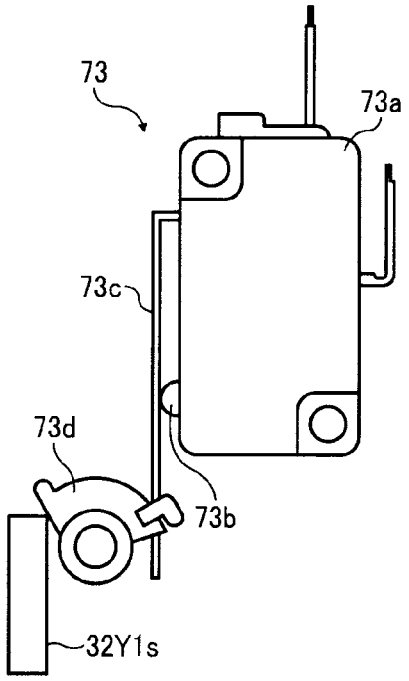

FIGS. 46A and 46B are schematic top views of the interlock switch 73. The output from the interlock switch 73 is off in FIG. 46A and on in FIG. 46B.

Referring to FIGS. 44 and 46A, the interlock switch 73 provided on the upper front case 701-4 of the bottle fixing portion 70-4 includes a switch body 73*a*, a button 73*b*, a blade 73*c*, and a lever 73*d*. More specifically, the lever 73*d* of the interlock switch 73 is positioned so as to project from the second guide grooves 71Y2 as viewed on the upstream side in the installation direction of the toner container 32-4. In other words, when the toner container 32Y-4 is inserted into the toner container mount 31, the interlock release rib 32Y1*s*, provided on the cap 32Y1-4, is fitted in the second guide grooves 71Y2 and contacts the lever 73*d*.

The lever 73*d* is supported on the upper front case 701-4 rotatably around an axis and is biased in the direction indicated by arrow Y6 shown in FIG. 46A by a spring. One end (i.e., a first end) of the blade 73*c* engages the lever 73*d*, and the other end (i.e., a second end) is supported on a side of the switch body 73*a*. The button 73*b* is provided on the side of the switch body 73*a*, at a position facing the blade 73*c*.

The button 73*b* is used to switch the output from the interlock switch 73 between on and off. The output from the interlock switch 73 is used to enable and stop or prohibit driving of the bottle driving unit 90, data writing on the ID chip 32Y1*f*, and supply of toner. More specifically, when the output from the interlock switch 73 is off, the motor 92 of the bottle driving unit 90 is locked and is not driven. By contrast, when the output from the interlock switch 73 is on, the motor 92 of the bottle driving unit 90 is unlocked and can be driven.

Referring to FIG. 46B, when the toner container 32Y-4 is inserted into the insertion opening 71Y-4, the interlock release rib 32Y1*s* provided in the top portion of the cap 32Y1-4 comes into contact with the lever 73*d*. Contacting the interlock release rib 32Y1*s*, the lever 73*d* rotates around the axis clockwise in FIG. 46B. As the lever 73*d* thus rotates, the blade 73*c* engaging the lever 73*d* is pushed toward the switch body 73*a*. Then, the blade 73*c* approaching the switch body 73*a* presses the button 73*b* provided on the side of the switch body 73*a*, thereby turning on the output from the interlock switch 73. As a result, the motor 92 of the bottle driving unit 90 is unlocked. In this state, because the toner container 32Y-4 is set in the toner container mount 31 and the driving input parts 32Y2*b* engages the driving coupling 91, the motor 92 can drive the container body 32Y2-4, thereby conveying the toner inside the toner container 32Y-4 to the opening 32Y2*c*.

By contrast, when the toner container 32Y-4 is removed from the toner container mount 31, the interlock release rib 32Y1*s* moves away from the lever 73*d* (in FIG. 46B, downward). When the interlock release rib 32Y1*s* is disengaged from the lever 73*d*, the lever 73*d* rotates counterclockwise in FIG. 46B around the axis, biased by the spring. As the lever 73*d* thus rotates, the blade 73*c* moves away from the switch body 73*a*, is disengaged from the button 73*b*, and returns to the position shown in FIG. 46A. That is, the output from the interlock switch 73 is turned off, and the motor 92 is stopped. The driving coupling 91 is movable reciprocally in the installation direction of the toner container 32Y-4. Accordingly, when the toner container 32Y-4 is removed from the toner container mount 31, the engagement between the driving input parts 32Y2*b* and the driving coupling 91 is maintained for the distance in which the driving coupling 91 can move (see FIGS. 6 and 7). In other words, it is possible that the driving input parts 32Y2*b* engage the driving coupling 91 even when the toner container 32Y-4 is drawn out from the insertion opening 71Y-4 the distance in which the driving coupling 91 can move. Thus, even after the toner container 32Y-4 has moved a certain distance in the removal direction, the container body 32Y2-4 might be driven by the motor 92 although not intended.

In view of the foregoing, in the present embodiment, the interlock switch 73 can prohibit driving of the motor 92 during removal of the toner container 32Y-4 even if the driving input parts 32Y2*b* is in engagement with the driving coupling 91. More specifically, the controller 101 provided in the main body 100 of the image forming apparatus 200 detects the output from the interlock switch 73 and enables driving of the motor 92 only when the output from the interlock switch 73 is on.

Further, in the fourth embodiment, data writing on the ID chip 32Y1*f* as well as the supply of toner (driving of the toner supply device 60) can be enabled and stopped or prohibited by the output from the interlock switch 73.

It is to be noted that the lever 73*d* of the interlock switch 73 is positioned downstream (dismal) from the second guide groove 71Y2 in the installation direction of the toner container 71. The second guide groove 71Y2 has such a width (a length perpendicular to the installation direction) that the user's finger cannot fit in the second guide groove 71Y2 although the interlock release rib 32Y1*s* can fit in it. Therefore, the interlock is not unlocked unintentionally even if the user puts his/her finger in the second guide groove 71Y2.

Although, in the fourth embodiment, driving of the bottle driving unit 90, data writing on the ID chip 32Y1*f*, and supply of toner can be enabled and stopped or forbidden by the output from the interlock switch 73, the output from the lever position detector 79 may be used together with that from the interlock switch 73. In such a case, driving of the motor 92 and the like are enabled only when the controller 101 recognizes that both the lever position detector 79 and the interlock switch 73 output signals (outputs are on). By contrast, driving of the motor 92 and the like are stopped or forbidden when the controller 101 recognizes that the lever position detector 79 or the interlock switch 73, or both do not output signals (outputs are off).

Figure 47A:
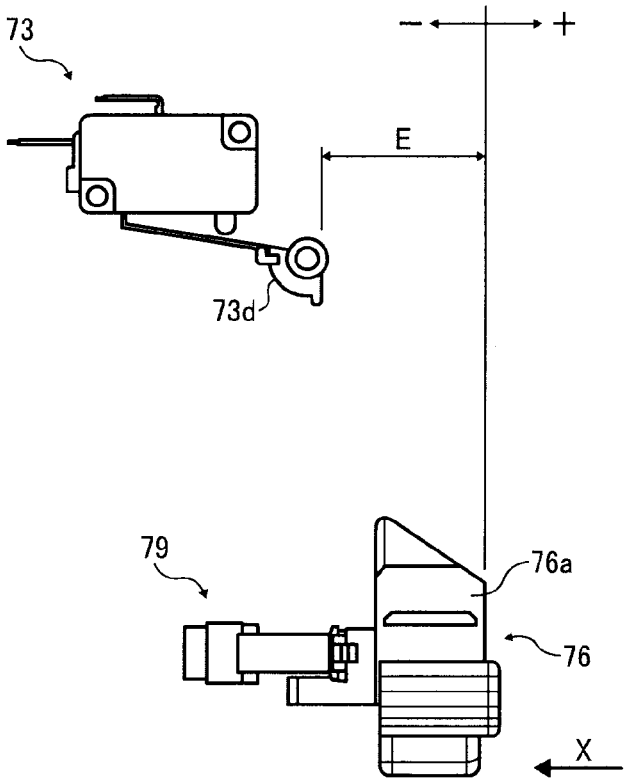
FIGS. 47A and 47B are respectively a schematic side view and a top view that illustrate the toner container, the interlock switch, and the lever.
Figure 47B:
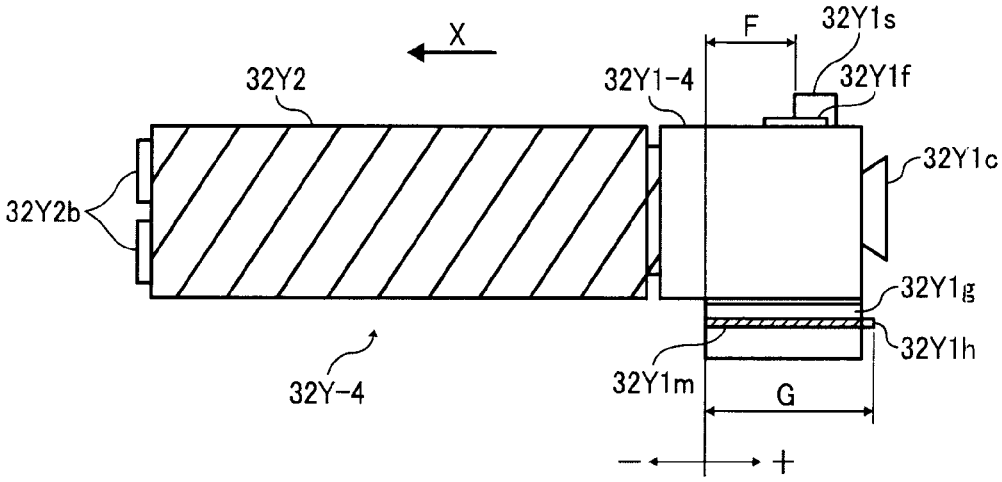

FIG. 47A is a schematic top view that illustrates relative positions of the lever 76 and the interlock switch 73 in the installation direction of the toner container 32Y-4, and FIG. 47B is a schematic side view of the toner container 32Y-4.

In FIG. 47A, the toner container 32Y-4 is inserted into the toner container mount 31 from the right to the left. In FIG. 47B, the toner container 32Y-4 is inserted into the toner container mount 31 from the right to the left as well.

The relative positions of the lever 76 and the interlock switch 73, in the installation direction of the toner container 32Y-4, are set such that G>F>E is satisfied wherein E represents a distance from the upstream end of the pawl 76*a* of the lever 76 to an upstream end of the lever 73*d* of the interlock switch 73, F represents a distance from the downstream end of the sliding contact portion 32Y1*m* to a downstream end of the interlock release rib 32Y1*s*, and G represents a distance from the downstream end of the sliding contact portion 32Y1*m* to the edge (upstream end) of the pressed portion 32Y1*h* in the installation direction of the toner container 32Y-4.

It is to be noted that the distance E is regarded as positive (+) when the upstream end of the lever 73*d* of the interlock switch 73 is positioned upstream (proximal) from the upstream end of the pawl 76*a* of the lever 76 in the installation direction of the toner container 32Y-4 and as negative (−) when it is positioned downstream (dismal) from the upstream end of the pawl 76*a* in that direction. It is to be noted that the distance F is regarded as positive (+) when the downstream end of the interlock release rib 32Y1*s* is positioned upstream (proximal) from the downstream end of the sliding contact portion 32Y1*m* in the installation direction of the toner container 32Y-4 and as negative (−) when the downstream end of the interlock release rib 32Y1*s* is positioned downstream (dismal) from the downstream end of the sliding contact portion 32Y1*m* in that direction. The distance G is regarded as positive (+) when the upstream end of the pressed portion 32Y1*h* is positioned upstream (proximal) from the downstream end of the sliding contact portion 32Y1*m* in the installation direction of the toner container 32Y-4 and as negative (−) when the upstream end of the pressed portion 32Y1*h* is positioned downstream (dismal) from the downstream end of the sliding contact portion 32Y1*m* in that direction.

In the arrangement in which the distance F is greater than the distance E (F>E), the interlock release rib 32Y1*s* does not contact the lever 73*d* of the interlock switch 73 even when the toner container 32Y-4 is at a position where the downstream end of the sliding contact portion 32Y1*m* comes into contact with the pawl 76*a* (as shown in FIG. 14) during installation of the toner container 32Y-4. In this state, the interlock switch 73 does not output signals (output is off) even though the lever position detector 79 outputs a signal (output is on). Therefore, driving of the motor 92, the data writing on the ID chip 32Y1*f*, and supply of toner can be prevented until the toner container 32Y-4 is secured in the toner container mount 31. In particular, in the state shown in FIG. 14, the toner container 32Y-4 can move because the first grooves 32Y1*g* do not yet fit around the positioning protrusions 78. If data is written in or read out from the electronic board (ID chip) 32Y1*f* in this state, it is possible that the electronic board 32Y1*f* is moved outside the communicational area of the antenna board 74 during data writing or reading, resulting in a communication error. Thus, the electronic board 32Y1*f* or the antenna board 74, or both can be damaged seriously.

In view of the foregoing, in the fourth embodiment, the relative positions of the toner container 32Y-4 and the toner container mount 31 are set so that the distance F is greater than the distance E (F>E). With this arrangement, rotation of the toner container 32Y-4 and data writing and reading from the electronic board 32Y1*f* can be executed only after the toner container 31Y-4 is secured in the toner container mount 31.

Additionally, because the distance G is greater than the distance F (G>F), the output from the lever position detector 79 can become on only after the output from the interlock switch 73 is turned on and the toner container 32Y-4 is secured in the toner container mount 31. Accordingly, driving of the toner container 32Y-4 (motor 92) and data writing and reading from the electronic board 32Y1*f* can be enabled only after the toner container 32Y-4 is secured in the toner container mount 31.

Table 2 illustrates relations among time of the various operations, on and off states of outputs from the detectors, and the movements of the respective components in the fourth embodiment.

TABLE 2

| Operational timing | Lever position detector | Interlock switch | Toner container rotation | Writing on electronic board | Screw pump driving |
|---|---|---|---|---|---|
| Toner container secured | ON | ON | Permitted | Permitted | Permitted |
| Lever released | OFF | ON | Prohibited | Prohibited | Prohibited |
| Toner container removed | ON | OFF | Prohibited | Prohibited | Prohibited |

TABLE 2-continued

| Operational timing | Lever position detector | Interlock switch | Toner container rotation | Writing on electronic board | Screw pump driving |
|---|---|---|---|---|---|
| Installation of new container started | OFF | Switched to ON | Prohibited | Prohibited | Prohibited |
| New container secured | ON | ON | Permitted | Permitted | Permitted |

Referring to table 2, when the toner container 32Y-4 is secured at the installation position in the toner container mount 31, the output from the lever position detector 79Y is on and the interlock switch 73 is on. In this state, any of rotation of the toner container 32Y-4, data writing on the IC chip (electronic board) 32Y1*f*, and driving of the screw pump 61 is permitted as required. When the lever 76 is released to remove the toner container 32Y-4 from the toner container mount 31, the output from the lever position detector 79 is turned off. In this state, rotation of the toner container 32Y-4, data writing on the IC chip (electronic board) 32Y1*f*, and driving of the screw pump 61 are stopped compulsively or forbidden even when the interlock switch 73 is on. When the toner container 32Y-4 is removed and is not present in the toner container mount 31, the output from the lever position detector 79 is on and the interlock switch 73 is off. In this state, rotation of the toner container 32Y-4, data writing on the IC chip (electronic board) 32Y1*f*, and driving of the screw pump 61Y are yet forbidden. Additionally, when a new (used or unused) toner container 32Y-4 is being inserted into the toner container mount 31, the output from the lever position detector 79 is off and the interlock switch 73 is switched from off to on. Because insertion of the toner container 32Y-4 is not yet completed even when the interlock switch 73 is turned on, the output from the lever position detector 79 remains off. Accordingly, rotation of the toner container 32Y-4, data writing on the IC chip (electronic board) 32Y1*f*, and driving of the screw pump 61Y are yet forbidden. When the new toner container 32Y-4 is set at the installation position, both the output from the lever position detector 79 and that from the interlock switch 73 are on. Therefore, rotation of the toner container 32Y-4, data writing on the IC chip (electronic board) 32Y1*f*, and driving of the screw pump 61Y are permitted as required.

Next, a flow of processes for setting the operation enabling flag performed by the controller 101 according to the fourth embodiment is described below.

Figure 51:
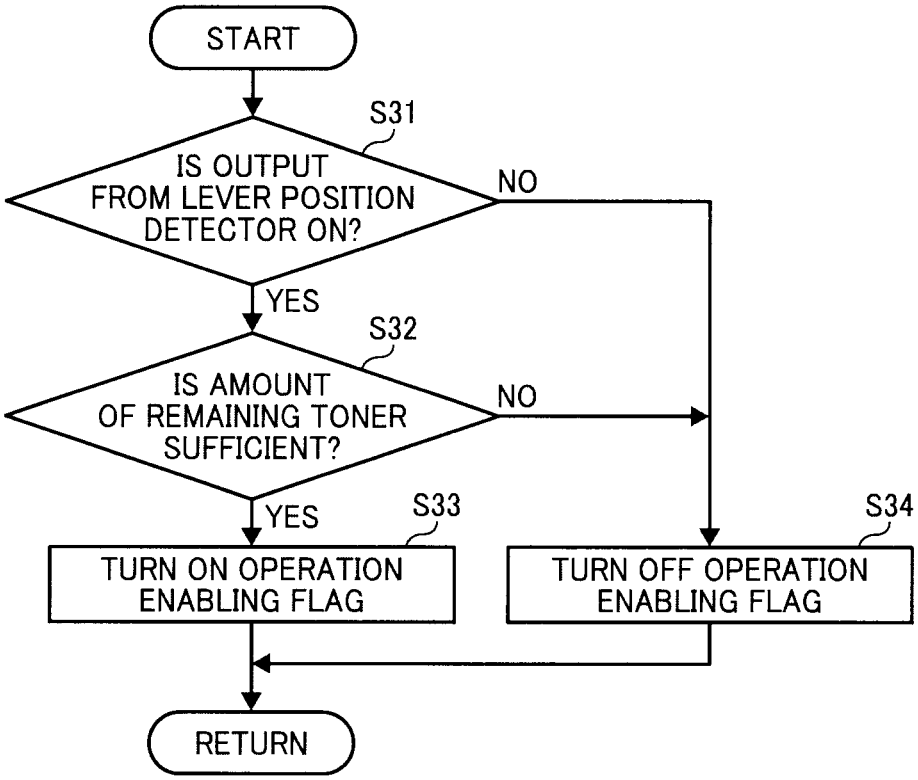
FIG. 51 is a flowchart that illustrates a flow of processes for setting operation enabling flag according to another embodiment.

FIG. 51 is a flowchart that illustrates a sequence of processes for setting the operation enabling flag by the controller 101 of the image forming apparatus 200 according to the fourth embodiment.

The operation enabling flag setting is performed repeatedly, independently for each of yellow, cyan, magenta, and black when a main power of the image forming apparatus 200 is on. At S31 the controller 101 checks the output from the lever position detector 79 and, at S32, checks the amount of toner remaining in the toner container 32Y-4. The controller 101 checks the amount of the remaining toner based on the data relating to that stored in the ID chip (electronic board) 32Y1*f*. When the output from the lever position detector 79 is on (Yes at S31) and it is recognized that the amount of remaining toner is sufficient (Yes at S32), at S33 the operation enabling flag is turned on. In other cases, at S44 the operation enabling flag is turned off. It is to be noted that, when the toner container 32Y is not set in the toner container mount 31, the amount of remaining toner cannot be retrieved from the ID chip 32Y1*f* (read error), and thus the controller 101 regards the amount of remaining toner as insufficient (No at S32).

In the fourth embodiment, because the amount of remaining toner is checked in the operation enabling flag setting shown in FIG. 51, the amount of remaining toner is not checked in the flow for allowing or forbidding driving of the screw pump 61 or rotation of the toner container 32Y-4. Thus, the control flow can be simplified.

Table 3 illustrates relations among time of the various operations, on and off states of outputs from the detectors, and the movements of the respective components.

TABLE 3

| Operational timing | Lever position detector | Amount of Toner | Screw pump driving |
|---|---|---|---|
| Toner container secured (with toner) | ON | Sufficient | Permitted |
| Toner container secured (without toner) | ON | Insufficient | Prohibited |
| Lever released | OFF | Sufficient or Insufficient | Prohibited |
| Toner container removed | ON | Not available (Insufficient) | Prohibited |
| Installation of new container started | OFF | Changed from "insufficient" to "sufficient" | Prohibited |
| New container secured | ON | Sufficient | Permitted |

When the toner container 32Y-4 is retained at the installation position and the amount of remaining toner is regarded as sufficient (Yes), the output from the lever position detector 79 is on. In this state, any of rotation of the toner container 32Y-4, data writing on the IC chip (electronic board) 32Y1*f*, and driving of the screw pump 61 is permitted as required. Even when the output from the lever position detector 79 is on, driving of the toner container 32Y-4, data writing on the IC chip (electronic board) 32Y1*f*, and driving of the screw pump 61 are prohibited when no toner is present in the toner container 32Y-4 or the amount of remaining toner is insufficient (No at S32 in FIG. 51). When the lever 76 is released to remove the toner container 32Y-4 from the toner container mount 31, the output from the lever position detector 79 is turned off. In this state, rotation of the toner container 32Y-4, data writing on the IC chip (electronic board) 32Y1*f*, and driving of the screw pump 61 are stopped compulsively or forbidden even when the amount of remaining toner is regarded as sufficient. When the toner container 32Y-4 is removed and is not present in the toner container mount 31, the output from the lever position detector 79 is on and the amount of remaining toner is regarded as insufficient. In this state, rotation of the toner container 32Y-4, data writing on the IC chip (electronic board) 32Y1*f*, and driving of the screw pump 61 are yet forbidden. Additionally, when a new (used or unused) toner container 32Y-4 is being inserted into the toner container mount 31, the output from the lever position detector 79 is off and the determination of the amount of remaining toner is switched from "insufficient" to "sufficient". Because insertion of the toner container 32Y-4 is not yet completed even when the amount of remaining toner is regarded as sufficient, the output from the lever position detector 79 remains off. Accordingly, rotation of the toner container 32Y-4, data writing on the IC chip (electronic board) 32Y1*f*, and driving of the screw pump 61 are yet forbidden. When the new toner container 32Y-4 is set at the installation position, the output from the lever position detector 79 is on and the amount of remaining toner is regarded as sufficient. Therefore, rotation of the toner container 32Y-4, data writing on the IC chip (electronic board) 32Y1*f*, and driving of the screw pump 32Y are permitted as required.

It is to be noted that, in the present embodiment, the outputs from the lever position detector 79, the antenna board 74, and the interlock switch 73 may be used in combination in the above-described control. In such a case, driving of the motor 92 and the like are enabled only when the controller 101 recognizes that all of the lever position detector 73, the antenna board 74, and the interlock switch 73 output signals (outputs are on). By contrast, driving of the motor 92 and the like are stopped or forbidden when the controller 101 recognizes that any of the lever position detector 79, the antenna board 74, and the interlock switch 73 does not output signals (outputs are off).

In a configuration in which the outputs from the lever position detector 79, the antenna board 74, and the interlock switch 73 are used in combination, it is preferable that the relative positions shown in FIGS. 41A and 41B (A>B), those shown in FIGS. 42A and 42B (D>C), and those shown in FIGS. 47A and 47B (G>F) be satisfied as well. With this arrangement, even in a case of a malfunction of any of the lever position detector 79, the antenna board 74, and the interlock switch 73 and the output is erroneous, driving of the toner container 32Y-4 (motor 92), data writing and reading from the electronic board 32Y1*f*, and the like can be controlled reliably.

It is to be noted that, although the toner containers 32 contain powder toner in the above-described first to fourth embodiments, alternatively, the toner containers 32 may contain two-component developer consisting essentially of toner and carrier to be used in image forming apparatuses that use two-component developer. In such a configuration, effects similar to those attained in the above-described embodiments can be also attained.

Further, at least one of the components of the image forming unit 3 may be held together with the photoreceptor drum 1 in a common unit casing, that is, the image forming unit 3 may be configured as a process cartridge removably insertable into the main body 100. In such a configuration, effects similar to those attained in the above-described embodiments can be also attained.

The number, position, shape of the components of the image forming apparatus described above are not limited to those described above.

Numerous additional modifications and variations are possible in light of the above teachings. It is therefore to be understood that, within the scope of the appended claims, the disclosure of this patent specification may be practiced otherwise than as specifically described herein.

What is claimed is:

1. A powder container, removably installable horizontally in an apparatus, the powder container comprising:

a powder containing compartment for containing a powder, having a powder outlet connectable to a powder inlet of a horizontally extending tube of the apparatus in conjunction with installation of the powder container in the apparatus, the powder outlet from which the powder contained in the powder containing compartment is discharged to the tube through the powder inlet thereof;

a tube inlet for receiving the tube of the apparatus;

a removably insertable plug member to open and close the powder outlet of the powder containing compartment in conjunction with installation of the powder container in the apparatus; and at least one discrimination protrusion projecting from an outer circumferential surface of the powder container and positioned such that a downstream end of the discrimination protrusion is disposed downstream from a downstream end of the powder outlet of the powder containing compartment in an installation direction in which the powder container is installed in the apparatus, at least one of shape, arrangement, and quantity of the discrimination protrusion being unique to the type of powder contained in the powder container, the powder container further comprising:

a horizontally extending tube connection compartment into which the tube of the apparatus is inserted horizontally after passing through the tube inlet, and in which the plug member is contained, the tube connection compartment communicating with the powder outlet of the powder containing compartment, wherein the plug member prevents discharge of the powder from the powder container when the plug member is in a closed position, wherein the powder containing compartment comprises:

a container body having an opening in an upstream end portion thereof, the opening facing in the installation direction of the powder container; and a cap to cover the opening of the container body, wherein the powder outlet and the tube connection compartment are formed in the cap, and wherein the tube inlet faces in an opposite direction as the opening of the container body.

2. The powder container according to claim 1, further comprising an electronic data storage unit for storing data relating to the powder container, communicably connected to a communication circuit of the apparatus, wherein the electronic data storage unit is positioned opposite the tube connection compartment relative to a long axis of the cap.

3. The powder container according to claim 1, further comprising a rotatable powder conveyance member inside the container body for conveying the powder through the container body to the opening thereof.

4. The powder container according to claim 1, wherein the cap is retained stationary in the apparatus at a fixed position relative to the apparatus upon installation of the powder container in the apparatus, and the container body rotatively engages the cap.

5. The powder container according to claim 4, wherein the container body comprises a spiral protrusion protruding inward from an inner circumferential surface of the container body that conveys the powder contained in the container body therealong to the opening of the container body as the container body rotates.

6. The powder container according to claim 1, further comprising a rotatable powder conveyance member inside the powder containing compartment for conveying the powder through the powder containing compartment to the powder outlet thereof.

7. The powder container according to claim 1, further comprising an electronic data storage unit for storing data relating to the powder container, communicably connected to a communication circuit of the apparatus, wherein the electronic data storage unit is positioned opposite the powder outlet relative to a long axis of the powder containing compartment.

8. The powder container according to claim 1, incorporated in an image forming apparatus.

9. The powder container according to claim 1, wherein:

the plug member prevents discharge of the powder from the powder container when the plug member is in a closed position, opens and closes the powder outlet of the powder containing compartment by moving horizontally relative to the apparatus inside the tube connection compartment in conjunction with installation of the powder container in the apparatus.

10. A powder container, removably installable horizontally in an apparatus, the powder container comprising:

a powder containing compartment for containing a powder, having a powder outlet connectable to a powder inlet of a horizontally extending tube of the apparatus in conjunction with installation of the powder container in the apparatus, the powder outlet from which the powder contained in the powder containing compartment is discharged to the tube through the powder inlet thereof;

a tube inlet for receiving the tube of the apparatus; and a horizontally extending tube connection compartment into which the tube of the apparatus is inserted horizontally after passing through the tube inlet, the tube connection compartment communicating with the powder outlet of the powder containing compartment, wherein the powder containing compartment includes a conveying member to transport powder in the powder containing compartment in a direction opposite an installation direction in which the powder container is installed in the apparatus, and wherein the tube inlet faces the direction in which the conveying member transports powder inside the powder containing compartment.

11. The powder container according to claim 10, further comprising:

a removably insertable plug to open and close the powder outlet of the powder containing compartment in conjunction with installation of the powder container in the apparatus.

12. The powder container according to claim 11, wherein:

the horizontally extending tube connection compartment contains the plug.

13. The powder container according to claim 11, wherein:

wherein the plug prevents discharge of the powder from the powder container when the plug is in a closed position.

14. The powder container according to claim 10, wherein the powder containing compartment comprises:

a container body having an opening in an upstream end portion thereof, the opening facing in the installation direction of the powder container; and a cap to cover the opening of the container body, wherein the powder outlet and the tube connection compartment are formed in the cap.

15. The powder container according to claim 10, further comprising:

at least one discrimination protrusion projecting from an outer circumferential surface of the powder container and positioned such that a downstream end of the discrimination protrusion is disposed downstream from a downstream end of the powder outlet of the powder containing compartment in an installation direction in which the powder container is installed in the apparatus, at least one of shape, arrangement, and quantity of the discrimination protrusion being unique to the type of powder contained in the powder container.

* * * * *